US011089936B2

(12) United States Patent
Ham et al.

(10) Patent No.: US 11,089,936 B2
(45) Date of Patent: Aug. 17, 2021

(54) DISHWASHER AND HOME APPLIANCE

(71) Applicant: SAMSUNG ELECTRONICS CO., LTD., Suwon-si (KR)

(72) Inventors: Hyung Kwen Ham, Seoul (KR); Hyeon Kyu Lim, Hwaseong-si (KR); Yong Soo Kyong, Yongin-si (KR); Nam Soo Park, Suwon-si (KR); Chang Wook Lee, Seoul (KR); Jin Doo Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/643,686

(22) PCT Filed: Mar. 28, 2018

(86) PCT No.: PCT/KR2018/003651
§ 371 (c)(1),
(2) Date: Mar. 2, 2020

(87) PCT Pub. No.: WO2019/045210
PCT Pub. Date: Mar. 7, 2019

(65) Prior Publication Data

US 2020/0221921 A1 Jul. 16, 2020

(30) Foreign Application Priority Data

Aug. 31, 2017 (KR) ..... 10-2017-0111481
Nov. 22, 2017 (KR) ..... 10-2017-0156190

(51) Int. Cl.
*A47L 15/42* (2006.01)
*A47L 15/00* (2006.01)

(52) U.S. Cl.
CPC ..... *A47L 15/4261* (2013.01); *A47L 15/0086* (2013.01); *A47L 15/4259* (2013.01); *A47L 15/4263* (2013.01)

(58) Field of Classification Search
CPC ..... A47L 15/0086; A47L 15/4259; A47L 15/4261; A47L 15/4263
(Continued)

(56) References Cited

U.S. PATENT DOCUMENTS 1,995,331 A * 3/1935 Snyder ..... A47L 15/0031 134/58 D
3,001,227 A * 9/1961 Long ..... A47L 15/4261 16/290
(Continued)

FOREIGN PATENT DOCUMENTS

EP 2568864 1/2015
EP 2927603 10/2015
(Continued)

OTHER PUBLICATIONS

International Search Report dated Jul. 19, 2018 from International Patent Application No. PCT/KR2018/003651, 4 pages.
(Continued)

*Primary Examiner* — James O Hansen
(74) *Attorney, Agent, or Firm* — Staas & Halsey LLP

(57) ABSTRACT

The present disclosure relates to a dishwasher. The dishwasher, which is installed in a built-in manner in a system kitchen including a cabinet having a receiving space and a counter disposed on the cabinet to include an opening, includes a tub including a front opening, a front door configured to open and close the front opening, a cover frame disposed in the opening of the counter, an upper door rotatably coupled to the cover frame to open and close the opening of the counter, a trigger configured to lock or unlock
(Continued)

the upper door, and a lift apparatus disposed to be spaced apart from the trigger and configured to open the upper door by a predetermined angle when the trigger releases the locking of the upper door.

15 Claims, 51 Drawing Sheets

(58) Field of Classification Search
USPC ..... 312/276, 228, 311, 312, 290
See application file for complete search history.

(56) References Cited

U.S. PATENT DOCUMENTS 3,207,167 A * 9/1965 Edstrom ..... A47L 15/506 134/144
3,727,622 A * 4/1973 Jacobs ..... A47L 15/502 134/183
3,997,201 A * 12/1976 DeSchaaf ..... A47L 15/4259 292/173
4,739,781 A * 4/1988 Casoli ..... A47L 15/0086 134/115 R
2003/0205250 A1* 11/2003 DeBoer ..... A47L 15/4293 134/57 D
2016/0348919 A1 12/2016 Ivanovic et al.

FOREIGN PATENT DOCUMENTS

| | | |
|---|---|---|
| FR | 2004067 | 11/1969 |
| JP | 11-178661 | 7/1999 |
| JP | 2001-377 | 1/2001 |
| JP | 2002-10961 | 1/2002 |
| KR | 10-1996-0016831 | 6/1996 |
| KR | 10-2008-0064303 | 7/2008 |
| KR | 10-2011-0045741 | 6/2011 |

OTHER PUBLICATIONS

Extended European Search Report dated Apr. 3, 2020 from European Application No. 18852402.9, 7 pages.

* cited by examiner

DISHWASHER AND HOME APPLIANCE

CROSS-REFERENCE TO RELATED APPLICATIONS

This application is a U.S. National Stage Application which claims the benefit under 35 U.S.C. § 371 of International Patent Application No. PCT/KR2018/003651 filed on Mar. 28, 2018, which claims foreign priority benefit under 35 U.S.C. § 119 of Korean Patent Application Nos. 10-2017-0111481 filed on Aug. 31, 2017 and Application No. 10-2017-0156190 filed on Nov. 22, 2017, the contents of all of which are incorporated herein by reference.

TECHNICAL FIELD

The present disclosure relates to a dishwasher and a home appliance, and more particularly, to a dishwasher and a home appliance having a structure with improved ease of use.

BACKGROUND ART

In general, home appliances such as dishwashers, refrigerators, washing machines, and ovens include a door for opening and closing an internal space. There are many kinds of home appliances with a door, but in particular, a dishwasher will be described as an example. The dishwasher is an apparatus that automatically cleans food residues on dishes using a detergent and washing water.

As an example, a dishwasher includes a main body having a front opening and a tub disposed therein, a door installed on the main body to open and close the front opening, a basket for receiving dishes, an injection nozzle for injecting washing water, and the like. In such a front loading type dishwasher, food residues on the dishes may fall on a mounting surface of the dishwasher when the dishes are loaded into the basket.

As another example, a dishwasher includes a main body having an upper opening and a tub disposed therein, a door installed on the main body to open and close the upper opening, a basket for receiving dishes, an injection nozzle for injecting washing water, and the like. In such a top loading type dishwasher, loading of dishes having a certain size or more may be difficult due to interfering with an upper space of the tub and the door.

Accordingly, a new type of dishwasher capable of solving the problems of the front loading type dishwasher and the top loading type dishwasher is required.

DISCLOSURE

Technical Problem

The present disclosure is directed to providing a dishwasher having an improved structure capable of front loading and top loading of dishes.

The present disclosure is directed to providing a dishwasher and a home appliance in which an upper door is capable of being easily opened and closed without a separate handle protruding from the upper door.

Technical Solution

One aspect of the present disclosure provides a dishwasher, which is installed in a built-in manner in a system kitchen including a cabinet having a receiving space and a counter disposed on the cabinet to include an opening, including a tub including a front opening, a front door configured to open and close the front opening, a cover frame disposed in the opening of the counter, an upper door rotatably coupled to the cover frame to open and close the opening of the counter, a trigger configured to lock or unlock the upper door, and a lift apparatus disposed to be spaced apart from the trigger and configured to open the upper door by a predetermined angle when the trigger releases the locking of the upper door.

The dishwasher may further include a latch-locker module configured to support a portion of the lift apparatus or to be coupled to the lift apparatus as the latch-locker module is selectively pressed by the trigger, wherein the trigger may be disposed on the cover frame, and the latch-locker module and the lift apparatus may be disposed inside the upper door.

The latch-locker module may include a locker, the lift apparatus may include a lifter supported by or coupled to the locker, and the lifter may be configured to be coupled to the locker when the upper door is opened and to be supported by the locker when the upper door is closed.

The trigger may be disposed on the other end opposite to one end on which a rotation shaft of the upper door is disposed, and the cover frame may include a locking opening into which a portion of the trigger is selectively inserted.

The trigger may be disposed on a portion of the cover frame close to the other end opposite to the one end on which a rotation shaft of the upper door is disposed, and the upper door may include a locking opening into which a portion of the trigger is selectively inserted.

The trigger may include a locking member configured to be movable between a locking position and an unlocking position, an elastic member configured to elastically bias the locking member to the locking position, and a button member configured to move the locking member in a direction of releasing the locking of the upper door as the button member is pressed.

The trigger may include a button member configured to be movable, a locking member configured to be movable between a locking position and an unlocking position, a driving apparatus configured to move the locking member between the locking position and the unlocking position, and a control module comprising a sensor configured to detect the movement of the button member to drive the driving apparatus.

The lift apparatus may be disposed in the upper door, and the cover frame may include a pressing portion to press a portion of the lift apparatus in a direction in which the upper door is opened when the upper door is closed.

The lift apparatus may include an arm member pressed by the pressing portion when the upper door is closed, and an elastic member configured to elastically bias the arm member in a direction opposite to the direction in which the upper door is opened.

The lift apparatus may be disposed on an upper end portion of the tub.

The lift apparatus may include a driving source, a cam connected to the driving source, a support configured to move up and down by sliding on an outer circumferential surface of the cam as the cam rotates, and a push member in which one end thereof is in contact with the support to receive a force from the support and open the upper door by a predetermined angle and the other end opposite to the one end is disposed to be in contact with the upper door.

The push member may include a push pin and a push shaft configured to be screw-coupled to the push pin, and a length of the push member may be adjusted by adjusting a degree of screw coupling of the push shaft to the push pin.

The lift apparatus may further include a switch configured to detect a rotational position of the cam.

The upper door may further include a catch member disposed on a lower surface thereof, and the lift apparatus may include a connection member, a hook member rotatably connected to the connection member and configured to be connectable to the catch member, a case comprising a guide slit to guide the movement of the connection member and the hook member, an elastic member in which one end thereof is fixed to the case and the other end opposite to the one end is fixed to the connection member, wherein the elastic member is configured to elastically bias the connection member in a direction in which the upper door is opened, and a driving unit configured to apply a force to the connection member such that the connection member is movable in a direction in which the upper door is closed.

The lift apparatus may include a driving source, a power transmission member configured to receive power from the driving source and comprising a first guide portion formed at a portion along an outer circumferential surface thereof, and a push member comprising a second guide portion coupled to the first guide portion, wherein the push member is configured to open the upper door only by a predetermined angle as the power transmission member is driven.

The lift apparatus may be disposed on the cover frame and may include a driving source, a support connected to the driving source, a push member configured to receive power from the support and open the upper door only by a predetermined angle, a connection shaft to connect the support to the push member, a guide slit to guide the movement of the connection shaft, and a restriction member to restrict a range of the movement of the connection shaft.

Another aspect of the present disclosure provides a dishwasher including a tub having a front opening and an upper opening, a front door configured to open and close the front opening, an upper door configured to open and close the upper opening, a cover frame configured to rotatably support the door, and a trigger disposed on the other end opposite to one end on which a rotation shaft of the upper door is disposed, the trigger configured to lock or unlock the upper door, and a lift apparatus disposed above the tub and configured to open the upper door by a predetermined angle when the trigger releases the locking of the upper door.

The lift apparatus may include a driving source, a push member configured to be movable up and down at a lower side of the upper door, and a power transmission member configured to receive power from the driving source and move the push member up and down.

The power transmission member may include a cam connected to the driving source, and a support configured to slidingly move up and down along an outer circumferential surface of the cam as the cam rotates, to move the push member up and down.

The upper door may further include a catch member disposed on a lower surface thereof, and the lift apparatus may include a latch module configured to be connectable to the catch member, a case including a guide slit to guide the movement of the latch module, an elastic member in which one end thereof is fixed to the case and the other end opposite to the one end is fixed to the latch module, the elastic member configured to elastically bias the latch module in a direction in which the upper door is opened, and a driving unit configured to apply a force to the latch module such that the latch module is movable in a direction in which the upper door is closed.

Another aspect of the present disclosure provides a home appliance including a cabinet having an opening formed on an upper surface thereof, an upper door configured to open and close the opening of the cabinet, a cover frame disposed in the opening of the cabinet to rotatably support the upper door, a trigger disposed on the cover frame to lock or unlock the upper door, a lift apparatus disposed on the upper door and configured to open the upper door by a predetermined angle when the trigger releases the locking of the upper door, and a latch-locker module configured to support a portion of the lift apparatus or to be coupled to the lift apparatus as the latch-locker module is selectively pressed by the trigger.

The latch-locker module may include a locker, the lift apparatus may include a lifter supported by or coupled to the locker, and the lifter may be configured to be coupled to the locker when the upper door is opened and to be supported by the locker when the upper door is closed.

Advantageous Effects

Because a dishwasher according to an embodiment of the present disclosure includes a front door and an upper door, both front loading and top loading of dishes can be implemented.

Because a dishwasher and a home appliance according to an embodiment of the present disclosure include a trigger configured to lock or unlock an upper door and a lift apparatus configured to open to the extent that the upper door can be lifted by a user according to the operation of the trigger, the upper door can be easily opened and closed without a separate handle protruding from the upper door.

A dishwasher and a home appliance according to an embodiment of the present disclosure can reduce the inconvenience that a user may feel when contacting a structure protruding on a counter such as a handle because an upper door can be easily opened and closed without a separate handle protruding from the upper door.

MODE OF THE INVENTION

Hereinafter, embodiments of the present disclosure will be described in detail with reference to the accompanying drawings. In this specification, the terms "front end," "rear end," "upper portion," "lower portion," "upper end" and "lower end" used in the following description are defined with reference to the drawings, and the shape and position of each component are not limited by these terms.

Figure 1:
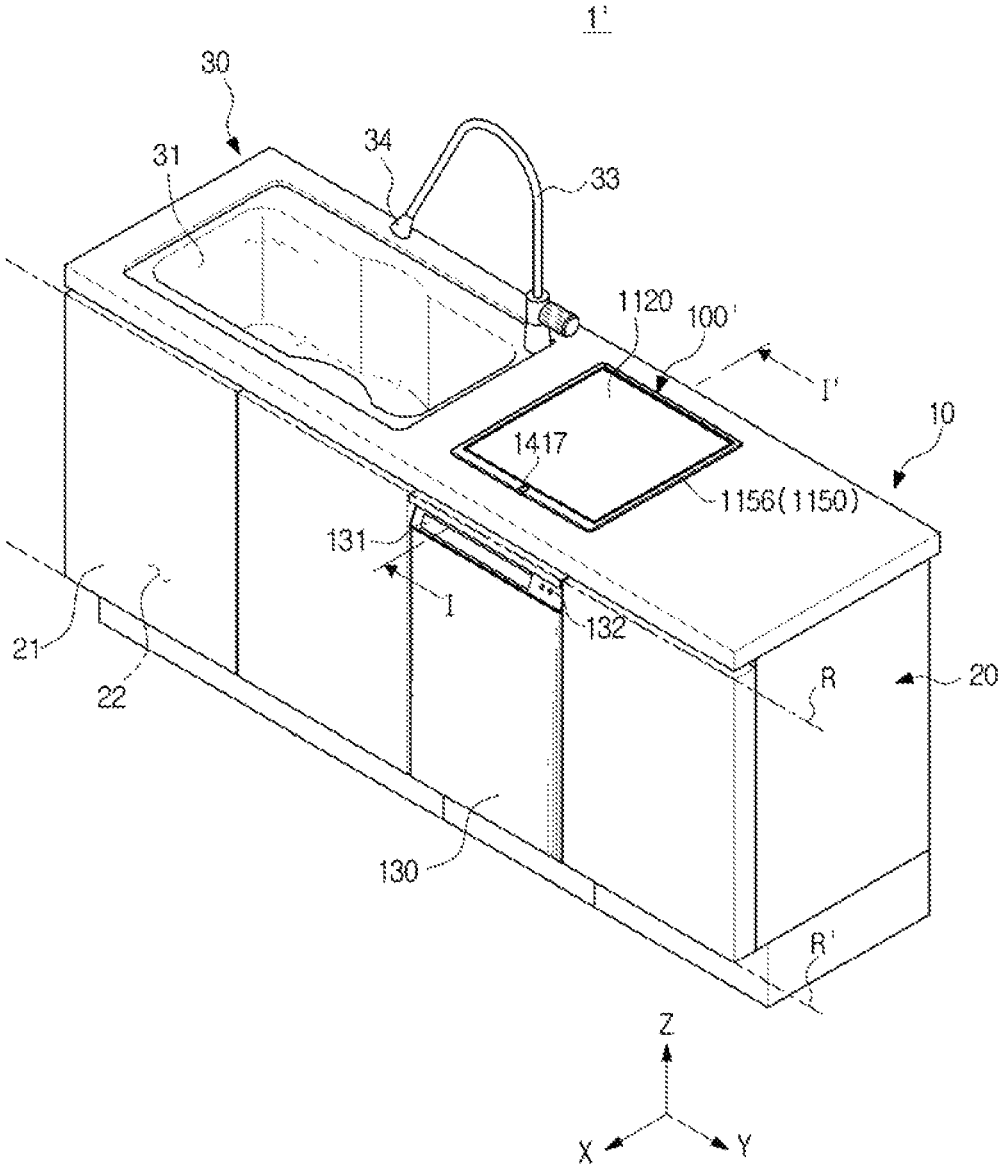
FIG. 1 is a view illustrating a system kitchen in which a dishwasher according to an embodiment of the present disclosure is installed in a built-in manner.
Figure 2:
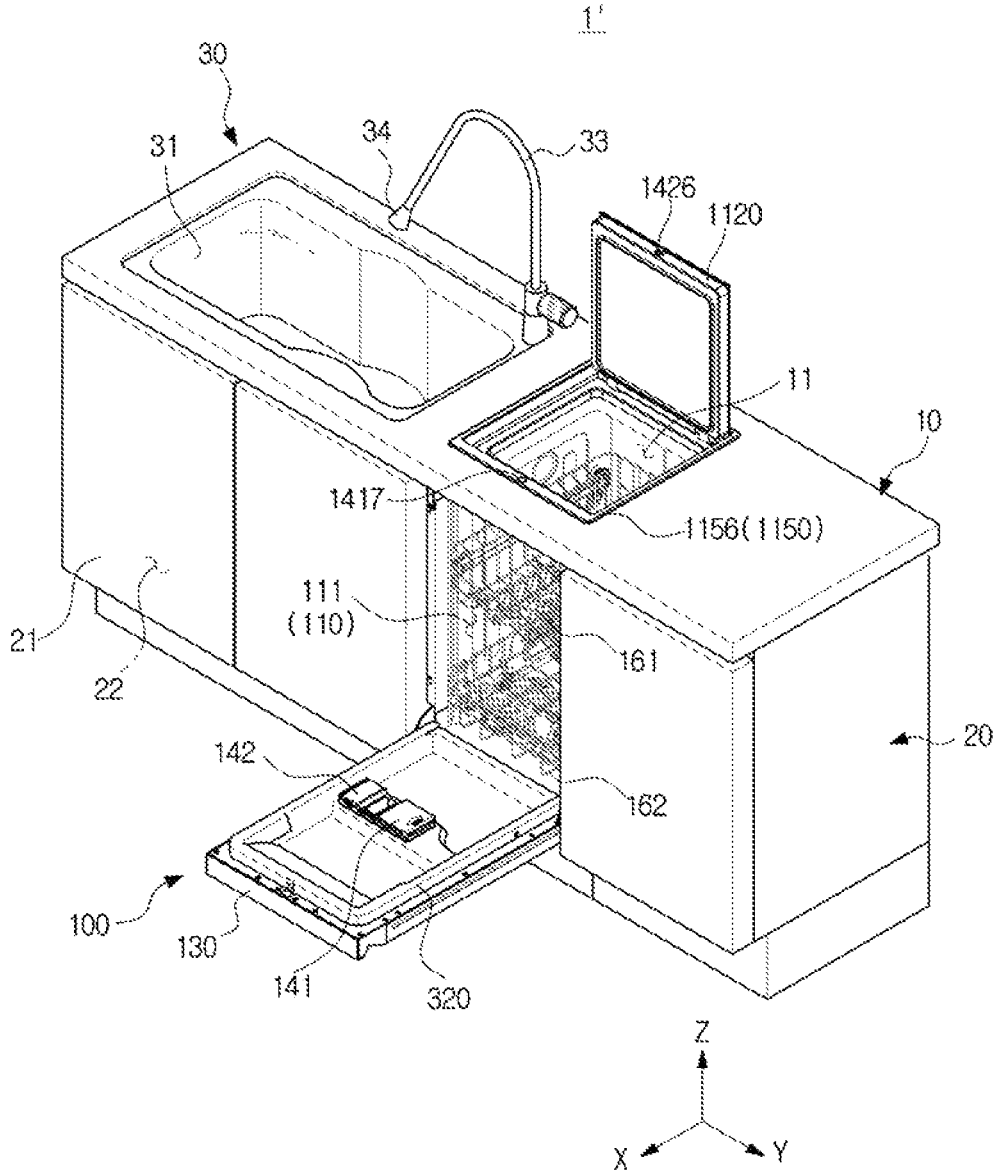
FIG. 2 is a view illustrating a state in which a front door and an upper door of the dishwasher in the system kitchen shown in FIG. 1 are opened.

FIG. 1 is a view illustrating a system kitchen in which a dishwasher according to an embodiment of the present disclosure is installed in a built-in manner. FIG. 2 is a view illustrating a state in which a front door and an upper door of the dishwasher in the system kitchen shown in FIG. 1 are opened. Hereinafter, "X" represents the front-rear direction of a system kitchen 1, "Y" represents the left-right direction of a system kitchen 1', and "Z" represents the up-down direction of the system kitchen 1'. The left-right direction of the system kitchen 1' may be referred to as a width direction of the system kitchen 1'. The up-down direction of the system kitchen 1' may be referred to as a height direction of the system kitchen 1'. In addition, the front-rear direction, the left-right direction and the up-down direction of the system kitchen 1' may be referred to as the front-rear direction, the left-right direction and the up-down direction of a dishwasher 100', respectively.

As illustrated in FIGS. 1 and 2, the system kitchen 1' may include a cabinet 20 having a receiving space 22 and a counter 10 disposed on the cabinet 20. The counter 10 may be formed in a flat plate shape. The counter 10 may be referred to as a "cooking table." An opening 11 may be formed on the counter 10.

The cabinet 20 may be provided with a receiving space 22 capable of receiving a variety of kitchen utensils. The receiving space 22 may be opened and closed by a cabinet door 21. As an example, the cabinet door 21 may be provided to be rotatable.

The cabinet 20 may include a partition (not shown) disposed inside the cabinet 20 to partition the receiving space 22. As an example, the partition wall may extend in a height direction Z of the system kitchen 1' to partition the receiving space 22 into a plurality of spaces.

The system kitchen 1' may further include a sink 30 configured to wash dishes or to clean food ingredients. The sink 30 may be provided on one side of the counter 10. The sink 30 may include a sink bowl 31 installed on the counter 10 to wash dishes or food ingredients. The sink ball 31 may be provided with a drain hole (not shown) to drain water supplied to the sink ball 31. The sink 30 may further include a water pipe 33 installed adjacent to the sink ball 31 to supply water to the sink ball 31. A faucet 34 may be coupled to one end of the water pipe 33. Water supplied from the faucet 34 to the sink bowl 31 may be drained through the drain hole and a drain pipe (not shown) connected to the drain hole.

The system kitchen 1' may further include the dishwasher 100' installed in the system kitchen 1' in a built-in manner.

The dishwasher 100' may include a plurality of doors 1120 and 130 for the convenience of a user. In detail, the dishwasher 100' may include the upper door 1120 provided to enable top loading of the dishes and the front door 130 provided to enable front loading of the dishes. The upper door 1120 and the front door 130 may be rotatably installed. However, the installation form of the upper door 1120 and the front door 130 is not limited to the above example and may be variously changed. As an example, the upper door 1120 and the front door 130 may be installed to open or close in a sliding manner. As another example, one of the upper door 1120 and the front door 130 may be installed to open or close in the sliding manner, and the other of the upper door 1120 and the front door 130 may be installed to open or close in a rotational manner. Hereinafter, a case where the upper door 1120 and the front door 130 are rotatably installed will be described. The upper door 1120 may be rotatably installed on a cover frame 1150. The front door 130 may be rotatably installed on a tub 110.

The upper door 1120 may be configured to open and close the opening 11 of the counter 10.

The front door 130 may be provided with at least one of a detergent box 141 configured to supply a detergent to the inside of the tub 110 and a rinse box 142 configured to supply a rinse to the inside of the tub 110.

The front door 130 may be provided with a display 131 configured to display an operating state of the dishwasher 100' and the like. In detail, the display 131 may be provided an upper side of a front surface of the front door 130. The display 131 may be implemented as a touch screen structure to allow the user to input a command.

The front door 130 may be provided with an operating portion 132. As an example, the operating portion 132 may include a power button of the dishwasher 100' and the like. The operating portion 132 may be provided on one side of the display 131.

Preferably, at least one of the display 131 and the operating portion 132 may be provided on the front door 130.

The dishwasher 100' may further include the tub 110 having a washing space 330 formed therein. The tub 110 may include a front opening 111 capable of being opened and closed by the front door 130. Preferably, the front opening 111 may be larger than the opening 11 formed on the counter 10. The tub 110 may further include an upper opening 112 (see FIG. 3) provided to correspond to the opening 11 formed on the counter 10. Accordingly, the upper door 1120 may be configured to open and close the upper opening 112 of the tub 110.

The dishwasher 100' may further include the cover frame 1150. The cover frame 1150 may be mounted in the opening 11 of the counter 10. The upper door 1120 may be installed on the cover frame 1150. The cover frame 1150 may be mounted to the opening 11 in a state where a portion of the cover frame 1150 is placed on the counter 10 at a periphery of the opening 11. That is, the cover frame 1150 may include a bent portion 1156 formed at one end thereof so as to rest on the counter 10. The bent portion 1156 of the cover frame 1150 may be exposed to the outside. A width w1 of the cover frame 1150 exposed to the outside may be larger than a width w2 of the opening 11 formed on the counter 10 (see FIG. 3). In this case, the width w1 of the cover frame 1150 and the width w2 of the opening 11 refer to those measured based on a width direction Y of the system kitchen 1. Therefore, the cover frame 1150 may be mounted in the opening 11 in a state where the bent portion 1156 of the cover frame 1150 is supported by the counter 10.

The dishwasher 100' may further include one or more baskets 161 and 162 disposed inside the tub 110 to be withdrawable through the front opening 111. The one or more baskets 161 and 162 may be referred to as "front loading baskets." As an example, the dishwasher 100' may include the upper basket 161 disposed at an upper portion of the tub 110 in an up-down direction Z of the dishwasher 100', and the lower basket 162 disposed below the upper basket 161 in the up-down direction Z of the dishwasher 100'.

The front door 130 of the dishwasher 100' may form an appearance of the system kitchen 1'. In detail, the front door 130 of the dishwasher 100' may form a front appearance of the system kitchen 1' together with the cabinet door 21.

An upper end of the front door 130 and an upper end of the cabinet door 21 may be positioned on a reference line R extending in the width direction Y of the system kitchen 1'. The reference line R may be an imaginary line extending in the width direction Y of the system kitchen 1' so as to be parallel to the counter 10. As such, by designing such that the upper end of the front door 130 and the upper end of the cabinet door 21 are positioned on a straight line, the system kitchen 1' of a neat image having a sense of unity as a whole may be implemented.

Preferably, a lower end of the front door 130 and a lower end of the cabinet door 21 may also be positioned on a reference line R' extending in the width direction Y of the system kitchen 1'. The reference line R' may be an imaginary line extending in the width direction Y of the system kitchen 1' so as to be parallel to the counter 10. That is, the reference line R' may be parallel to the reference line R.

The upper door 1120 of the dishwasher 100' may form the appearance of the system kitchen 1'. In detail, the upper door 1120 of the dishwasher 100' may form an upper appearance of the system kitchen 1' together with the counter 10. The upper door 1120 may be configured such that a step with the counter 10 in the height direction Z of the system kitchen 1' is not large. When the upper door 1120 is configured such that the step with the counter 10 in the height direction Z of the system kitchen 1' is large, that is, when the upper door 1120 is configured to excessively protrude in an upward direction of the system kitchen 1, ease of use may be lowered. As an example, the user may collide with the upper door 1120 protruding excessively in the upward direction of the system kitchen 1'.

Figure 3:
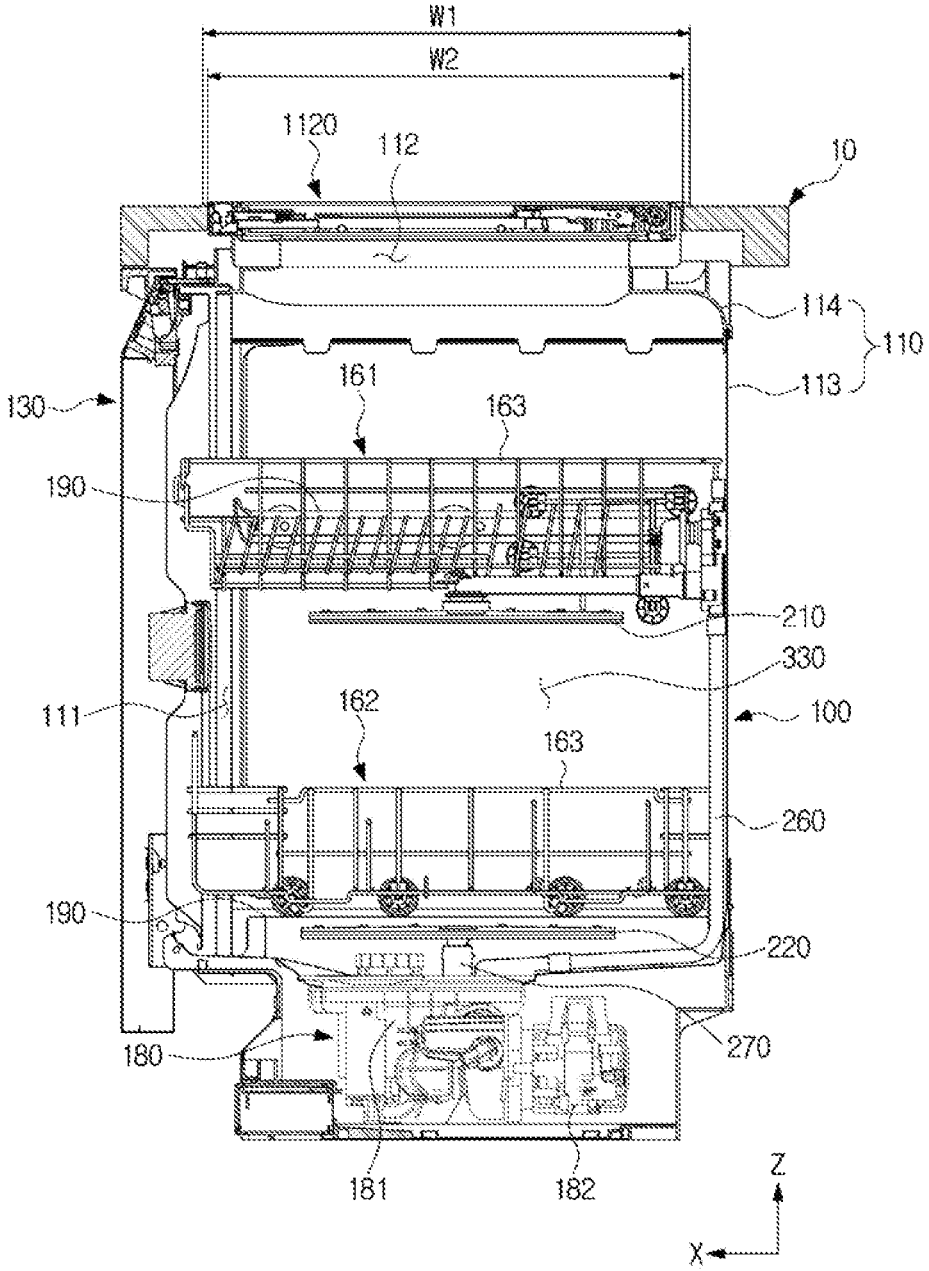
FIG. 3 is a cross-sectional view taken along line I-I' of the system kitchen shown in FIG. 1.
Figure 4:
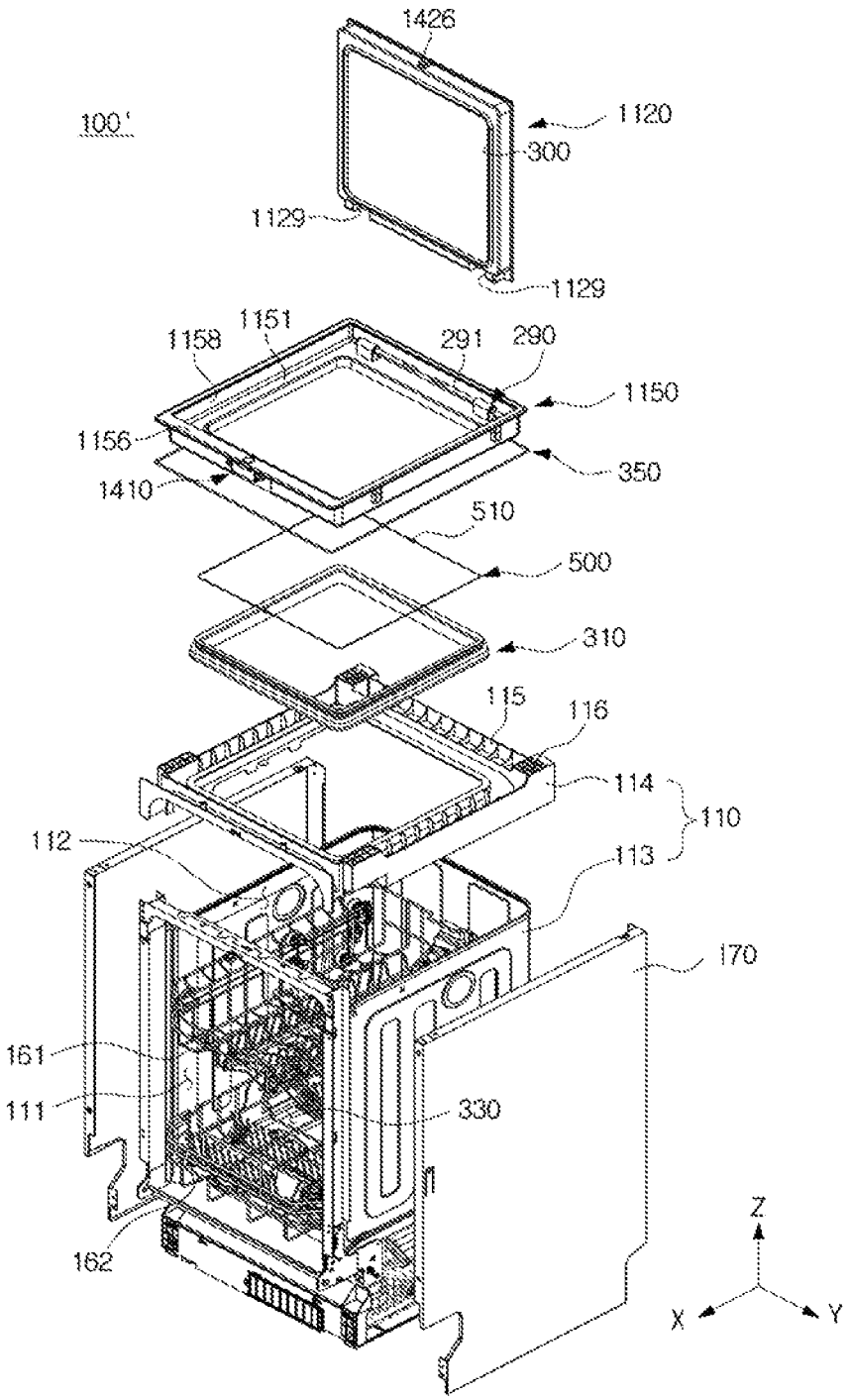
FIG. 4 is an exploded perspective view of the dishwasher in the system kitchen shown in FIG. 1.

FIG. 3 is a cross-sectional view taken along line I-I' of the system kitchen shown in FIG. 1. FIG. 4 is an exploded perspective view of the dishwasher in the system kitchen shown in FIG. 1. For reference, the front door 130 is not shown in FIG. 4.

As illustrated in FIGS. 3 and 4, the dishwasher 100' may include the tub 110 having the washing space 330 formed therein, and a sump 180 provided at a lower portion of the tub 110 to receive washing water.

The one or more baskets 161 and 162 may be disposed inside the tub 110 to be capable of reciprocating in the front-rear direction X of the system kitchen 1. In detail, the one or more baskets 161 and 162 may be drawn in and out through the front opening 111 of the tub 110 by at least one rack 190 slidingly supporting the one or more baskets 161 and 162.

The one or more baskets 161 and 162 may have an opened upper end to receive dishes therein. The one or more baskets 161 and 162 may be composed of wires 163 arranged in a lattice shape so that dishes received therein may be easily washed by washing water. In other words, the one or more baskets 161 and 162 may be composed of a plurality of the wires 163 intersecting each other to receive dishes therein.

The dishwasher 100' may further include one or more injectors 210 and 220 configured to inject washing water. The one or more injectors 210 and 220 may include the first injector 210 positioned between the upper basket 161 and the lower basket 162, and the second injector 220 positioned below the lower basket 162.

The first injector 210 and the second injector 220 may be installed to be rotatable about respective rotating shafts to inject washing water while rotating.

The tub 110 may be provided with a heater (not shown) for heating washing water, and a heater mounting groove (not shown). The heater mounting groove may be formed at the bottom of the tub 110, and the heater may be mounted in the heater mounting groove.

The sump 180 may be provided at the center of the bottom of the tub 110 such that the washing water may be collected and pumped. The sump 180 may be provided with a washing pump 181 configured to pump washing water at a high pressure, and a pump motor 182 configured to drive the washing pump 181.

The washing pump 181 pumps washing water to the first injector 210 through a first supply pipe 260. Further, the washing pump 181 pumps washing water to the second injector 220 through a second supply pipe 270.

The sump 180 may be provided with a turbidity sensor (not shown) to detect a contamination level of washing water. A controller (not shown) of the dishwasher 100' may detect the contamination level of washing water using the turbidity sensor (not shown) and control the number of times of a washing process or a rinsing process. That is, when the contamination level is high, the number of times of the washing process or the rinsing process may increase, and when the contamination level is low, the number of times of the washing process or the rinsing process may decrease.

The dishwasher 100' may further include the cover frame 1150 mounted in the opening 11 of the counter 10. The cover frame 1150 may be mounted in the opening 11 to be spaced apart from the tub 110 in the height direction Z of the system kitchen 1'. In other words, the cover frame 1150 may be mounted in the opening 11 so as not to overlap the tub 110 in the height direction Z of the system kitchen 1'.

The cover frame 1150 may include a frame body 1158 and a bent portion 1156 bent from the frame body 1158 to be supported on the counter 10. The bent portion 1156 may be formed at an upper end of the frame body 1158 to be bent in the outward direction of the dishwasher 100'.

The frame body 1158 may include a seating portion 1151 configured to seat the upper door 1120 thereon. In detail, an upper door hinge 290 including a hinge shaft 291 may be mounted on the seating portion 1151 of the frame body 1158. The upper door 1120 may be coupled to the upper door hinge 290 to be rotatable about the hinge shaft 291. The hinge shaft 291 of the upper door hinge 290 may extend in the width direction Y of the system kitchen 1'.

The dishwasher 100' may further include a frame sealing member 350. The frame sealing member 350 may be disposed between the cover frame 1150 and the counter 10. In other words, the frame sealing member 350 may be coupled to at least one of the cover frame 1150 and the counter 10. The frame sealing member 350 serves to compensate for sealing a gap between the cover frame 1150 and the counter 10 to prevent external fluid from flowing into the inside of the dishwasher 100' through the gap between the cover frame 1150 and the counter 10 or to prevent washing water inside the tub 110 from flowing out of the dishwasher 100' through the gap between the cover frame 1150 and the counter 10. The frame sealing member 350 may be formed of an elastic material. As an example, the frame sealing member 350 may be formed of rubber or the like.

The dishwasher 100' may further include an upper door sealing member 300. The upper door sealing member 300 may be coupled to the upper door 1120. In detail, the upper door sealing member 300 may be disposed on a lower frame 1122 of the upper door 1120. The upper door sealing member 300 may serves to compensate for sealing a gap between the cover frame 1150 and the upper door 1120 to prevent washing water inside the tub 110 from leaking to the outside of the upper door 1120. The upper door sealing member 300 may be formed of an elastic material. As an example, the upper door sealing member 300 may be formed of rubber or the like.

The dishwasher 100' may further include a housing panel 170. The housing panel 170 may be disposed outside the tub 110. In detail, the housing panel 170 may be coupled to opposite sidewalls of the tub 110, that is, a left side wall and a right side wall, respectively.

The dishwasher 100' may further include a tub body 113 and a tub top 114 mounted to the tub body 113. The tub 110 may include the tub body 113 and the tub top 114. The tub top 114 may be coupled to an upper end of the tub body 113. The tub top 114 may be provided with the upper opening 112 corresponding to the opening 11 of the counter 10.

The tub top 114 may be formed of a material different from the tub body 113. As an example, the tub top 114 may be formed of polypropylene (PP), and the tub body 113 may be formed of stainless steel (STS).

The tub top 114 may be provided with a water collector 115. The water collector 115 may be formed along a circumference of the tub top 114 to have a predetermined depth. The water collector 115 may be formed on the tub top 114 to be positioned outside a connection member 310 which will be described later. When washing water does not flow into the inside of the tub 110 and flows along an outer wall of the tub 110 due to incomplete coupling and abrasion of the connection member 310, not only an unsanitary problem but a fire may be caused. The water collector 115 is formed at the uppermost end of the tub body 113, that is, at the tub top 114 to collect washing water that does not flow into the inside of the tub 110 and guide the collected washing water into the inside of the tub 110.

The tub top 114 may be provided with a panel fixing portion 116. The housing panel 170 may be coupled to the tub 110 to face the opposite sidewalls of the tub 110. In detail, the housing panel 170 may be coupled to the panel fixing portion 116 of the tub top 114 to face opposite sidewalls of the tub body 113. The housing panel 170 may be fixed to the panel fixing portion 116 by a coupling member such as a screw.

The dishwasher 100' may further include the connection member 310. The connection member 310 may be provided to connect the cover frame 1150 and the tub 110. In detail, the connection member 310 may connect the cover frame 1150 and the tub 110 to be capable of extending and contracting in the height direction Z of the system kitchen 1'. The connection member 310 may have an elastic material. As an example, the connection member 310 may be formed of a material such as rubber. An upper end of the connection member 310 may be coupled to the cover frame 1150, and a lower end of the connection member 310 may be coupled to the tub 110. In other words, the upper end of the connection member 310 may be coupled to the cover frame 1150, and the lower end of the connection member 310 may be coupled to the tub top 114.

The dishwasher 100' may further include a front door sealing member 320. The front door sealing member 320 may be coupled to the front door 130. The front door sealing member 320 serves to compensate for sealing a gap between the tub 110 and the front door 130 to prevent washing water inside the tub 110 from leaking to the outside of the front door 130. The front door sealing member 320 may be formed of an elastic material. As an example, the front door sealing member 320 may be formed of rubber or the like.

The upper door 1120 may include a communicator configured to control the operation of the dishwasher 100' according to whether the upper door 1120 is opened or closed. As an example, when a controller is positioned in a "lower module", which will be described later, the controller may be electrically connected to a sensor provided in the upper door 1120 to detect whether the upper door 1120 is opened or closed. When the controller is positioned in the upper door 1120, the controller of the upper door 1120 may be electrically connected to the sensor provided in the upper door 1120 to detect whether the upper door 1120 is opened or closed. In addition, the controller of the upper door 1120 may be electrically connected to various electronic components disposed in the lower module.

The dishwasher 100' may further include a wire 500 provided to couple the connection member 310 to the cover frame 1150. The wire 500 may include a knot 510 (see FIG. 4).

Hereinafter, a process of installing the dishwasher 100' in the system kitchen 1' in a built-in manner will be described. For convenience of description, the cover frame 1150 and the upper door 1120 among the components of the dishwasher 100' are referred to as an "upper module", and the remaining components except for the cover frame 1150, the upper door 1120 and the connection member 310 among the components of the dishwasher 100' are referred to as the "lower module". First, the lower module is mounted to the cabinet 20 in the front-rear direction X of the system kitchen 1'. In detail, the lower module is received in the front-rear direction X of the system kitchen 1' in the cabinet 20 having a front opening and then fixed to the cabinet 20. Thereafter, the upper module is mounted to the counter 10. In detail, the cover frame 1150 is mounted in the opening 11 of the counter 10, and the upper door 1120 is installed on the cover frame 1150. The upper module and the lower module may be connected by the connection member 310. In detail, the cover frame 1150 of the upper module and the tub 110 of the lower module may be connected by the connection member 310.

Figure 5:
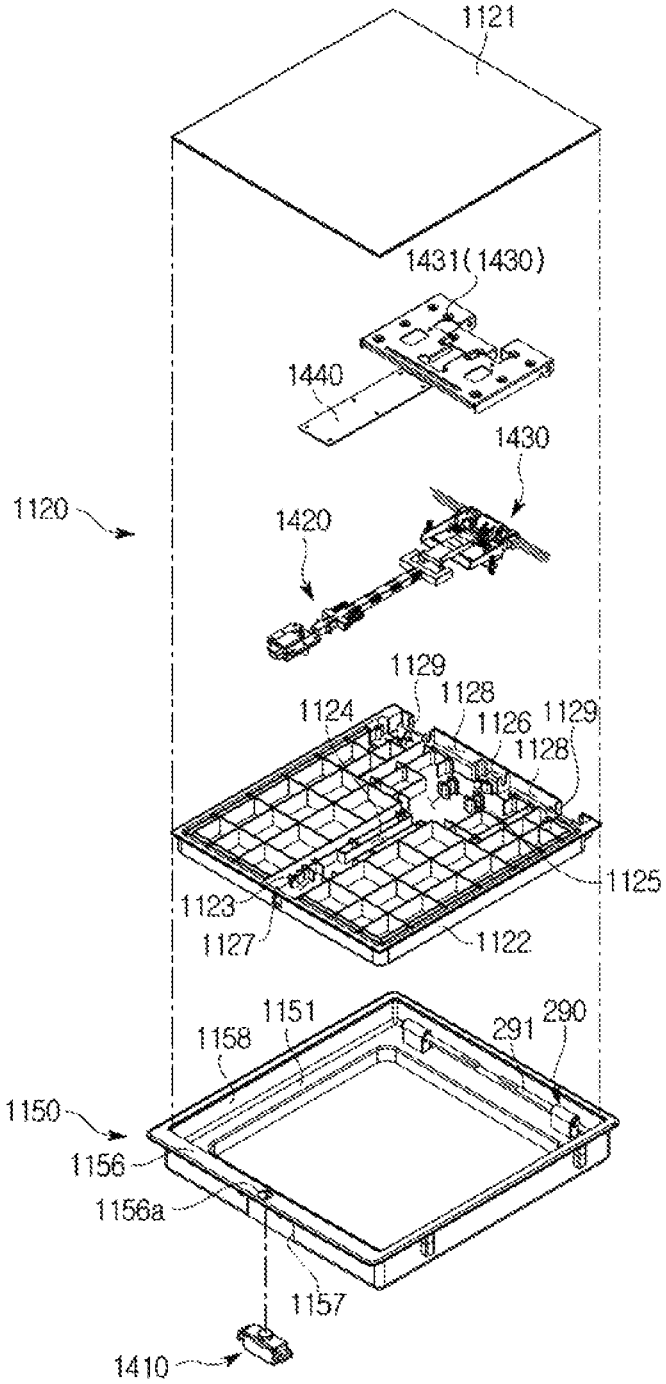
FIG. 5 is an exploded perspective view a cover frame and the upper door of the dishwasher in the system kitchen shown in FIG. 4.
Figure 6:
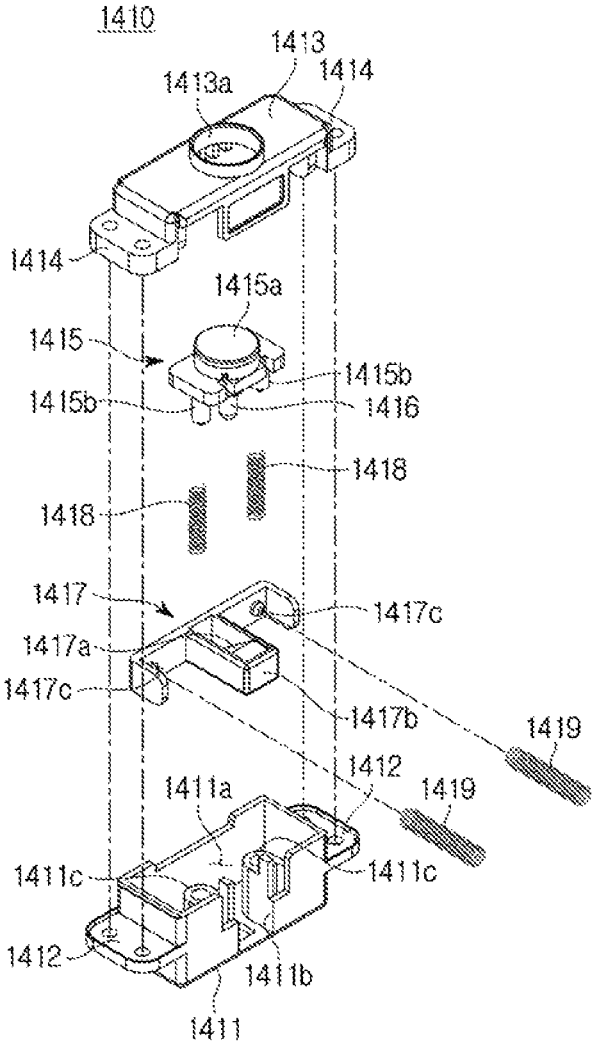
FIG. 6 is an exploded perspective view of the trigger shown in FIG. 5.
Figure 7:
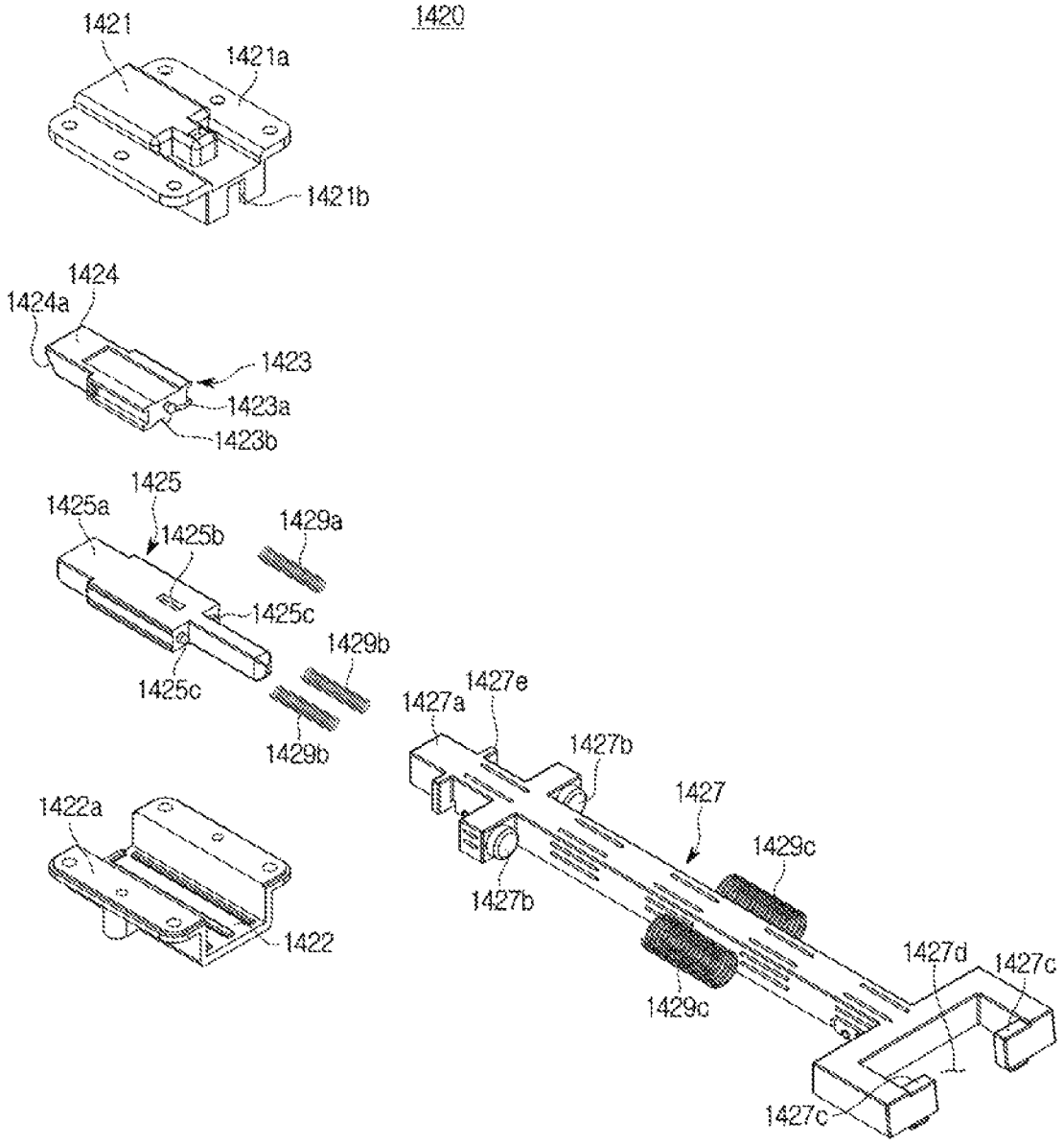
FIG. 7 is an exploded perspective view of the latch module and the locker module shown in FIG. 5.
Figure 8:
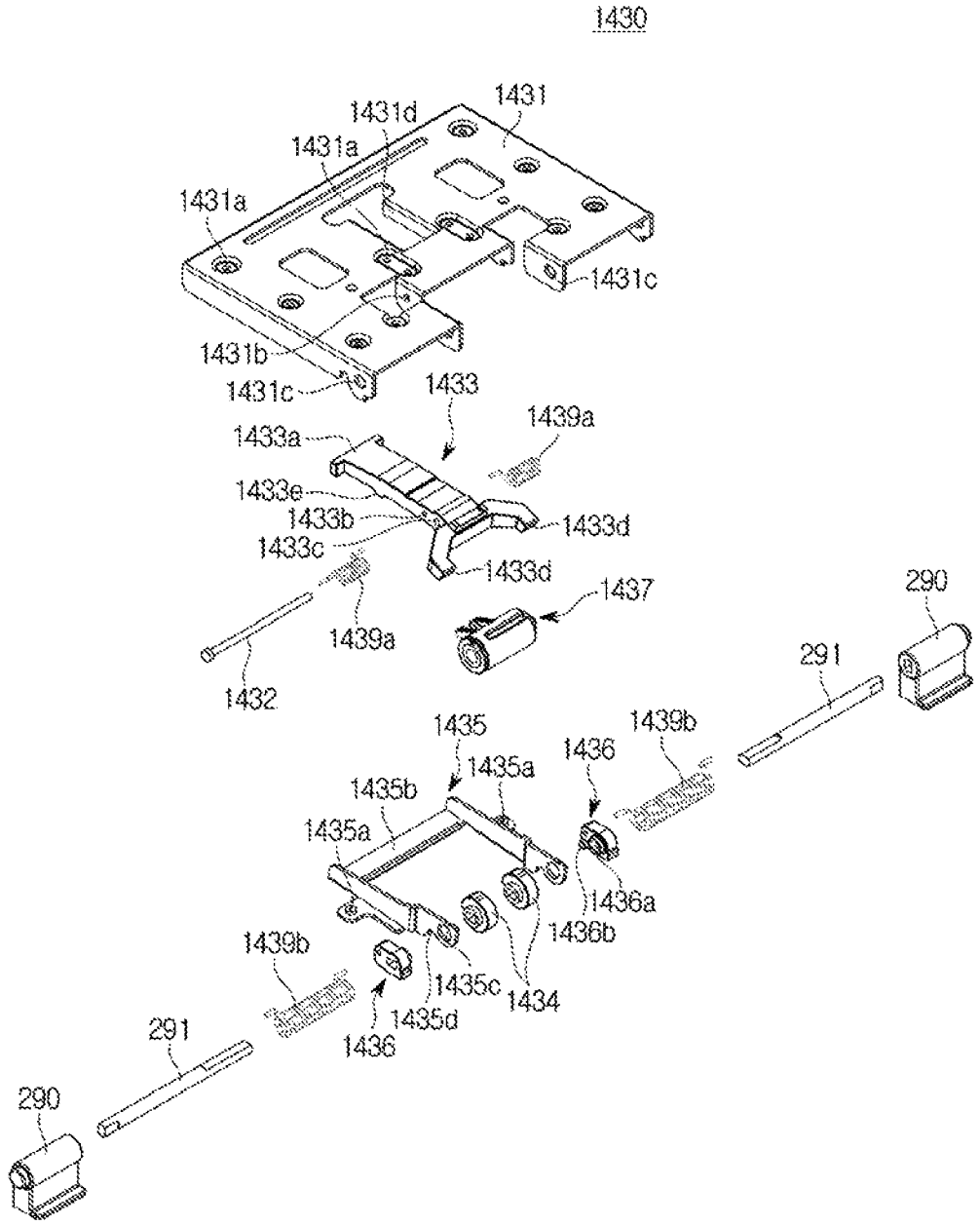
FIG. 8 is an exploded perspective view of the lift apparatus shown in FIG. 5.

FIG. 5 is an exploded perspective view a cover frame and the upper door of the dishwasher in the system kitchen shown in FIG. 4. FIG. 6 is an exploded perspective view of the trigger shown in FIG. 5. FIG. 7 is an exploded perspective view of the latch module and the locker module shown in FIG. 5. FIG. 8 is an exploded perspective view of the lift apparatus shown in FIG. 5.

Referring to FIG. 5, the upper door 1120 may be rotatably mounted to the cover frame 1150 by the upper door hinge 290 having the hinge shaft 291. The dishwasher 100' may include a trigger 1410 for automatically opening or automatically closing the upper door 1120 by a predetermined angle, a latch-locker module 1420, and a lift apparatus 1430.

The trigger 1410 may be mounted to the cover frame 1150. The latch-locker module 1420 and the lift apparatus 1430 may be disposed inside the upper door 1120. The upper door 1120 may include the lower frame 1122 configured to receive the latch-locker module 1420 and the lift apparatus 1430 therein, and an upper frame 1121 configured to cover an upper surface of the lower frame 1122.

The lower frame 1122 may include latch-locker receiving spaces 1123 and 1124 in which the latch-locker module 1420 is received. The latch-locker receiving spaces 1123 and 1124 may include the latch receiving space 1123 in which a latch 1423 is received, and the locker receiving space 1124 in which a locker 1427 is received.

The lower frame 1122 may include a lift receiving space 1125 in which the lift apparatus 1430 is received. The lower frame 1122 may include a damper receiving space 1126 in which a damper 1437 is received. The lower frame 1122 may include a hinge shaft receiving space 1128 in which the hinge shaft 291 is received. The lower frame 1122 may include a hinge receiving space 1129 in which the upper door hinge 290 is disposed.

The lower frame 1122 may include a latch opening 1127 into which the latch 1423 is slidingly inserted. The latch opening 1127 may be formed to correspond to the size and shape of the latch 1423. The latch opening 1127 may be disposed on one side of the lower frame 1122 at which the trigger 1410 is positioned. A latch head 1424 of the latch 1423 may protrude toward the trigger 1410 through the latch opening 1127. Referring to FIGS. 5 and 6, the trigger 1410 may be disposed on the other side opposite to one side where the upper door hinge 290 of the cover frame 1150 is disposed. The trigger 1410 may be disposed at a lower side of the bent portion 1156.

The cover frame 1150 may include a trigger mounting portion 1157 to which the trigger 1410 is mounted. The trigger mounting portion 1157 may include a push opening **1159*a* into which a portion of a push member 1417 of the trigger 1410 is slidingly inserted. The trigger mounting portion 1157 may include a latch receiving hole 1159*b* provided to allow the first latch 1423 to be selectively inserted therein. The push opening 1159*a* and the latch receiving hole 1159*b* may be formed on a portion of the frame body 1158. The cover frame 1150 may include a button opening 1156*a* provided to expose an upper surface 1415*b* of a button 1415 of the trigger 1410 to the outside. The button opening 1156*a* may be formed at a portion of the bent portion 1156 on which the trigger 1410** is disposed.

The trigger 1410 may be configured to lock or unlock the upper door 120 together with the latch-locker module 1420. The trigger 1410 may include a lower case 1411, an upper case 1413, a button 1415, the push member 1417, a button elastic member 1418, and a push elastic member 1419.

The lower case 1411 may include a receiving space **1411*a* receiving the push member 1417, the button 1415, the button elastic member 1418, and the push elastic member 1419**.

The lower case 1411 may include a guide opening **1411*b* to guide the movement of a push portion 1417*b* of the push member 1417. The guide opening 1411*b* may be formed to be substantially the same as the size and/or shape of the push member 1417. The guide opening 1411***b* may be formed at one side surface of the lower case 1411 directing to the upper door 120.

The lower case 1411 may include a button guide portion 1411*c* into which a leg 1415*b* of the button 1415 is slidingly inserted. Although FIG. 6 illustrates that two of the button guide portions 1411*c* are provided to correspond to the number of the legs 1415*b* because the button 1415 includes two of the legs 1415*b*, the number of the button guide portions 1411*c* is not limited thereto, and may be provided to correspond to the number of the legs 1415*b* of the button 1415.

The lower case 1411 may include a lower case fixing portion 1412 to be fixed to the cover frame 1150. The lower case fixing portion 1412 may be fixed to the cover frame 1150 through a fixing member (not shown) together with an upper case fixing portion 1414 of the upper case 1413.

The upper case 1413 may cover an upper portion of the lower case 1411. The upper case 1413 may cover the receiving space 1411*a*. The upper case 1413 may include the upper case fixing portion 1414 to be fixed to the cover frame 1150 together with the lower case 1411. The upper case fixing portion 1414 may be fixed to the cover frame 1150 through the fixing member together with the lower case fixing portion 1412.

The upper case 1413 may include an exposure hole 1413*a* to expose the upper surface 1415*a* of the button 1415. The exposure hole 1413*a* may be formed to have substantially the same size and/or shape as the upper surface 1415*a* of the button 1415. The exposure hole 1413*a* may be provided to correspond to the button opening 1156*a* of the cover frame 1150. The exposure hole 1413*a* may be positioned on an upper surface of the upper case 1413.

The button 1415 is a portion to which the user presses to open the upper door 1120. The button 1415 may include the upper surface 1415*a* exposed to the outside of the cover frame 1150 to be pressed by the user.

The button 1415 may include the leg 1415*b* supported by the lower case 1411. Although FIG. 6 illustrates that the button 1415 includes two of the legs 1415*b*, the number of the legs 1415*b* is limited thereto. The leg 1415*b* may guide the vertical movement of the button 1415 in a state of being inserted into the button guide portion 1411*c* of the lower case 1411.

The button elastic member 1418 may elastically bias the button 1415 in a direction away from the lower case 1411 in a state of being coupled to the leg 1415*b*. One end of the button elastic member 1418 may be fixed to a lower surface of the button 1415, and the other end thereof may be fixed to an upper surface of the button guide portion 1411*c*. The button elastic member 1418 may apply an elastic force to the button 1415 so that the upper surface 1415*a* of the button 1415 is exposed through the exposure hole 1413*a*. The button elastic member 1418 may elastically bias the button 1415 in the upward direction with respect to the lower case 1411. The button elastic member 1418 may be a spring.

The button 1415 may include a pressing protrusion 1416. The pressing protrusion 1416 may be positioned to correspond to a push inclined surface 1417*a* of the push member 1417. The pressing protrusion 1416 may protrude from the lower surface of the button 1415. When the button 1415 is pressed, the pressing protrusion 1416 may descend to press the push inclined surface 1417*a*.

The push member 1417 may be received in the receiving space 1411*a* of the lower case 1411. The push member 1417 may be elastically biased in a direction away from the upper door 1120 by the push elastic member 1419. The push member 1417 may be elastically biased by the push elastic member 1419 in a direction in which the push inclined surface 1417*a* lifts the button 1415 upward.

One end of the push elastic member 1419 may be fixed to the push member 1417, and the other end thereof may be fixed to an inner surface of the lower case 1411. One end of the push elastic member 1419 may be fixed to an elastic member fixing portion 1417*c* of the push member 1417. The other end of the push elastic member 1419 may be fixed to an inner surface close to the upper door 1120 of the lower case 1411. The push elastic member 1419 may be a spring.

The push member 1417 may include the push inclined surface 1417*a* to allow the push member 1417 to move toward the upper door 1120 as the push member 1417 is pressed by the pressing protrusion 1416 of the button 1415. The push inclined surface 1417*a* may be provided to incline upward from a front lower side to a rear upper side. As the push elastic member 1419 applies an elastic force to the push member 1417 in the direction away from the upper door 1120, the push inclined surface 1417*a* may lift the pressing protrusion 1416 in the upward direction when the button 1415 is not pressed.

As the push inclined surface 1417*a* is pressed by the pressing protrusion 1416 and as the push member 1417 moves toward the upper door 1120, the push portion 1417*b* of the push inclined surface 1417*a* may press a latch support member 1425 to a rearward direction. The push portion 1417*b* may extend from the push inclined surface 1417*a* toward the upper door 1120. The push portion 1417*b* may slide in the guide opening 1411*b* and the push opening 1159*a* to press the latch support member 1425. Referring to FIG. 7, the latch-locker module 1420 may be configured to lock or unlock the upper door 120 together with the trigger 1410. The latch-locker module 1420 may include an upper cover 1421, a lower cover 1422, the latch 1423, the latch support member 1425, and the locker 1427.

The upper cover 1421 may receive the latch 1423 and the latch support member 1425 together with the lower cover 1422. The upper cover 1421 may include an upper cover fixing portion 1421*a* to be fixed to the lower frame 1122 together with the lower cover 1422. The upper cover fixing portion 1421*a* may be fixed to the lower frame 1122 together with a lower cover fixing portion 1422*a* of the lower cover 1422 by the fixing member.

The upper cover 1421 may include a support member opening 1421*b* into which a portion of the latch support member 1425 is slidingly inserted. The support member opening 1421*b* may be formed at one side of the upper cover 1421 directing to the locker 1427.

The lower cover 1422 may receive the latch 1423 and the latch support member 1425 together with the upper cover 1421. The lower cover 1422 may cover a lower portion of the upper cover 1421. The lower cover 1422 may include the lower cover fixing portion 1422*a* to be fixed to the lower frame 1122 together with the upper cover 1421. The lower cover fixing portion 1422*a* may be fixed to the lower frame 1122 together with the upper cover fixing portion 1421*a* of the upper cover 1421 by the fixing member.

The latch 1423 may be selectively inserted into the latch receiving hole 1159*b* of the cover frame 1150 to lock or unlock the upper door 120. The latch 1423 may be supported by the latch support member 1425. The movement of the latch 1425 may be guided by a latch support member 1425.

The latch 1423 may be elastically biased in a direction of protruding to the outside of the upper door 1120 by a latch elastic member 1429*a*. One end of the latch elastic member

1429*a* may be fixed to an elastic member support portion 1423*a* of the latch 1423, and the other end thereof may be fixed to an inner side surface of the upper cover 1421. That is, the latch 1423 may be elastically biased in a direction directing to the trigger 141 with respect to the upper cover 1421.

The latch 1423 may include a latch protrusion 1423*b* inserted into a latch guide groove 1425*b* of the latch support member 1425. The latch protrusion 1423*b* may protrude from a lower surface of the latch 1423 toward the latch support member 1425. The latch protrusion 1423*b* may guide the movement of the latch 1423 in a state of being inserted into the latch guide groove 1425*b*. However, a method of guiding the movement of the latch 1423 is not limited thereto, and a groove may be formed on the latch 1423 and a protrusion may be formed on the latch support member 1425.

The latch 1423 may include a latch head 1424 disposed at a front end. The latch head 1424 may include a guide surface 1424*a* protruding from the upper door 1120 to maintain a locked state when the upper door 1120 is locked and guiding the latch 1423 by being pressed by the cover frame 1150 to be drawn into the upper door 1120 when the upper door 1120 closes. The guide surface 1424*a* may be inclined downward from a front upper side to a rear lower side. The latch head 1424 protrudes to the outside of the upper door 1120 through the latch opening 1127 and may be selectively inserted into the latch receiving hole 1159*b*.

The latch support member 1425 may move by being pressed by the push member 1417 of the trigger 1410. The latch support member 1425 may be provided to be slidingly movable in the latch opening 1127. The latch support member 1425 may include a support head 1425*a* pressed by the push member 1417. The support head 1425*a* may protrude to the outside of the upper door 1120 through the latch opening 1127.

The latch support member 1425 may be elastically biased in a direction of protruding from the upper door 1120 by a support elastic member 1429*b*. One end of the support elastic member 1429*b* may be fixed to the elastic member fixing portion 1425*c* of the latch support member 1425, and the other end thereof may be fixed to an inner surface of the upper cover 1421. Accordingly, the support elastic member 1429*b* may apply an elastic force to the latch support member 1425 in the direction of protruding from the upper door 1120.

The latch support member 1425 may support the latch 1423. The latch support member 1425 may include the latch guide groove 1425*b* into which the latch protrusion 1423*b* of the latch 1423 is inserted. The latch guide groove 1425*b* may extend by a predetermined length along a moving direction of the latch 1423. When the upper door 1120 is closed, the latch guide groove 1425*b* may guide the latch 1423 when the latch 1423 is pressed by the cover frame 1150 to move in the direction of being drawn out of the upper door 1120. When the latch support member 1425 is pressed by the push member 1417 as the latch protrusion 1423*b* is inserted into the latch guide groove 1425*b*, the latch 1423 may move together with the latch support member 1425 in a direction of being drawn into the upper door 1120.

The locker 1427 may be pushed back by the latch support member 1425. The locker 1427 may be in contact with the other end opposite to one end of the latch support member 1425 provided with the support head 1425*a*. The locker 1427 may include a locker head 1427*a* in contact with the latch support member 1425.

The locker 1427 may be elastically biased in a direction directing to the latch support member 1425 by a locker elastic member 1429*c*. One end of the locker elastic member 1429*c* may be fixed to an elastic member support portion 1427*b* of the locker 1427, and the other end thereof may be fixed to the lower frame 1122. The locker elastic member 1429*c* may applies an elastic force to the locker 1227 in a forward direction with respect to the lower frame 1122.

The locker 1227 may further include a restricting protrusion 1227*e* protruding such that movement is restricted by the lower frame 1122.

The locker 1427 may include a lifter support portion 1749*c* formed at the other end opposite to one end where the locker head 1743*a* is disposed. The lifter support portion 1743*c* may selectively come into contact with a lifter 1433 of the lift apparatus 1430. A lifter insertion space 1427*d* into which the lifter 1433 may be selectively inserted may be formed between the lifter support portions 1743*c*. That is, the lifter insertion space 1427*d* formed in a shape corresponding to a front end of the lifter 1433 by the lifter support portions 1743*c* may be provided at a rear end of the locker 1743.

The locker 1427 may include a roller 1428 disposed on a lower surface thereof to easily move on the lower frame 1122. When the locker 1427 moves in the front-rear direction, the roller 1428 may roll on the lower frame 1122 to allow the locker 1743 to move smoothly. Referring to FIG. 8, the lift apparatus 1430 may automatically open the upper door 1120 by a predetermined angle when the upper door 1120 is opened. The lift apparatus 1430 may automatically close the upper door 1120 when the upper door 1120 is closed together with the locker 1427. The lift apparatus 1430 may include a lift bracket 1431, the lifter 1433, a first cam 1434, a lifter support member 1435, and a second cam 1436.

The lift bracket 1431 may be fixed to the lower frame 1122. The lifter 1433 and the lifter support member 1435 may be connected to each other in the lift bracket 1431. The lift bracket 1431 may include at least one fixing portion 1431*a* to be fixed to the lower frame 1122 by a fixing member. As the fixing member (not shown) is coupled to the fixing portion 1431*a* of the lift bracket 1431, the lift bracket 1431 may be fixed to the lower frame 1122 of the upper door 1120.

The lift bracket 1431 may include a lifter coupling portion 1431*b* to which the lifter 1433 is rotatably coupled. As a coupling shaft 1432 is coupled to the lifter coupling portion 1431*b* and a shaft coupling portion 1433*c* of the lifter 1433, the lifter 1433 may be rotatably coupled by the lift bracket 1431.

The lift bracket 1431 may include a hinge shaft coupling hole 1431*c* to which the hinge shaft 291 is coupled. The hinge shaft 291 may be rotatably coupled to the lift bracket 1431. As the hinge shaft 291 is coupled to the hinge shaft coupling hole 1431*c* of the lift bracket 1431, the upper door 1120 may rotate with respect to the cover frame 1150 to which the upper door hinge 290 is fixed.

The lift bracket 1431 may include a lifter through hole 1431*d*. The lifter through hole 1431*d* may be provided similar to the shape of the front end of the lifter 1433. The lifter through hole 1431*d* may prevent the lifter 1433 from interfering with the lifter bracket 1431 when the upper door 120 is opened and closed.

The lifter 1433 may be rotatably coupled to the lift bracket 1431. As the lifter 1433 rotates with respect to the lift bracket 1431, the lifter head 1433*a* of the lifter 1433 may move between a position where the lifter head 1433*a* is inserted into the lifter insertion space 1743*d* and a position where the lifter head 1433*a* presses the lifter support portion 1427*c*. To this end, the lifter head 1433*a* of the lifter 1433 may be provided in a shape similar to that of the lifter insertion space 1427*d*.

The lifter 1433 may be elastically biased in a direction in which the upper door 1120 is closed by a lifter elastic member 1439*a*. One end of the lifter elastic member 1439*a* is inserted into an elastic member insertion hole 1433*b* of the lifter 1433, the other end thereof is fixed to the lifter bracket 1431, so that the lifter elastic member 1439*a* may apply an elastic force to the lifter 1433 in the direction in which the upper door 1120 is closed with respect to the lifter bracket 1431. Although FIG. 8 illustrates that two of the lifter elastic members 1439*a* are provided, as needed, only one of the lifter elastic member may be provided and three or more of lifter elastic members may be provided.

The lifter 1433 may include the shaft coupling hole 1433*c* into which the coupling shaft 1432 is rotatably inserted. The coupling shaft 1432 may be inserted into the lift coupling portion 1431*b* and the shaft coupling hole 1433*c* in a state where the shaft coupling hole 1433*c* is positioned to correspond to the lifter coupling portion 1431*b*.

The lifter 1433 may include a lifter leg 1433*d*. The lifter leg 1433*d* may be disposed at the other end opposite to one end of the lifter 1433 where the lifter head 1433*a* is disposed. When the upper door 1120 is opened, the lifter leg 1433*d* may be pressed by the second cam 1434 to rotate the lifter 1433 in a direction in which the upper door 120 is opened. As the lifter 1433 rotates in the direction in which the upper door 120 is opened, the lifter head 1433*a* may be separated from the lifter insertion space 1427*d* of the locker 1743.

The lifter 1433 may include a support protrusion 1433*e* supported by the lifter support member 1435. The support protrusion 1433*e* may be in contact with a support extension portion 1435*b* of the lifter support member 1435. The support protrusion 1433*e* may have a curved surface to be supported by the support extension portion 1435*b* even if the lifter 1433 rotates.

The lifter support member 1435 may be fixed to the lower frame 1122 of the upper door 1120. The lifter support member 1435 may include a support member fixing portion 1435*a* to be fixed to the lower frame 1122.

The lifter support member 1435 may include the support extension portion 1435*b* to support the support protrusion 1433*e* of the lifter 1433. The lifter support member 1435 may be positioned to correspond to the support protrusion 1433*e*.

The lifter support member 1435 may include a hinge shaft insertion hole 1435*c*. As the hinge shaft 291 is rotatably inserted into the hinge shaft insertion hole 1435*c*, the lifter support member 1435 may rotate about the hinge shaft 291 that is an axis of rotation.

The lifter support member 1435 may include a restriction groove 1435*d* to restrict a range of movement of the lifter support member 1435. The restriction groove 1435*d* may be provided in a shape corresponding to a restriction protrusion 1436*b* of the second cam 1434. The restriction groove 1435*d* may prevent the lifter support member 1435 from further rotating in the direction in which the upper door 1120 is closed in a position where the upper door 1120 is closed.

The lifter support member 1435 may include a hinge elastic member 1439*b* having one end fixed to the lift bracket 1431 and the other end fixed to the second cam 1436. Because the second cam 1434 is fixed to the hinge shaft 291 so as not to rotate, the hinge elastic member 14390*b* may apply an elastic force to the lift bracket 1431 in the direction in which the upper door 1120 is closed with respect to the second cam 1436.

The first cam 1434 may rotate the lifter 1433 by pressing the lifter leg 1433*d* when the lifter 1433 rotates in the direction in which the upper door 1120 is opened. Accordingly, the lifter head 1433*a* of the lifter 1433 may be separated from the insertion space 1427*d* of the locker 1427.

The second cam 1436 may be coupled to the rotation shaft 291 so as not to be rotatable. The second cam 1436 may restrict the range of movement of the lifter support member 1435. The lifter support member 1435 may include a shaft coupling portion 1436*a* to which the hinge shaft 291 is coupled. The shaft coupling portion 1436*a* may be provided in a non-circular shape.

Figure 9:
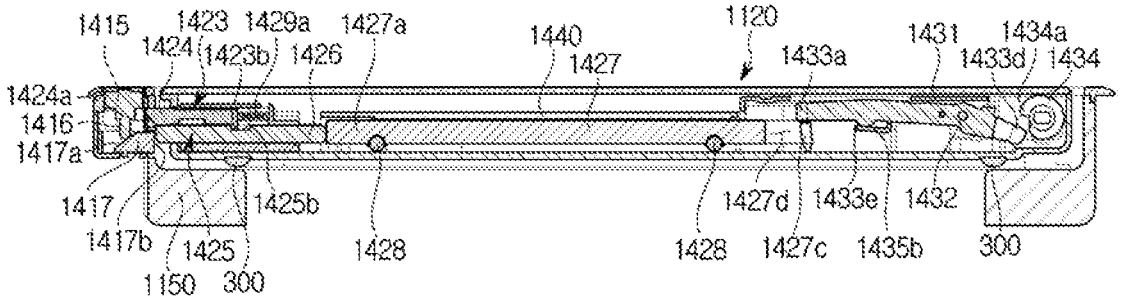
FIG. 9 is a cross-sectional view illustrating a state in which the upper door shown in FIG. 5 closes an opening.
Figure 10:
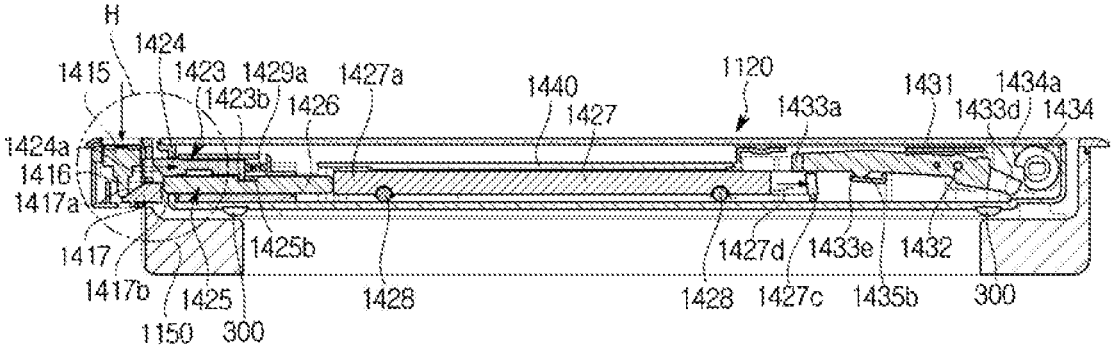
FIG. 10 is a cross-sectional view illustrating a process in which the trigger shown in FIG. 5 starts to open the upper door.
Figure 11:
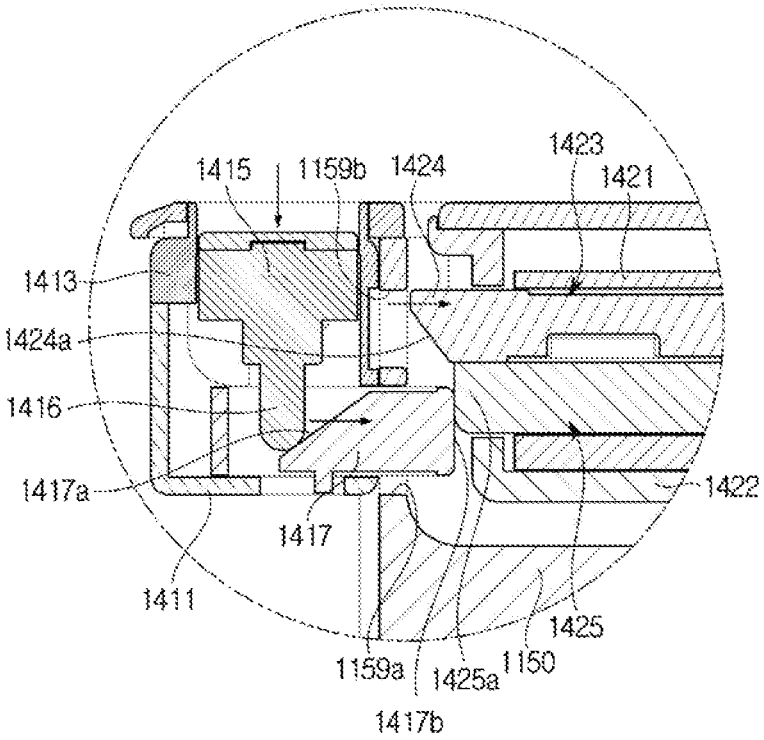
FIG. 11 is an enlarged view of portion H shown in FIG. 10.
Figure 12:
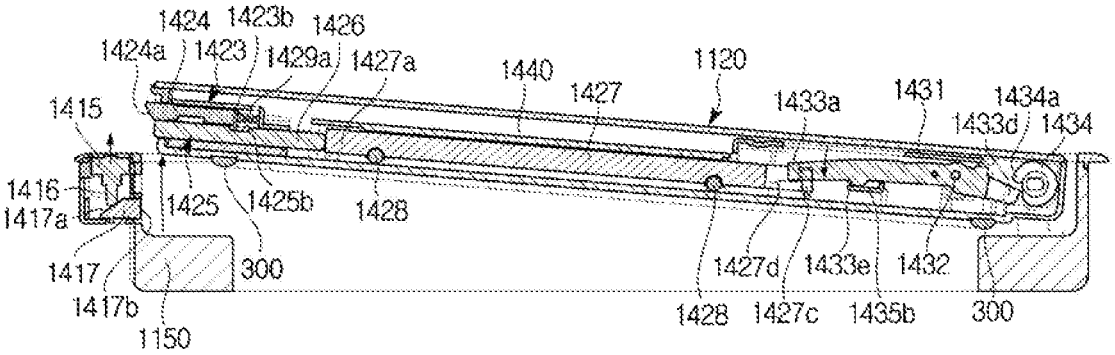
FIG. 12 is a view illustrating a process in which the lift apparatus shown in FIG. 5 opens the upper door by a predetermined angle.
Figure 13:
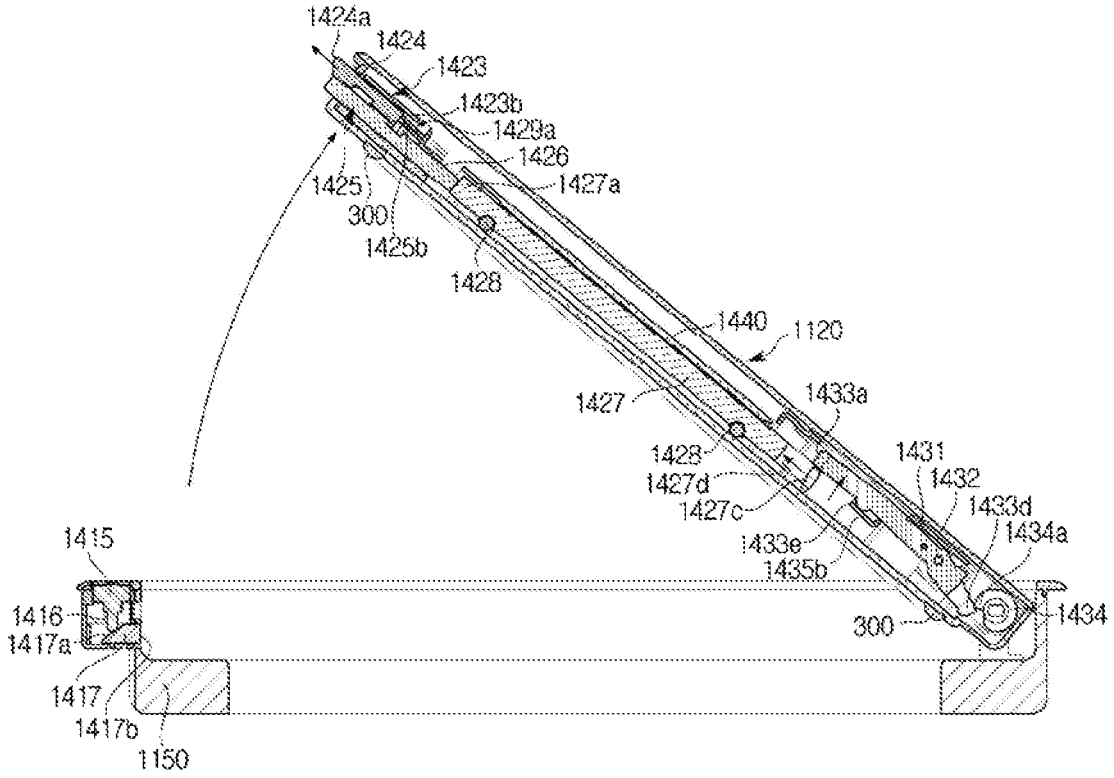
FIG. 13 is a view illustrating a process in which a user completely opens the upper door opened by the predetermined angle.

The lift apparatus 1430 may further include a damper 1437. The damper 1437 is received in the lower frame 1122 and may be connected to the hinge shaft 291. The damper 1437 may allow the opening and closing of the upper door 1120 not to operate fast. That is, the damper 1437 may allow the upper door 1120 to be closed slowly. FIG. 9 is a cross-sectional view illustrating a state in which the upper door shown in FIG. 5 closes an opening. FIG. 10 is a cross-sectional view illustrating a process in which the trigger shown in FIG. 5 starts to open the upper door. FIG. 11 is an enlarged view of portion H shown in FIG. 10. FIG. 12 is a view illustrating a process in which the lift apparatus shown in FIG. 5 opens the upper door by a predetermined angle. FIG. 13 is a view illustrating a process in which a user completely opens the upper door opened by the predetermined angle.

Hereinafter, the opening and closing operation of the upper door 1120 will be described with reference to FIGS. 9 to 13.

Referring to FIG. 9, in the state where the upper door 1120 is closed, the button 1415 is elastically biased in the upward direction by the button elastic member 1418 without pressing the push member 1417. The push member 1417 is elastically biased in a direction in which the latch support member 1425 is not pressed by the push elastic member 1419. The latch support member 1425 is elastically biased in a direction of protruding through the latch opening 1127 by the support elastic member 1429*b*, and the latch 1423 also is elastically biased in the direction of protruding through the latch opening 1127 by the latch elastic member 1429*a*. The locker 1427 is elastically biased toward the latch support member 1425 by the locker elastic member 1429*c*.

The lifter support portion 1427*c* of the locker 1427 supports the lifter head 1433*a* in a state disposed below the lifter head 1433*a*.

Referring to FIGS. 10 and 11, when the user pushes the button 1415, the button 1415 may descend to press the push member 1417. The pressed push member 1417 may protrude toward the upper door 1120 to press the latch support member 1425. The latch support member 1425 is drawn into the upper door 1120, and at this time, the latch 1423 may also be drawn into the upper door 1120 by the configuration of the latch protrusion 1423*b* and the latch guide groove 1425*b*.

As the latch support member 1425 is pressed rearwards, the locker 1427 may also be pressed rearwards. As the locker 1427 is pressed rearwards, the lifter support portion 1427*c* supporting the lifter head 1433*a* moves so as not to support the lifter head 1433*a*. At this time, because the lifter 1433 is elastically biased in the direction in which the upper door 120 is closed by the lifter elastic member 1439*a*, the lifter 1433 may rotate as the lifter support portion 1427*c* moves.

As the lifter 1433 rotates, the lifter head 1433*a* may be received in the lifter insertion space 1427*d*.

Next, referring to FIG. 12, the lifter 1433 rotates about the support protrusion 1433*e* by the elastic force of the lifter elastic member 1439*a*, so that a portion where the coupling shaft 1432 is disposed is lifted up. Accordingly, the upper door 1120 is lifted by a predetermined angle.

Referring to FIG. 13, after that, when the user lifts the upper door 1120 to open it completely, the lifter leg 1433*d* of the lifter 1433 is pressed by a pressing protrusion 1434*a* of the first cam 1434 to rotate in the direction in which the upper door 120 is opened about the coupling shaft 1432 as a center of rotation. At this time, the lifter head 1433*a* received in the insertion space 1427*d* is separated from the insertion space 1743*d*. At this time, the locker 1427 moves forward by the locker elastic member 1429*c*, so that the lifter support portion 1427*c* moves to a position supporting the lifter head 1433*a*.

After that, when the user closes the upper door 1120, the upper door 1120 may be automatically closed completely by the lifter elastic member 1439*a* applying an elastic force to the lifter 1433 in the direction in which the upper door 1120 is closed.

According to this configuration, the dishwasher 100' of the present disclosure may automatically open and close the upper door 1120 and at the same time may improve the design.

Figure 14:
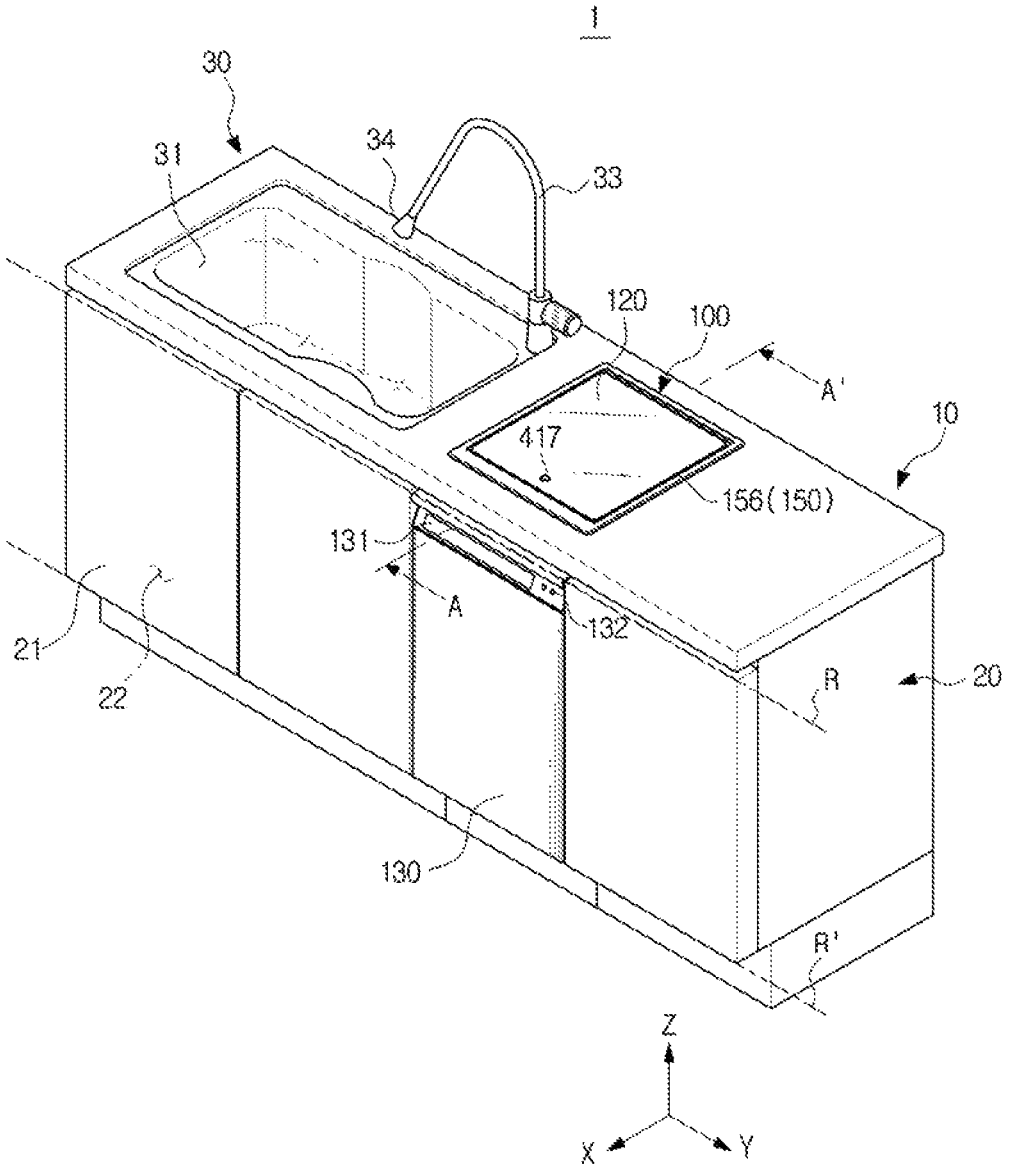
FIG. 14 is a view illustrating a system kitchen in which a dishwasher including an upper door according to another embodiment of the present disclosure is installed in a built-in manner.
Figure 15:
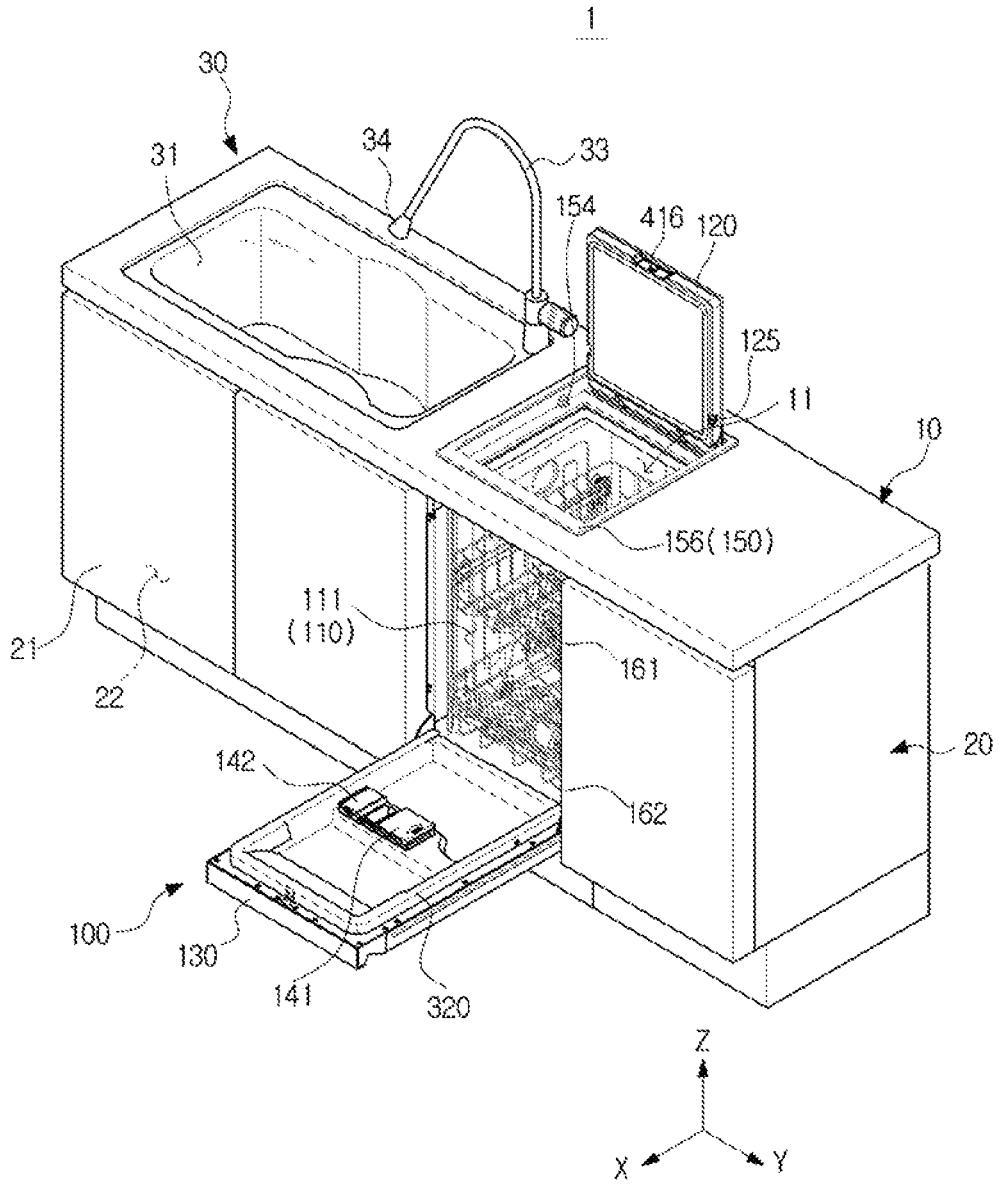
FIG. 15 is a view illustrating a state in which a front door and an upper door of the dishwasher in the system kitchen shown in FIG. 14 are opened.

FIG. 14 is a view illustrating a system kitchen in which a dishwasher including an upper door according to another embodiment of the present disclosure is installed in a built-in manner. FIG. 15 is a view illustrating a state in which a front door and an upper door of the dishwasher in the system kitchen shown in FIG. 14 are opened. Hereinafter, "X" represents the front-rear direction of a system kitchen 1, "Y" represents the left-right direction of a system kitchen 1, and "Z" represents the up-down direction of the system kitchen 1. The left-right direction of the system kitchen 1 may be referred to as a width direction of the system kitchen 1. The up-down direction of the system kitchen 1 may be referred to as a height direction of the system kitchen 1. In addition, the front-rear direction, the left-right direction and the up-down direction of the system kitchen 1 may be referred to as the front-rear direction, the left-right direction and the up-down direction of a dishwasher 100, respectively. In the description of the embodiment illustrated in FIGS. 14 and 15, the same reference numerals may be given to the same elements as the above-described embodiments.

As illustrated in FIGS. 14 and 15, the system kitchen 1 may include the cabinet 20 having the receiving space 22 and the counter 10 disposed on the cabinet 20. The counter 10 may be formed in a flat plate shape. The counter 10 may be referred to as a "cooking table." The opening 11 may be formed on the counter 10.

The cabinet 20 may be provided with the receiving space 22 capable of receiving a variety of kitchen utensils. The receiving space 22 may be opened and closed by the cabinet door 21. As an example, the cabinet door 21 may be provided to be rotatable.

The cabinet 20 may include a partition (not shown) disposed inside the cabinet 20 to partition the receiving space 22. As an example, the partition wall may extend in a height direction Z of the system kitchen 1 to partition the receiving space 22 into a plurality of spaces.

The system kitchen 1 may further include the sink 30 configured to wash dishes or to clean food ingredients. The sink 30 may be provided on one side of the counter 10. The sink 30 may include the sink bowl 31 installed on the counter 10 to wash dishes or food ingredients. The sink ball 31 may be provided with a drain hole (not shown) to drain water supplied to the sink ball 31. The sink 30 may further include the water pipe 33 installed adjacent to the sink ball 31 to supply water to the sink ball 31. The faucet 34 may be coupled to one end of the water pipe 33. Water supplied from the faucet 34 to the sink bowl 31 may be drained through the drain hole and a drain pipe (not shown) connected to the drain hole.

The system kitchen 1 may further include the dishwasher 100 installed in the system kitchen 1 in a built-in manner.

The dishwasher 100 may include a plurality of doors 120 and 130 for the convenience of a user. In detail, the dishwasher 100 may include the upper door 120 provided to enable top loading of the dishes and the front door 130 provided to enable front loading of the dishes. The upper door 120 and the front door 130 may be rotatably installed. However, the installation form of the upper door 120 and the front door 130 is not limited to the above example and may be variously changed. As an example, the upper door 120 and the front door 130 may be installed to open or close in a sliding manner. As another example, one of the upper door 120 and the front door 130 may be installed to open or close in the sliding manner, and the other of the upper door 120 and the front door 130 may be installed to open or close in a rotational manner. Hereinafter, a case where the upper door 120 and the front door 130 are rotatably installed will be described. The upper door 120 may be rotatably installed on a cover frame 150. The front door 130 may be rotatably installed on the tub 110.

The upper door 120 may be configured to open and close the opening 11 of the counter 10.

The front door 130 may be provided with at least one of the detergent box 141 configured to supply a detergent to the inside of the tub 110 and the rinse box 142 configured to supply a rinse to the inside of the tub 110.

The front door 130 may be provided with the display 131 configured to display an operating state of the dishwasher 100 and the like. In detail, the display 131 may be provided an upper side of the front surface of the front door 130. The display 131 may be implemented as a touch screen structure to allow the user to input a command.

The front door 130 may be provided with the operating portion 132. As an example, the operating portion 132 may include the power button of the dishwasher 100 and the like. The operating portion 132 may be provided on one side of the display 131.

Preferably, at least one of the display 131 and the operating portion 132 may be provided on the front door 130.

The dishwasher 100 may further include the tub 110 having the washing space 330 formed therein. The tub 110 may include the front opening 111 capable of being opened and closed by the front door 130. Preferably, the front opening 111 may be larger than the opening 11 formed on the counter 10. The tub 110 may further include the upper opening 112 (see FIG. 16) provided to correspond to the opening 11 formed on the counter 10. Accordingly, the upper door 120 may be configured to open and close the upper opening 112 of the tub 110.

The dishwasher 100 may further include the cover frame 150. The cover frame 150 may be mounted in the opening 11 of the counter 10. The upper door 120 may be installed on the cover frame 150. The cover frame 150 may be mounted to the opening 11 in a state where a portion of the cover frame 150 is placed on the counter 10 at a periphery of the opening 11. That is, the cover frame 150 may include a bent portion 156 formed at one end thereof so as to rest on the counter 10. The bent portion 156 of the cover frame 150 may be exposed to the outside. The width w1 of the cover frame 150 exposed to the outside may be larger than the width w2 of the opening 11 formed on the counter 10 (see FIG. 16). In this case, the width w1 of the cover frame 150 and the width w2 of the opening 11 refer to those measured based on the width direction Y of the system kitchen 1. Therefore, the cover frame 150 may be mounted in the opening 11 in a state where the bent portion 156 of the cover frame 150 is supported by the counter 10.

The dishwasher 100 may further include the one or more baskets 161 and 162 disposed inside the tub 110 to be withdrawable through the front opening 111. The one or more baskets 161 and 162 may be referred to as "front loading baskets." As an example, the dishwasher 100 may include the upper basket 161 disposed at an upper portion of the tub 110 in the up-down direction Z of the dishwasher 100, and the lower basket 162 disposed below the upper basket 161 in the up-down direction Z of the dishwasher 100.

The front door 130 of the dishwasher 100 may form an appearance of the system kitchen 1. In detail, the front door 130 of the dishwasher 100 may form a front appearance of the system kitchen 1 together with the cabinet door 21.

An upper end of the front door 130 and an upper end of the cabinet door 21 may be positioned on the reference line R extending in the width direction Y of the system kitchen 1. The reference line R may be an imaginary line extending in the width direction Y of the system kitchen 1 so as to be parallel to the counter 10. As such, by designing such that the upper end of the front door 130 and the upper end of the cabinet door 21 are positioned on a straight line, the system kitchen 1 of a neat image having a sense of unity as a whole may be implemented.

Preferably, a lower end of the front door 130 and a lower end of the cabinet door 21 may also be positioned on a reference line R' extending in the width direction Y of the system kitchen 1. The reference line R' may be an imaginary line extending in the width direction Y of the system kitchen 1 so as to be parallel to the counter 10. That is, the reference line R' may be parallel to the reference line R.

The upper door 120 of the dishwasher 100 may form the appearance of the system kitchen 1. In detail, the upper door 120 of the dishwasher 100 may form an upper appearance of the system kitchen 1 together with the counter 10. The upper door 120 may be configured such that a step with the counter 10 in the height direction Z of the system kitchen 1 is not large. When the upper door 120 is configured such that the step with the counter 10 in the height direction Z of the system kitchen 1 is large, that is, when the upper door 120 is configured to excessively protrude in an upward direction of the system kitchen 1, ease of use may be lowered. As an example, the user may collide with the upper door 120 protruding excessively in the upward direction of the system kitchen 1.

Figure 16:
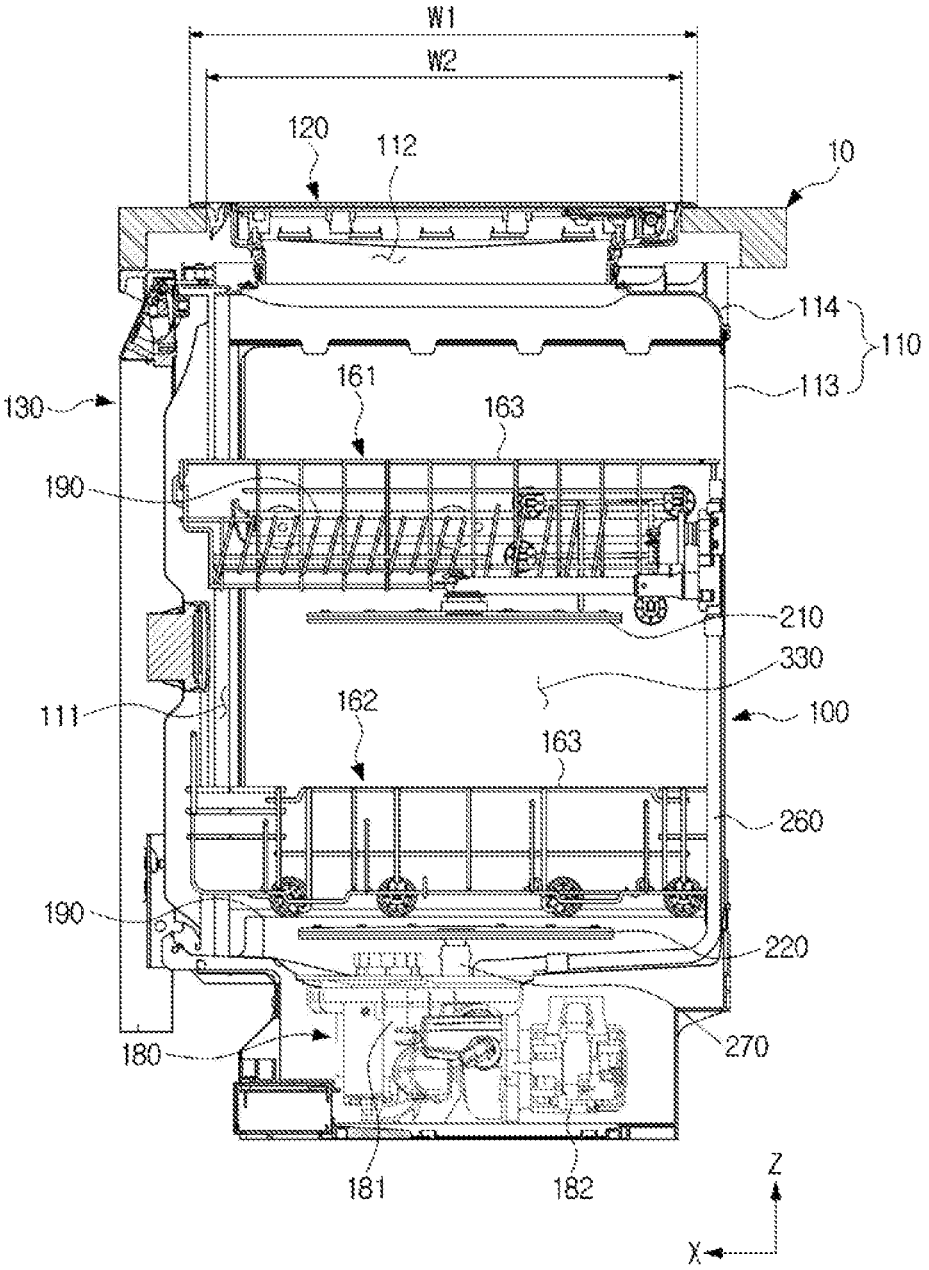
FIG. 16 is a cross-sectional view taken along line A-A' of the system kitchen shown in FIG. 14.
Figure 17:
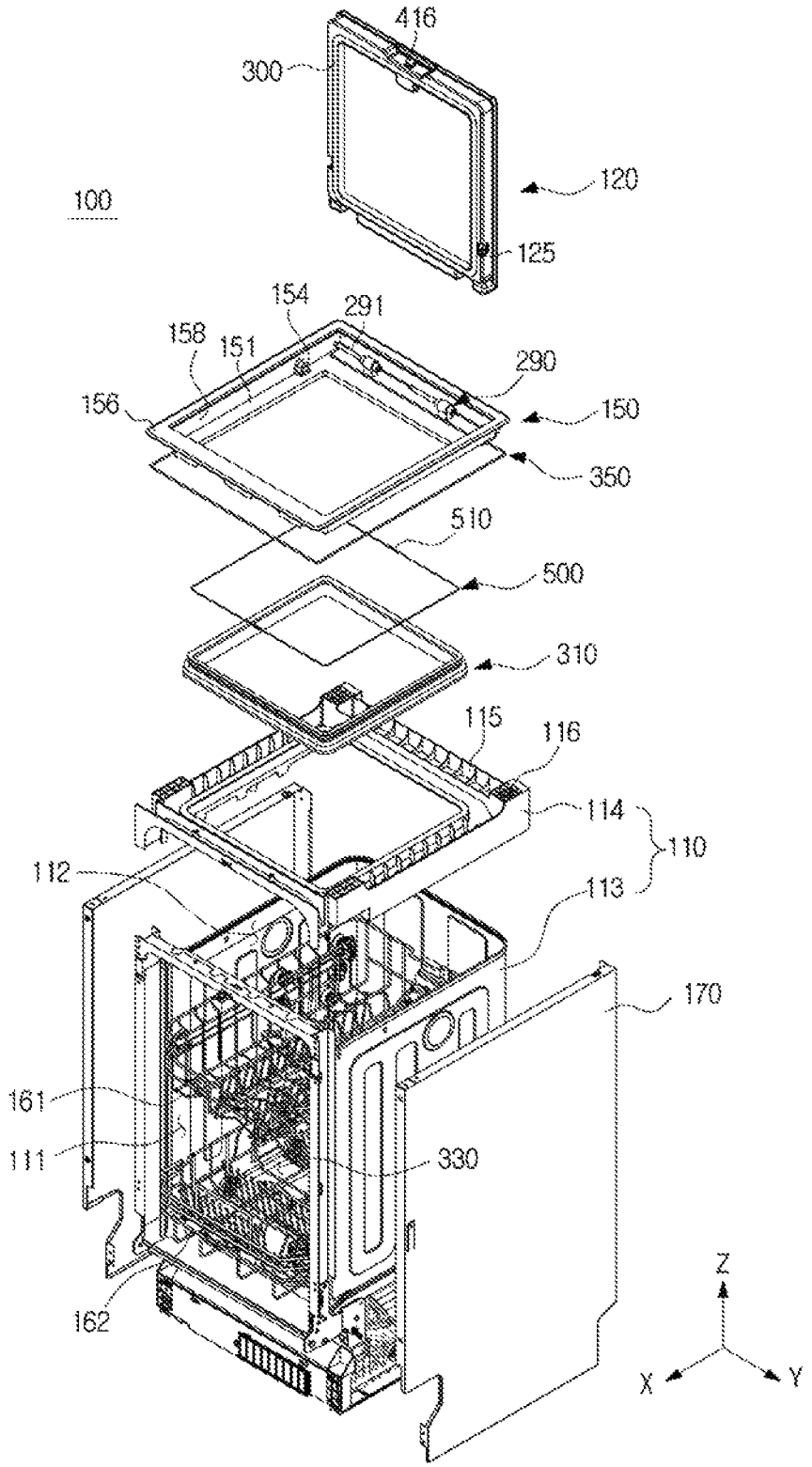
FIG. 17 is an exploded perspective view of the dishwasher in the system kitchen shown in FIG. 14.

FIG. 16 is a cross-sectional view taken along line A-A' of the system kitchen shown in FIG. 14. FIG. 17 is an exploded perspective view of the dishwasher in the system kitchen shown in FIG. 14. For reference, the front door 130 is not shown in FIG. 17.

As illustrated in FIGS. 16 and 17, the dishwasher 100 may include the tub 110 having the washing space 330 formed therein, and the sump 180 provided at a lower portion of the tub 110 to receive washing water.

The one or more baskets 161 and 162 may be disposed inside the tub 110 to be capable of reciprocating in the front-rear direction X of the system kitchen 1. In detail, the one or more baskets 161 and 162 may be put in and out through the front opening 111 of the tub 110 by the at least one rack 190 slidingly supporting the one or more baskets 161 and 162.

The one or more baskets 161 and 162 may have an opened upper end to receive dishes therein. The one or more baskets 161 and 162 may be composed of the wires 163 arranged in a lattice shape so that dishes received therein may be easily washed by washing water. In other words, the one or more baskets 161 and 162 may be composed of a plurality of the wires 163 intersecting each other to receive dishes therein.

The dishwasher 100 may further include the one or more injectors 210 and 220 configured to inject washing water. The one or more injectors 210 and 220 may include the first injector 210 positioned between the upper basket 161 and the lower basket 162, and the second injector 220 positioned below the lower basket 162.

The first injector 210 and the second injector 220 may be installed to be rotatable about the respective rotating shafts to inject washing water while rotating.

The tub 110 may be provided with a heater (not shown) for heating washing water, and a heater mounting groove (not shown). The heater mounting groove may be formed at the bottom of the tub 110, and the heater may be mounted in the heater mounting groove.

The sump 180 may be provided at the center of the bottom of the tub 110 such that the washing water may be collected and pumped. The sump 180 may be provided with the washing pump 181 configured to pump washing water at a high pressure, and the pump motor 182 configured to drive the washing pump 181.

The washing pump 181 pumps washing water to the first injector 210 through the first supply pipe 260. Further, the washing pump 181 pumps washing water to the second injector 220 through the second supply pipe 270.

The sump 180 may be provided with a turbidity sensor (not shown) to detect a contamination level of washing water. A controller (not shown) of the dishwasher 100 may detect the contamination level of washing water using the turbidity sensor (not shown) and control the number of times of a washing process or a rinsing process. That is, when the contamination level is high, the number of times of the washing process or the rinsing process may increase, and when the contamination level is low, the number of times of the washing process or the rinsing process may decrease.

The dishwasher 100 may further include the cover frame 150 mounted in the opening 11 of the counter 10. The cover frame 150 may be mounted in the opening 11 to be spaced apart from the tub 110 in the height direction Z of the system kitchen 1. In other words, the cover frame 150 may be mounted in the opening 11 so as not to overlap the tub 110 in the height direction Z of the system kitchen 1.

The cover frame 150 may include a frame body 158 and a bent portion 156 bent from the frame body 158 to be supported on the counter 10. The bent portion 156 may be formed at an upper end of the frame body 158 to be bent in the outward direction of the dishwasher 100.

The frame body 158 may include a seating portion 151 configured to seat the upper door 120 thereon. In detail, the upper door hinge 290 including the hinge shaft 291 may be mounted on the seating portion 151 of the frame body 158. The upper door 120 may be coupled to the upper door hinge 290 to be rotatable about the hinge shaft 291. The hinge shaft 291 of the upper door hinge 290 may extend in the width direction Y of the system kitchen 1.

The dishwasher 100 may further include the frame sealing member 350. The frame sealing member 350 may be disposed between the cover frame 150 and the counter 10. In other words, the frame sealing member 350 may be coupled to at least one of the cover frame 150 and the counter 10. The frame sealing member 350 serves to compensate for sealing a gap between the cover frame 150 and the counter 10 to prevent external fluid from flowing into the inside of the dishwasher 100 through the gap between the cover frame 150 and the counter 10 or to prevent washing water inside the tub 110 from flowing out of the dishwasher 100 through the gap between the cover frame 150 and the counter 10. The frame sealing member 350 may be formed of an elastic material. As an example, the frame sealing member 350 may be formed of rubber or the like.

The dishwasher 100 may further include the upper door sealing member 300. The upper door sealing member 300 may be coupled to the upper door 120. In detail, the upper door sealing member 300 may be disposed on a lower frame 122 of the upper door 120. The upper door sealing member 300 may serves to compensate for sealing a gap between the cover frame 150 and the upper door 120 to prevent washing water inside the tub 110 from leaking to the outside of the upper door 120. The upper door sealing member 300 may be formed of an elastic material. As an example, the upper door sealing member 300 may be formed of rubber or the like.

The dishwasher 100 may further include the housing panel 170. The housing panel 170 may be disposed outside the tub 110. In detail, the housing panel 170 may be coupled to opposite sidewalls of the tub 110, that is, a left side wall and a right side wall, respectively.

The dishwasher 100 may further include the tub body 113 and the tub top 114 mounted to the tub body 113. The tub 110 may include the tub body 113 and the tub top 114. The tub top 114 may be coupled to an upper end of the tub body 113. The tub top 114 may be provided with the upper opening 112 corresponding to the opening 11 of the counter 10.

The tub top 114 may be formed of a material different from the tub body 113. As an example, the tub top 114 may be formed of polypropylene (PP), and the tub body 113 may be formed of stainless steel (STS).

The tub top 114 may be provided with the water collector 115. The water collector 115 may be formed along a circumference of the tub top 114 to have a predetermined depth. The water collector 115 may be formed on the tub top 114 to be positioned outside the connection member 310 which will be described later. When washing water does not flow into the inside of the tub 110 and flows along an outer wall of the tub 110 due to incomplete coupling and abrasion of the connection member 310, not only an unsanitary problem but a fire may be caused. The water collector 115 is formed at the uppermost end of the tub body 113, that is, at the tub top 114 to collect washing water that does not flow into the inside of the tub 110 and guide the collected washing water into the inside of the tub 110.

The tub top 114 may be provided with the panel fixing portion 116. The housing panel 170 may be coupled to the tub 110 to face the opposite sidewalls of the tub 110. In detail, the housing panel 170 may be coupled to the panel fixing portion 116 of the tub top 114 to face opposite sidewalls of the tub body 113. The housing panel 170 may be fixed to the panel fixing portion 116 by a coupling member such as a screw.

The dishwasher 100 may further include the connection member 310. The connection member 310 may be provided to connect the cover frame 150 and the tub 110. In detail, the connection member 310 may connect the cover frame 1150 and the tub 110 to be capable of extending and contracting in the height direction Z of the system kitchen 1. The connection member 310 may have an elastic material. As an example, the connection member 310 may be formed of a material such as rubber. An upper end of the connection member 310 may be coupled to the cover frame 150, and a lower end of the connection member 310 may be coupled to the tub 110. In other words, the upper end of the connection member 310 may be coupled to the cover frame 150, and the lower end of the connection member 310 may be coupled to the tub top 114.

The dishwasher 100 may further include the front door sealing member 320. The front door sealing member 320 may be coupled to the front door 130. The front door sealing member 320 serves to compensate for sealing a gap between the tub 110 and the front door 130 to prevent washing water inside the tub 110 from leaking to the outside of the front door 130. The front door sealing member 320 may be formed of an elastic material. As an example, the front door sealing member 320 may be formed of rubber or the like.

The upper door 120 may include a communicator configured to control the operation of the dishwasher 100 according to whether the upper door 120 is opened or closed. As an example, when a controller is positioned in a "lower module", which will be described later, the controller may be electrically connected to a sensor provided in the upper door 120 to detect whether the upper door 120 is opened or closed. When the controller is positioned in the upper door 120, the controller of the upper door 120 may be electrically connected to the sensor provided in the upper door 120 to detect whether the upper door 120 is opened or closed. In addition, the controller of the upper door 120 may be electrically connected to various electronic components disposed in the lower module.

The dishwasher 100 may further include the wire 500 provided to couple the connection member 310 to the cover frame 150. The wire 500 may include the knot 510 (see FIG. 4).

Hereinafter, a process of installing the dishwasher 100 in the system kitchen 1 in a built-in manner will be described. For convenience of description, the cover frame 150 and the upper door 120 among the components of the dishwasher 100 are referred to as an "upper module", and the remaining components except for the cover frame 150, the upper door 120 and the connection member 310 among the components of the dishwasher 100 are referred to as the "lower module". First, the lower module is mounted to the cabinet 20 in the front-rear direction X of the system kitchen 1. In detail, the lower module is received in the front-rear direction X of the system kitchen 1 in the cabinet 20 having a front opening and then fixed to the cabinet 20. Thereafter, the upper module is mounted to the counter 10. In detail, the cover frame 150 is mounted in the opening 11 of the counter 10, and the upper door 120 is installed on the cover frame 150. The upper module and the lower module may be connected by the connection member 310. In detail, the cover frame 150 of the upper module and the tub 110 of the lower module may be connected by the connection member 310.

Figure 18:
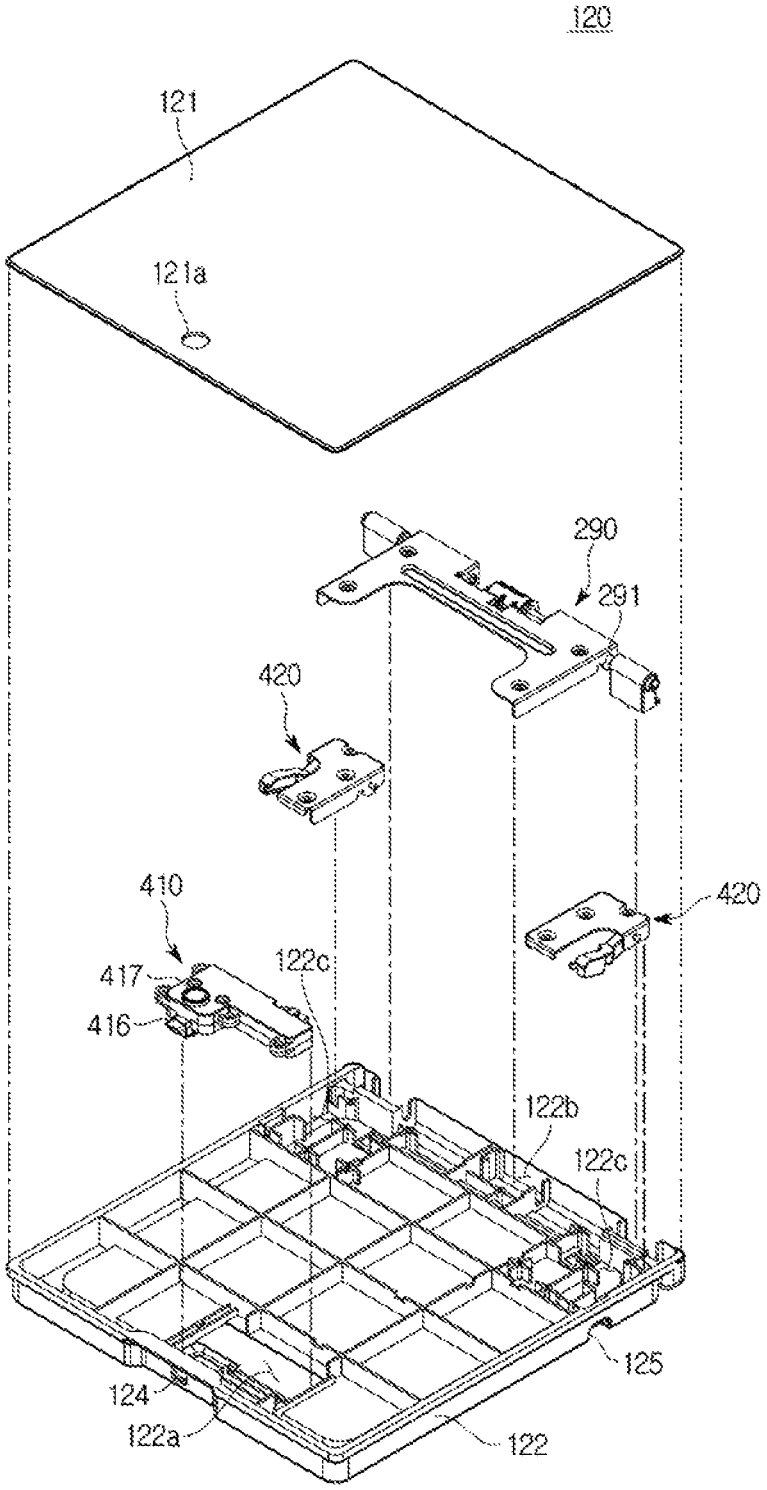
FIG. 18 is an exploded perspective view of an upper door of the system kitchen shown in FIG. 14.
Figure 19:
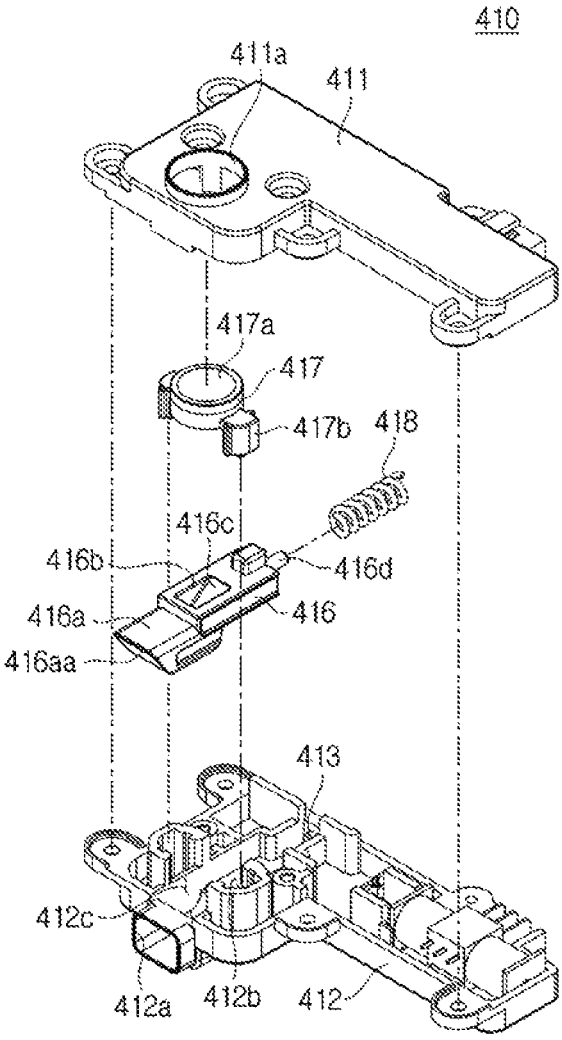
FIG. 19 is an exploded perspective view of the trigger shown in FIG. 18.
Figure 20:
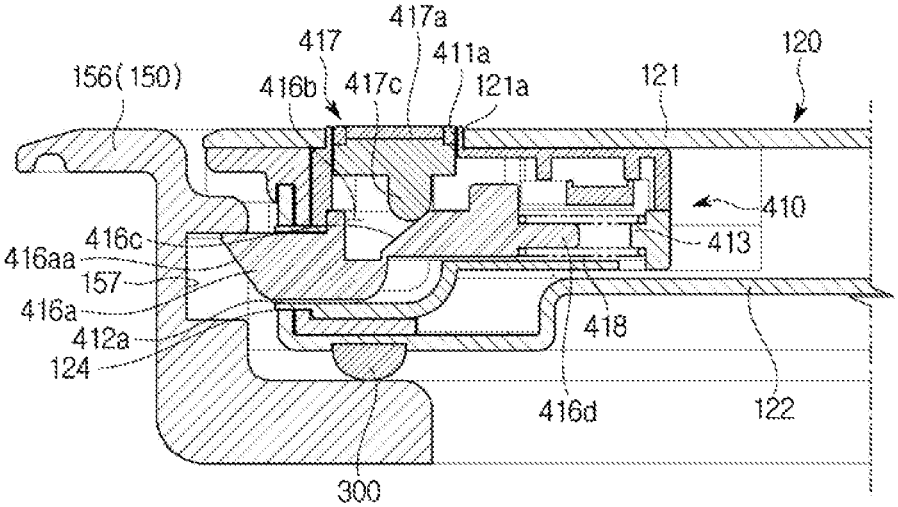
FIG. 20 is a cross-sectional view illustrating a state in which the trigger shown in FIG. 19 is in a locking position in which the upper door is locked.
Figure 21:
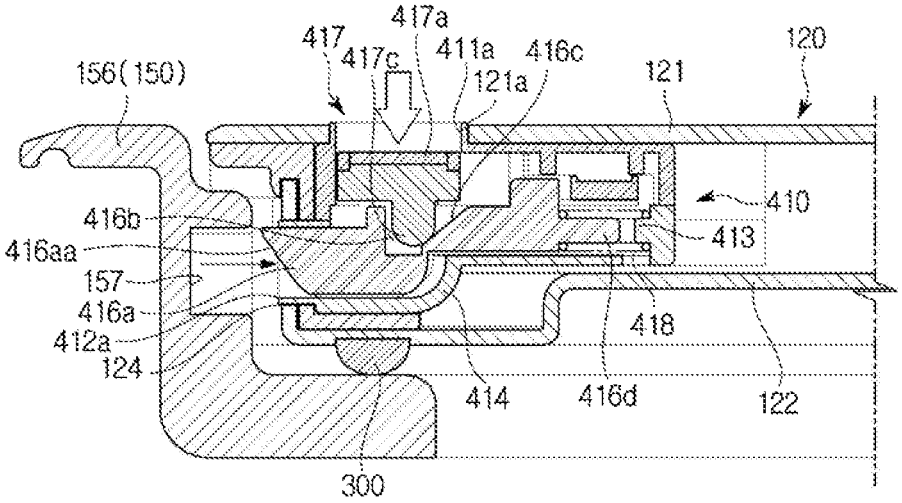
FIG. 21 is a cross-sectional view illustrating a state in which the trigger shown in FIG. 19 is in an unlocking position in which the upper door is unlocked.
Figure 22:
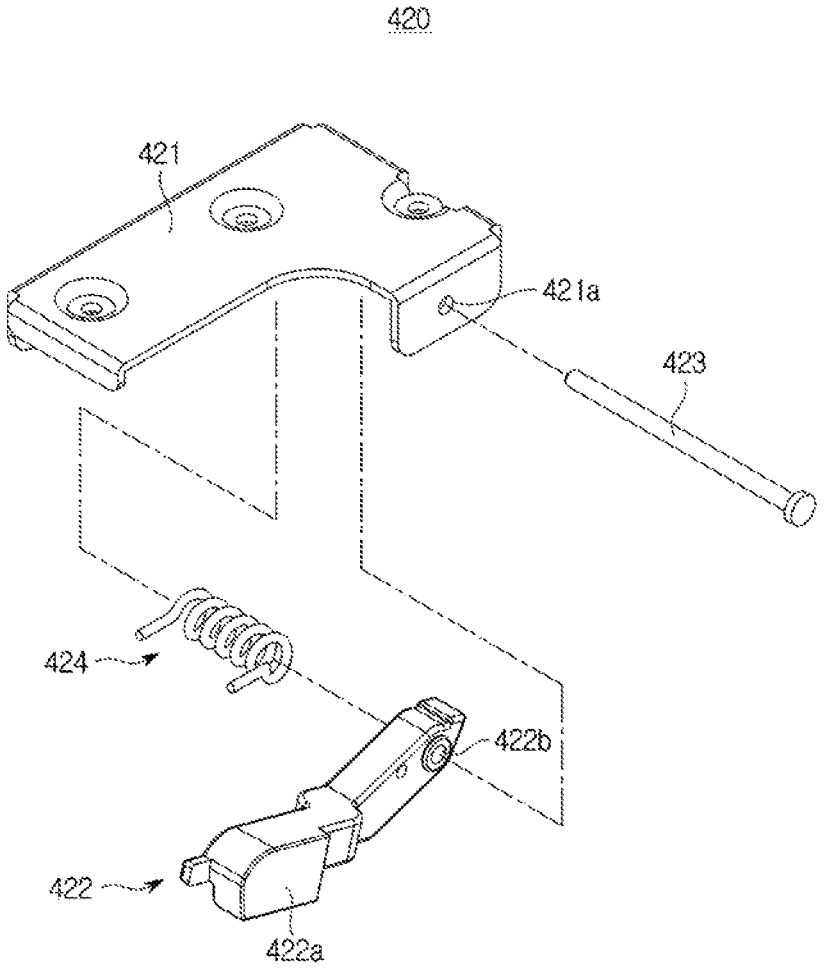
FIG. 22 is an exploded perspective view of the lift apparatus shown in FIG. 18.
Figure 23:
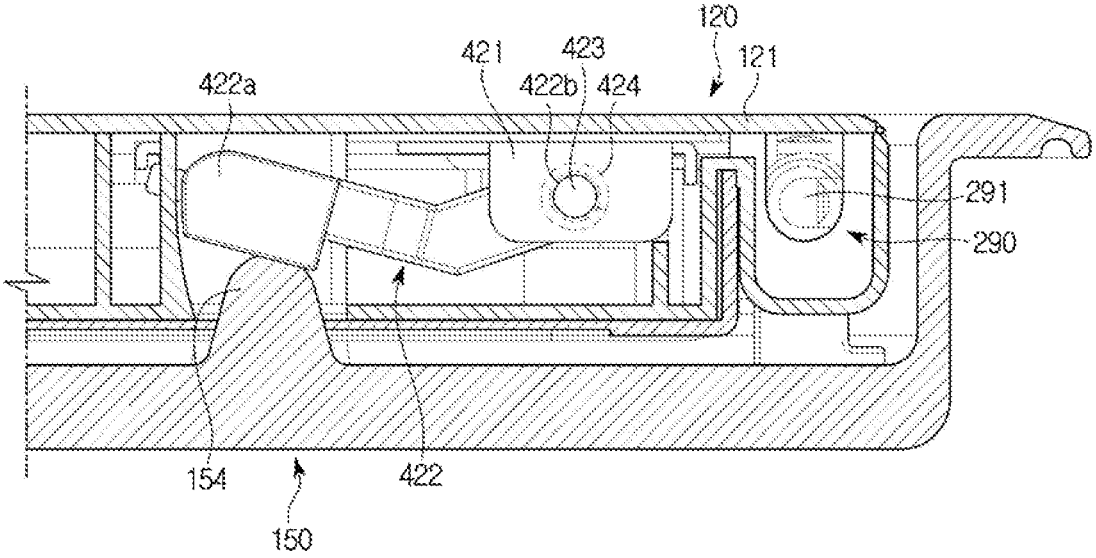
FIG. 23 is a cross-sectional view illustrating a state of the lift apparatus when the trigger shown in FIG. 18 locks the upper door.
Figure 24:
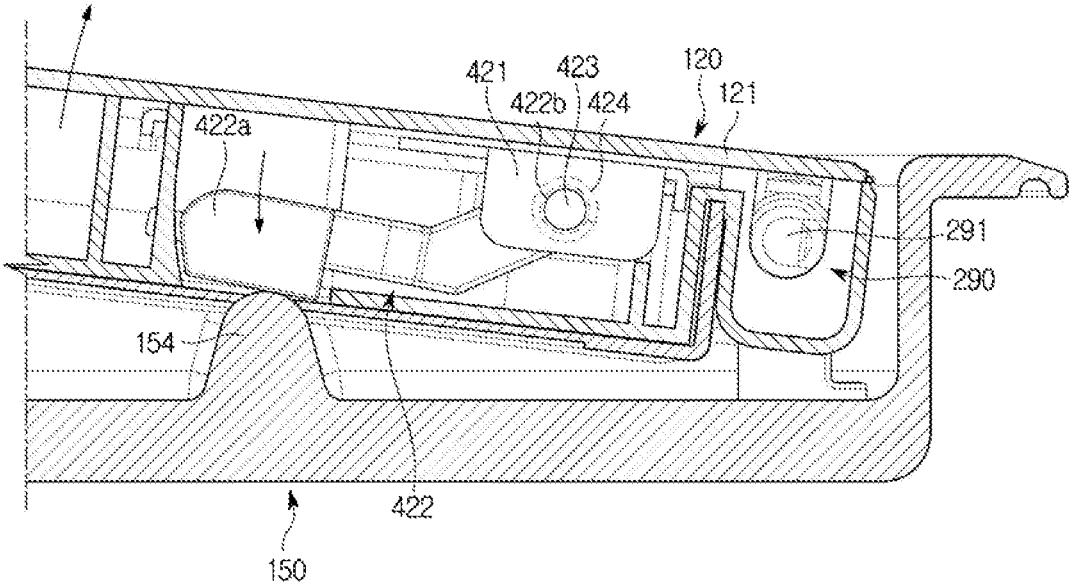
FIG. 24 is a cross-sectional view illustrating a state of the lift apparatus when the trigger shown in FIG. 18 unlocks the upper door.

FIG. 18 is an exploded perspective view of an upper door of the system kitchen shown in FIG. 14. FIG. 19 is an exploded perspective view of the trigger shown in FIG. 18. FIG. 20 is a cross-sectional view illustrating a state in which the trigger shown in FIG. 19 is in a locking position in which the upper door is locked. FIG. 21 is a cross-sectional view illustrating a state in which the trigger shown in FIG. 19 is in an unlocking position in which the upper door is unlocked. FIG. 22 is an exploded perspective view of the lift apparatus shown in FIG. 18. FIG. 23 is a cross-sectional view illustrating a state of the lift apparatus when the trigger shown in FIG. 18 locks the upper door. FIG. 24 is a cross-sectional view illustrating a state of the lift apparatus when the trigger shown in FIG. 18 unlocks the upper door.

Referring to FIG. 18, the upper door may include an upper frame 121, the lower frame 122, a trigger 410, and a lift apparatus 420.

The upper frame 121 may be configured to cover an upper surface of the lower frame 122. The upper frame 121 may cover the trigger 410 and the lift apparatus 420 mounted on the lower frame 122. The upper frame 121 may include a button opening 121*a* to expose a button member 417 of the trigger 410 to the outside.

The lower frame 122 may include a trigger mounting portion 122*a* on which the trigger 410 is mounted, a hinge mounting portion 122*b* on which the upper door hinge 290 is mounted, and a lifter mounting portion 122*c* on which the lift apparatus 420 is mounted. Because FIG. 18 illustrates that two of the lift apparatuses 420 are provided, two of the lifter mounting portions 122*c* may be provided. However, the number of the lift apparatuses 420 and the lifter mounting portions 122*c* is not limited thereto, and as needed, one, or three or more of lift apparatuses and the lifter mounting portions may be provided.

The lower frame 122 may include a through hole 124 formed at an outer surface thereof such that a locking member 416 protrudes to the outside of the upper door 120. For smooth movement of the locking member 416, a size of the through hole 124 may be slightly larger than a size of the locking member 416. The through hole 124 may be disposed to correspond to a position where a locking opening 157 of the cover frame 150 is provided.

The lower frame 122 may include a lift opening 125 provided such that a push portion 422*a* of an arm member 422 of the lift apparatus 420 and a pressing portion 154 of the cover frame 150 are in contact with to each other. The number of the lift openings 125 may be provided to correspond to the number of the lift apparatuses 420.

The trigger 410 may be disposed at a front end portion opposite to a rear end at which the upper door hinge 290 of the upper door 120 is disposed. Referring to FIGS. 19 to 21, the trigger 410 may include an upper case 411, a lower case 412, the locking member 416, the button member 417, and an elastic member 418.

The upper case 411 may form a space together with the lower case 412 to receive the locking member 416, the button member 417, and the elastic member 418 therein. A button exposure hole 411*a* may be formed on an upper surface of the upper case 411 to expose a portion of the button member 417 to the outside. The upper case 411 may cover an upper portion of the lower case 412.

The lower case 412 may form the space together with the upper case 411 to receive the locking member 416, the button member 417, and the elastic member 418 therein.

The lower case 412 may include a locking member exposure hole 412*a* through which the locking member 416 protrudes to the outside. The lower case 412 may include a locking member receiving portion 412*c* to slidingly receive the locking member 416. The locking member 416 may slidingly move on the locking member exposure hole 412*a* and the locking member receiving portion 412*c*.

The lower case 412 may include a button member guide 412*b* to guide the vertical movement of the button member 417. A leg 417*b* of the button member 417 may be inserted into the button member guide 412*b* to be slidable in the up-down direction.

The lower case 412 may include an elastic member fixing portion 413 to which the elastic member 418 is fixed.

The locking member 416 may be slidingly seated on the locking member receiving portion 412*c* of the lower case 412. The locking member 416 may be provided to be movable between a locking position in which the locking member protrudes to the outside of the trigger 410 to lock the upper door 120 and an unlocking position in which the locking member is inserted into the trigger 410 to unlock the upper door 120.

The locking member 416 may include a head 416*a*. The head 416*a* may be exposed to the outside of the trigger 410 through the locking member exposure hole 412*a*. The head 416*a* may be selectively inserted into the locking opening 157 of the cover frame 150 as the locking member 416 slidingly moves. The head 416*a* may include a first guide surface 416*aa* that is in contact with the cover frame 150 when the upper door 120 is closed and guided by the cover frame 150 to move in the rearward direction as a force is applied in the upward direction. The first guide surface 416*aa* may be formed to be inclined in a rear lower direction from a front upper side.

The locking member 416 may include a protrusion receiving portion 416*b* recessed to allow a pressing protrusion 417*c* of the button member 417 to be inserted therein when the button member 417 is pressed. The protrusion receiving portion 416*b* may include a second guide surface 416*c* receiving the pressing protrusion 417 and guided by the pressing protrusion 417 such that the locking member 416 may move in the rearward direction when a force is applied downwardly to the locking member 416. The second guide surface 416*c* may be formed to be inclined in a rear upper direction from a front lower side.

The locking member 416 may include an elastic member fixing portion 416*d* to which one end of the elastic member 418 is fixed.

The button member 417 may be configured such that a portion thereof is exposed to the outside of the trigger 410 by the button exposure hole 411*a* of the upper case 411. The button member 417 may be configured to release the locking of the locking member 416 when the exposed portion is pressed downward by the user.

In detail, the button member 417 may include a button 417*a* exposed to the outside of the trigger 410 through the button exposure hole 411*a*, the pressing protrusion 417*c* extending downwardly to be selectively inserted into the protrusion receiving portion 416*b* of the locking member 416, and the leg 417*b* inserted into the button member guide 412*b* to guide the vertical movement.

A rear end of the elastic member 418 may be fixed to the elastic member fixing portion 413 of the lower case 412, and the front end thereof may be fixed to the elastic member fixing portion 416*d* of the locking member 416. The elastic member 418 may elastically bias the locking member 416 to the locking position. That is, the elastic member 418 may press the locking member 416 to protrude the head 416*a* of the locking member 416 to the outside.

Referring to FIG. 20, when the upper door 120 is closed, the head 416*a* of the locking member 416 is inserted into the locking opening 157. That is, the locking member 416 is placed in the locking position by a force of the elastic member 418.

Referring to FIG. 21, when the user presses the button 417*a* to open the upper door 120, as the button 417*a* is pressed downward, the pressing protrusion 417*c* also moves downward. At this time, the pressing protrusion 417*c* descends along the second guide surface 416*c* and is inserted into the protrusion receiving portion 416*b*, thereby moving the locking member 416 backward. That is, the locking member 416 moves to the unlocking position. Accordingly, the head 416*a* is separated from the locking opening 157 and the upper door 120 becomes in a state capable of being opened.

When the user releases the force applied to the button 417*a*, the locking member 416 is moved back to the locking position by the elastic member 418, and in this case, the pressing protrusion 417*c* of the button member 417 may be moved upward along the second guide surface 416*c*.

The lift apparatus 420 may be disposed at a rear end of the upper door 120 where the upper door hinge 290 is disposed. Referring to FIGS. 22 to 24, the lift apparatus 420 may include a lift cover 421, the arm member 422, a lift shaft 423, and an elastic member 424.

The lift cover 421 may support and receive the arm member 422, the lift shaft 423, and the elastic member 424. The lift cover 421 may be mounted on the lower case 122. The lift cover 421 may include a shaft hole 421*a* into which the lift shaft 423 is rotatably inserted.

The arm member 422 may include an arm head 422*a* and a shaft fixing portion 422*b*. The shaft fixing portion 422*b* is a portion to which the lift shaft 423 is fixed in an inserted state. Accordingly, the arm member 422 and the lift shaft 423 are fixed to each other and may rotate together with respect to the lift cover 421. The arm head 422*a* may be provided to coming into contact with the pressing portion 154 of the cover frame 150.

The lift shaft 423 may be rotatably inserted into the lift cover 421. The lift shaft 423 may be inserted into and fixed to the arm member 422.

One side of the elastic member 424 may be fixed to the lift cover 421, and the other side thereof may be fixed to the arm member 422. Referring to FIGS. 23 and 24, as seen from the left, the elastic member 424 may apply a force to the arm member 422 such that the arm member 422 is elastically biased in the counterclockwise direction with respect to the lift cover 421. As seen from another side, the elastic member 424 may apply a force to the lift cover 421 such that the lift cover 421 is elastically biased in the clockwise direction relative to the arm member 422.

Referring to FIG. 23, when the trigger 410 is in the locking position and the upper door 120 is in the closed state, the arm head 422*a* of the arm member 422 is in contact with the pressing portion 154, and the elastic member 424 is in a state of having an elastic force in a direction of opening the upper door 120.

Referring to FIG. 24, when the trigger 410 is in the unlocking position and the upper door 120 is in a state of starting to open, the arm head 422*a* of the arm member 422 is in contact with the pressing portion 154, and the elastic member 424 may apply an elastic force to the lift cover 421 to rotate the lift cover 421 in the clockwise direction. That is, because the arm member 422 is fixed in a state of being in contact with the pressing portion 154, the lift cover 421 may be lifted by a predetermined angle by the elastic member 424. Accordingly, the upper door 120 to which the lift cover 421 is fixed may be opened by the predetermined angle.

When closing the upper door 120, the user applies a force greater than the elastic force of the elastic member 424 to the upper door 120, and when the arm head 422*a* of the arm member 422 comes in contact with the pressing portion 154, the lift cover 421 and the upper door 120 rotate in the counterclockwise direction in a state in which the arm member 422 is fixed.

According to this configuration, the dishwasher 100 according to the embodiment of the present disclosure may automatically open the upper door 120 by a predetermined angle only by pressing the button 417*a* of the trigger 410, and thus the upper door 1200 may be easily opened with a relatively simple configuration. In addition, because the button 417*a* is positioned at substantially the same height as an upper surface of the upper door 120, there is no structure protruding from the upper door 120 to open the upper door 120, so that discomfort that may be felt when a user performs cooking or the like on the counter 10 may be reduced.

Figure 25:
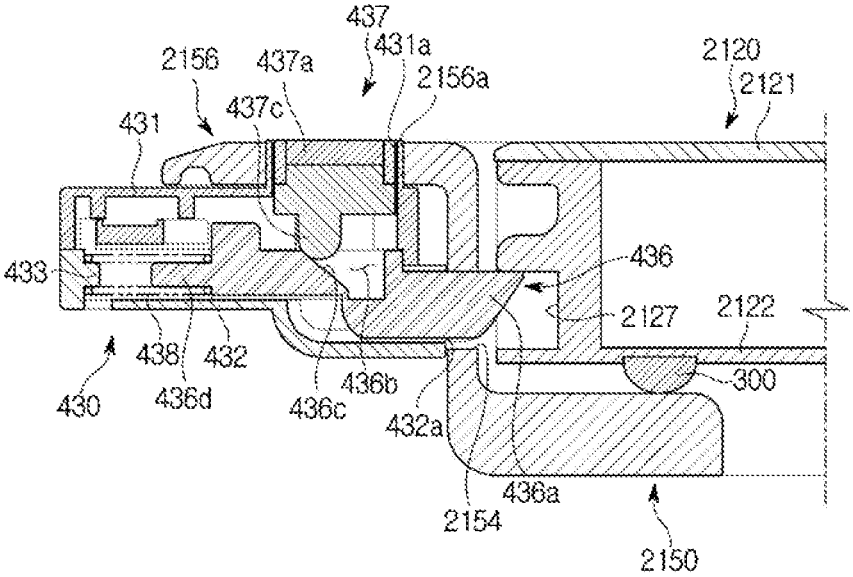
FIG. 25 is a cross-sectional view illustrating a state in which a trigger according to another embodiment is in a locking position in which the upper door is locked.
Figure 26:
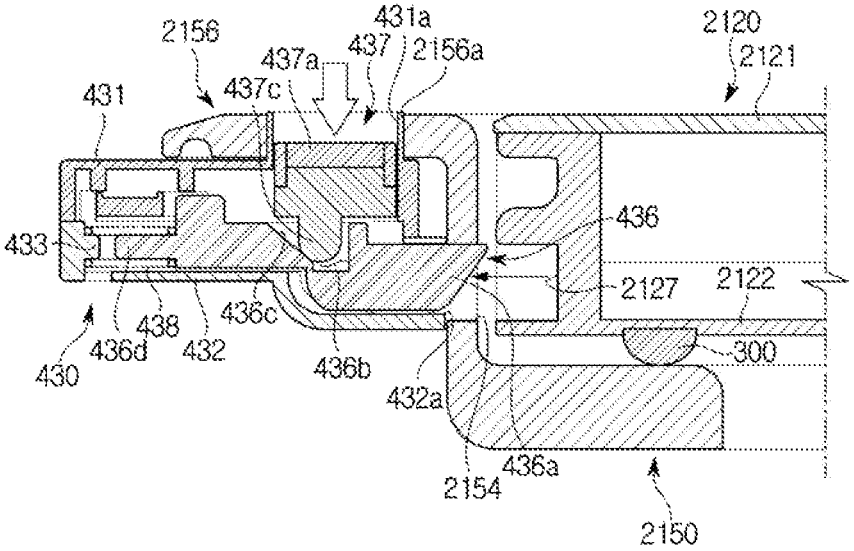
FIG. 26 is a cross-sectional view illustrating a state in which the trigger shown in FIG. 25 is in an unlocking position in which the upper door is unlocked.

FIG. 25 is a cross-sectional view illustrating a state in which a trigger according to another embodiment is in a locking position in which the upper door is locked. FIG. 26 is a cross-sectional view illustrating a state in which the trigger shown in FIG. 25 is in an unlocking position in which the upper door is unlocked.

In the description of the embodiment illustrated in FIGS. 25 and 26, the same reference numerals may be given to the same elements as in the above-described embodiments, and a description thereof may be omitted.

Referring to FIGS. 25 and 26, a trigger 430 may be positioned at a cover frame 2150. In detail, the trigger 430 may be disposed below a bent portion 2156 of the cover frame 2150. The trigger 430 may include an upper case 431, a lower case 432, a locking member 436, a button member 437, and an elastic member 438. An upper door 2120 may include an upper frame 2121 and a lower frame 2122.

A button exposure hole 431*a* may be formed on an upper surface of the upper case 431 to expose a portion of the button member 437 to the outside. The button exposure hole 431*a* may be formed to correspond to a button opening 2156*a* formed on the cover frame 2150.

The lower case 432 may include a locking member exposure hole 432*a* through which the locking member 436 protrudes to the outside.

The lower case 432 may include an elastic member fixing portion 433 to which the elastic member 438 is fixed.

The locking member 436 may be provided to be movable between a locking position in which the locking member protrudes to the outside of the trigger 430 to lock the upper door 2120 and an unlocking position in which the locking member is inserted into the trigger 430 to unlock the upper door 2120.

The locking member 436 may include a head 436*a*. The head 436*a* may be exposed to the outside of the trigger 430 through the locking member exposure hole 432*a*. The head 436*a* may protrude toward the upper door 120 through a locking opening 2154. The head 436*a* may be selectively inserted into a locking opening 2127 of the upper door 120 as the locking member 436 slidingly moves.

The locking member 436 may include a protrusion receiving portion 436*b* recessed to allow a pressing protrusion 437*c* of the button member 437 to be inserted therein when the button member 437 is pressed. The protrusion receiving portion 436*b* may include a guide surface 436*c* receiving the pressing protrusion 437 and guided by the pressing protrusion 437 such that the locking member 436 may move in the frontward direction when a force is applied downwardly to the locking member 436. The guide surface 436*c* may be formed to be inclined in a rear lower direction from a front upper side.

The locking member 436 may include an elastic member fixing portion 436*d* to which one end of the elastic member 438 is fixed.

The button member 437 may be configured such that a portion thereof is exposed to the outside of the trigger 430 by the button exposure hole 431*a* of the upper case 431. The button member 437 may be configured to release the locking of the locking member 436 when the exposed portion is pressed downward by the user. In addition, when closing the upper door 2120, the user may close the upper door 2120 after moving the locking member 436 to the unlocking position by pressing a button 437*a* of the button member 437.

In detail, the button member 437 may include the button 437*a* exposed to the outside of the trigger 430 through the button exposure hole 431*a*, and the pressing protrusion 437*c* extending downwardly to be selectively inserted into the protrusion receiving portion 436*b* of the locking member 436.

A rear end of the elastic member 438 may be fixed to the elastic member fixing portion 436*d* of the locking member 436, and the front end thereof may be fixed to the elastic member fixing portion 433 of the lower case 432. The elastic member 438 may elastically bias the locking member 436 to the locking position. That is, the elastic member 438 may press the locking member 436 to protrude the head 436*a* of the locking member 436 to the outside.

Referring to FIG. 25, when the upper door 2120 is closed, the head 436*a* of the locking member 436 is inserted into the locking opening 2127. That is, the locking member 436 is placed in the locking position by a force of the elastic member 438.

Referring to FIG. 26, when the user presses the button 437*a* to open the upper door 2120, as the button 437*a* is pressed downward, the pressing protrusion 437*c* also moves downward. At this time, the pressing protrusion 437*c* descends along the guide surface 436*c* and is inserted into the protrusion receiving portion 436*b*, thereby moving the locking member 436 frontward. That is, the locking member 436 moves to the unlocking position. Accordingly, the head 436*a* is separated from the locking opening 2127 and the upper door 2120 becomes in a state capable of being opened.

When the user releases the force applied to the button 437*a*, the locking member 436 is moved back to the locking position by the elastic member 438, and in this case, the pressing protrusion 437*c* of the button member 437 may be moved upward along the guide surface 436*c*. Therefore, when the user tries to close the upper door 2120 again, the upper door 2120 may be closed in a state in which the user presses the button 437*a* to move the locking member 436 to the unlocking position.

Figure 27:
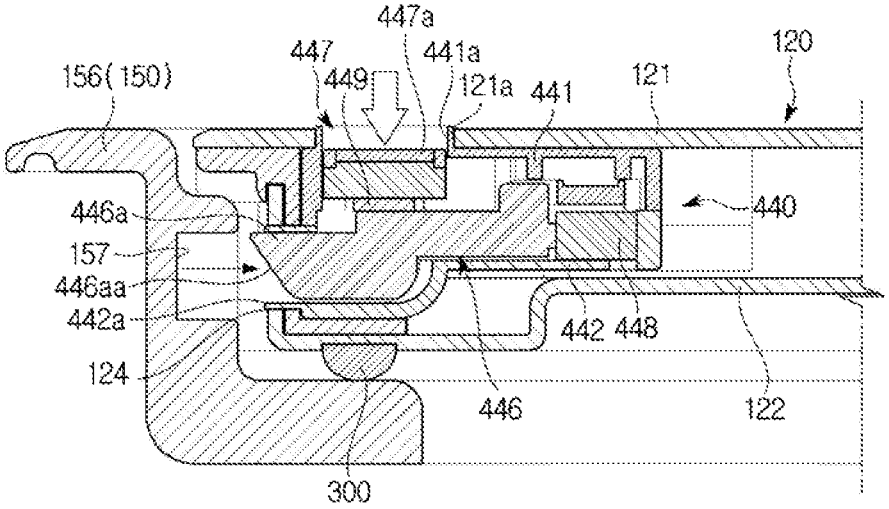
FIG. 27 is a cross-sectional view illustrating a state in which a trigger according to another embodiment is in a locking position in which the upper door is locked.
Figure 28:
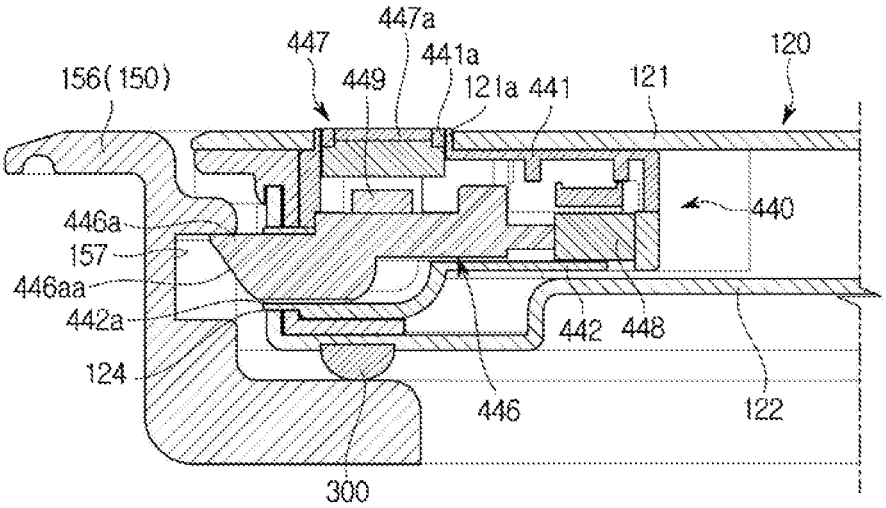
FIG. 28 is a cross-sectional view illustrating a state in which the trigger shown in FIG. 27 is in an unlocking position in which the upper door is unlocked.

FIG. 27 is a cross-sectional view illustrating a state in which a trigger according to another embodiment is in a locking position in which the upper door is locked. FIG. 28 is a cross-sectional view illustrating a state in which the trigger shown in FIG. 27 is in an unlocking position in which the upper door is unlocked.

In the description of the embodiment illustrated in FIGS. 27 and 28, the same reference numerals may be given to the same elements as in the above-described embodiments, and a description thereof may be omitted.

Referring to FIGS. 27 and 28, a trigger 440 may be disposed at a front end portion opposite to a rear end at which the upper door hinge 290 of the upper door 120 is disposed. The trigger 440 may include an upper case 441, a lower case 442, a locking member 446, a button member 447, a driving apparatus 448, and a control module 449.

A button exposure hole 441*a* may be formed on an upper surface of the upper case 441 to expose a portion of the button member 447 to the outside. The button exposure hole 441*a* may be provided to correspond to the button opening 121*a*.

The lower case 442 may include a locking member exposure hole 442*a* through which the locking member 446 protrudes to the outside.

The locking member 446 may be provided to be movable between a locking position in which the locking member protrudes to the outside of the trigger 440 to lock the upper door 120 and an unlocking position in which the locking member is inserted into the trigger 440 to unlock the upper door 120.

The locking member 446 may include a head 446*a*. The head 446*a* may be exposed to the outside of the trigger 440 through the locking member exposure hole 442*a*. The head 446*a* may be selectively inserted into the locking opening 157 of the cover frame 150 as the locking member 446 slidingly moves. The head 446*a* may include a guide surface 446*aa* that is in contact with the cover frame 150 when the upper door 120 is closed and guided by the cover frame 150 to move in the rearward direction as a force is applied in the upward direction. The guide surface 446*aa* may be formed to be inclined in a rear lower direction from a front upper side.

The button member 447 may be configured such that a portion thereof is exposed to the outside of the trigger 440 by the button exposure hole 441*a* of the upper case 441. The button member 447 may be configured to release the locking of the locking member 446 when the exposed portion is pressed downward by the user.

In detail, the button member 447 may include a button 447*a* exposed to the outside of the trigger 440 through the button exposure hole 441*a*.

The driving apparatus 448 is disposed in the rear of the locking member 446 and may move the locking member 446 to the locking position or the unlocking position. The driving apparatus 448 may include a motor and a shaft.

The control module 449 may be configured to detect whether the button member 447 is pressed and to drive the driving apparatus 448. The control module 449 may include a sensor. The sensor may be a touch sensor.

Referring to FIG. 27, when the upper door 120 is closed, the head 446*a* of the locking member 446 is inserted into the locking opening 157. That is, the locking member 446 is positioned at the locking position as the driving apparatus 448 moves the locking member 446.

Referring to FIG. 28, when the user presses the button 447*a* to open the upper door 120, the movement of the button member 447 caused by the button 447*a* being pressed downward is detected by the sensor of the control module 449, and the control module 449 drives the driving apparatus 448 to move the locking member 446 rearwards. That is, the driving apparatus 448 may move the locking member 446 to the unlocking position. Accordingly, the head 446*a* is separated from the locking opening 157 and the upper door 120 becomes in a state capable of being opened.

The button member 447 may be elastically biased in an upward direction by an elastic member (not shown). Therefore, when the user releases the force applied to the button 447*a*, the button member 447 may be returned to its original position by moving upward again.

Thereafter, when the user tries to close and lock the upper door 120, the user may press the button member 447 once more, and the control module 449 that has detected the movement of the button member 447 may drive the driving apparatus 448 to move the locking member 446 forward.

That is, the driving apparatus 448 may move the locking member 446 to the locking position.

Figure 29:
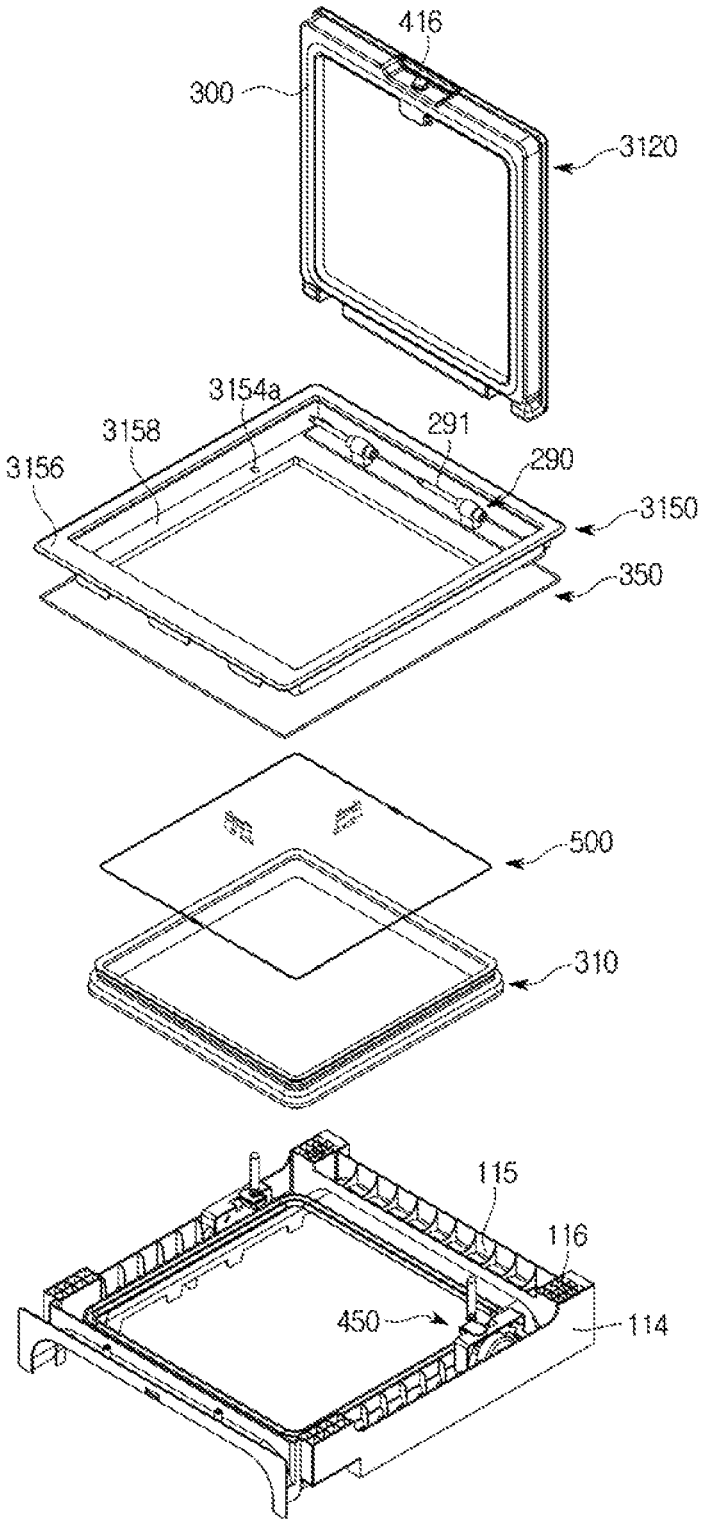
FIG. 29 is an exploded view of a part of the dishwasher including a lift apparatus according to another embodiment.
Figure 30:
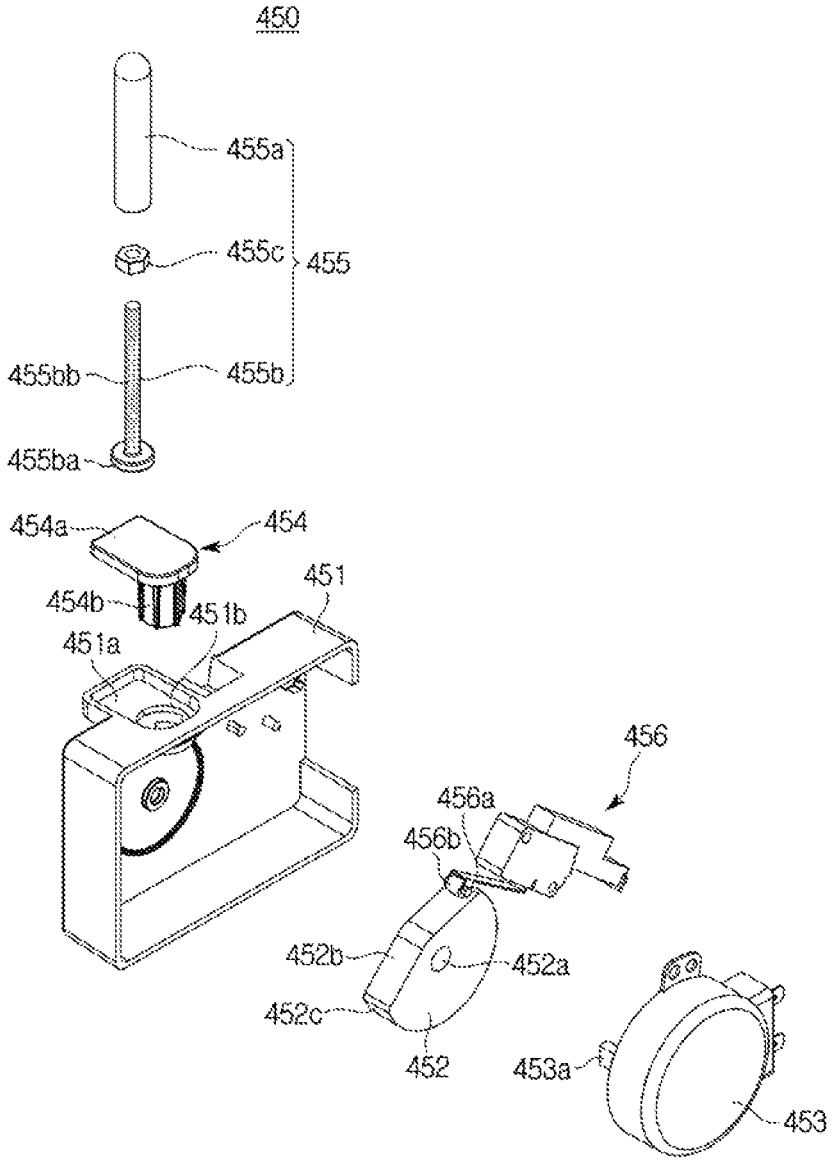
FIG. 30 is an exploded perspective view of the lift apparatus shown in FIG. 29.
Figure 31:
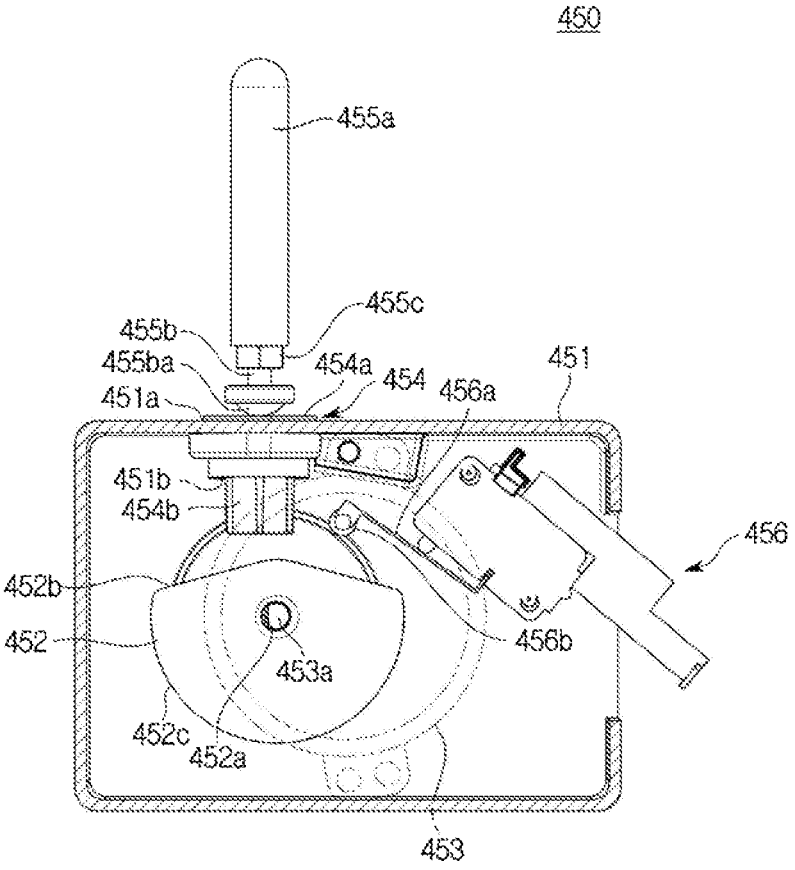
FIG. 31 is a view illustrating a state of the lift apparatus when the trigger locks the upper door.
Figure 32:
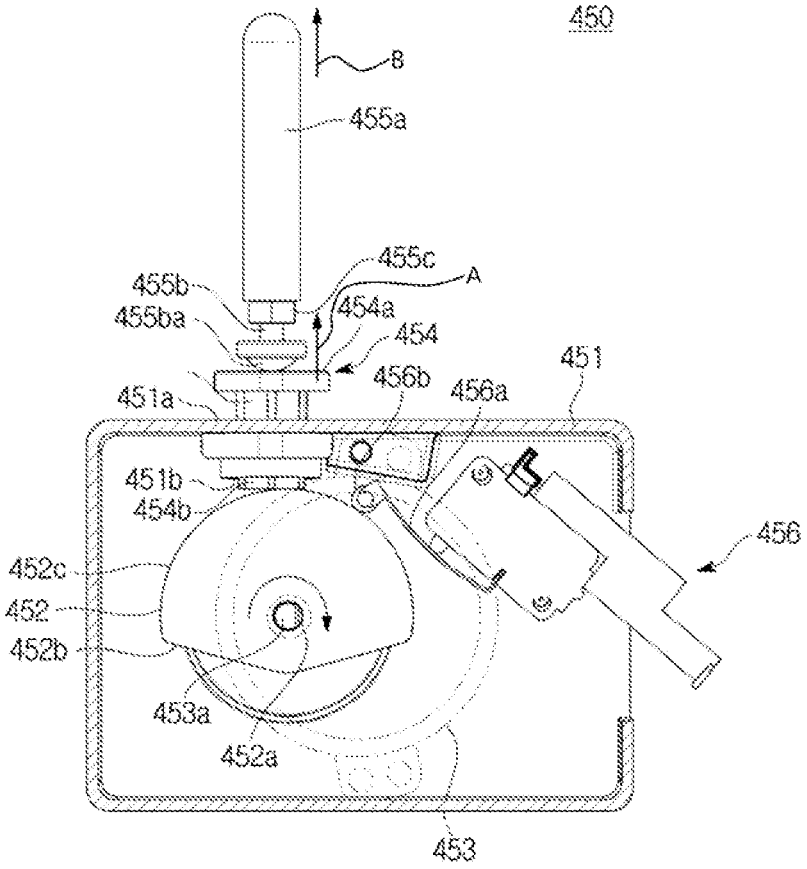
FIG. 32 is a view illustrating a state of the lift apparatus when the trigger unlocks the upper door.
Figure 33:
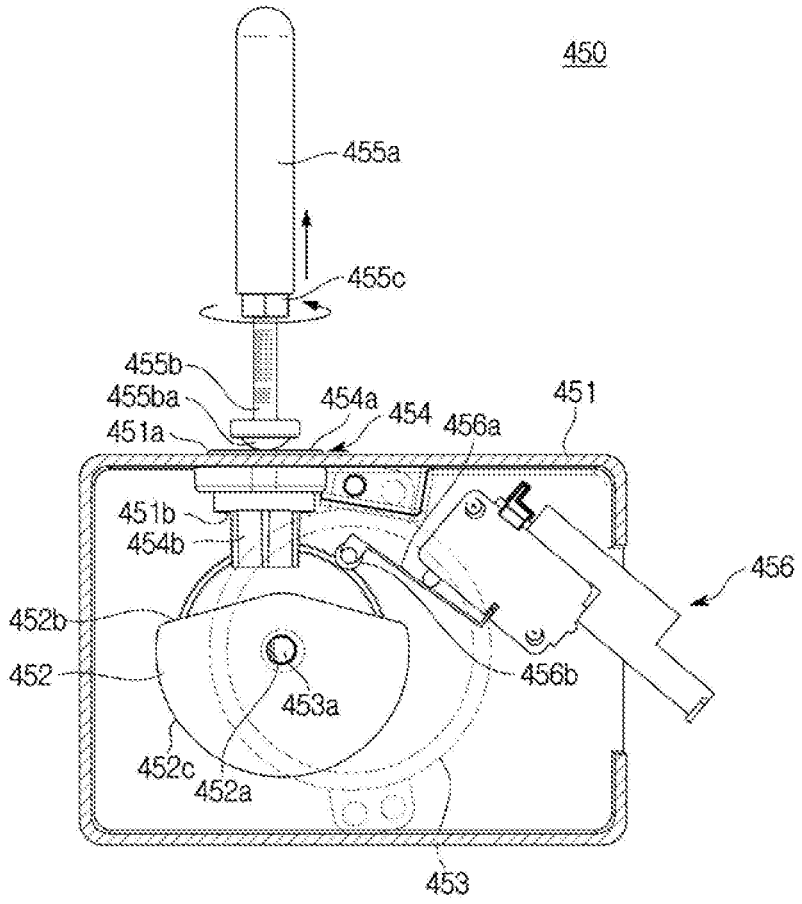
FIG. 33 is a view illustrating a state of adjusting a length of the push member shown in FIG. 30.

FIG. 29 is an exploded view of a part of the dishwasher including a lift apparatus according to another embodiment. FIG. 30 is an exploded perspective view of the lift apparatus shown in FIG. 29. FIG. 31 is a view illustrating a state of the lift apparatus when the trigger locks the upper door. FIG. 32 is a view illustrating a state of the lift apparatus when the trigger unlocks the upper door. FIG. 33 is a view illustrating a state of adjusting a length of the push member shown in FIG. 30.

In the description of the embodiment illustrated in FIGS. 29 to 33, the same reference numerals may be given to the same elements as in the above-described embodiments, and a description thereof may be omitted.

Referring to FIGS. 29 and 30, a lift apparatus 450 of the dishwasher 100 may be disposed on the tub top 114. The lift apparatus 450 may include a lift case 451, a cam 452, a driving source 453, a support 454, a push member 455, and a switch 456. A cover frame 3150 may include a frame body 3158 and a bent portion 3156.

The lift case 451 receives the cam 452 and the driving source 453 and may include a support seating portion 451*a* provided such that a first portion 454*a* of the support 454 is seated thereon and a support penetrating portion 451*b* provided such that a second portion 454*b* of the support 454 penetrates therethrough. The support 454 may move the push member 455 up and down as the second portion 454*b* slides up and down in the support penetrating portion 451*b*.

The cam 452 may be received in the lift case 451. The cam 452 may rotate by receiving power from the driving source 453 and move the support 454 in the up-down direction. The cam 452 may include a first outer circumferential surface 452*b* having a relatively small radius from a rotational center having a driving source connection portion 452*a*, and a second outer circumferential surface 452*c* having a relatively large radius from the rotational center. The cam 452 may be connected to the driving source 453 through a driving source connection portion 452*a* to receive power.

The driving source 453 may be a motor. The driving source 453 may include a driving shaft 453*a*. The driving shaft 453*a* may be connected to the driving source connection portion 452*a* of the cam 452.

The support 454 may include the first portion 454*a* transmitting a force to the push member 455 and the second portion 454*b* receiving a force from the cam 452. The first portion 454*a* may be seated on the support seating portion 451*a*, and an upper surface thereof may be in contact with the push member 455. The second portion 454*b* may penetrate the support penetrating portion 451*b* and slide on the outer circumferential surfaces 452*b* and 452*c* of the cam 452.

In detail, when the second portion 454*b* is positioned on the first outer circumferential surface 452*b* of the cam 452, the support 454 may be in a lowered position, and when the second portion 454*b* is positioned on the second outer circumferential surface 452*b* of the cam 452, the support 454 may be in a raised position.

The push member 455 may include a push shaft 455*a* having a hollow formed therein, a push pin 455*b* inserted into the hollow of the push shaft 455*a*, and an adjusting screw 455*c* coupled to the push pin 455*b*.

Threads may be formed on an outer circumferential surface 455*bb* of the push pin 455*b*, and the threads of the push pin 455*b* may be coupled to threads formed in the hollow of the push shaft 455*a*. The push pin 455*b* may include a push header 455*ba* in contact with the first portion 454*a* of the support 454 to receive power.

The push member 455 may move up and down by the support 454 to open an upper door 3120 by a predetermined angle. An upper end of the push shaft 455*a* may come into contact with a lower surface of the upper door 3120. The push shaft 455*a* may come into contact with the upper door 3120 by penetrating a shaft opening 3154*a* formed on the cover frame 3150.

The switch 456 may detect a position of the cam 452. The switch 456 may drive the driving source 453 based on the detected position information of the cam 452. The switch 456 may include a roller 456*b* configured to roll on the outer circumferential surfaces 452*b* and 452*c* of the cam 452, and a support member 456*a* configured to elastically support the roller 456*b*.

Referring to FIG. 31, when the upper door 3120 is closed, that is, when the trigger 440 shown in FIGS. 27 and 28 locks the upper door 3120, the support 454 may be seated on the support seating portion 451*a*, and thus the push member 455 may also be in the lowered position.

Referring to FIG. 32, when the upper door 3120 is opened, that is, when the trigger 440 shown in FIGS. 27 and 28 unlocks the upper door 3120, the control module 449 rotates the cam 452 by controlling the driving source 453. The control module 449 may be electrically connected to the driving source 453. That is, when the trigger 440 is operated, the control module 449 may detect the operation and drive the lift apparatus 450 disposed to be spaced apart from the trigger 410.

As the cam 452 rotates, the second portion 454*b* of the support 454 is positioned on the second outer circumferential surface 452*c* of the cam 452. Accordingly, the support 454 moves upward. As the support 454 moves upward, the push member 455 also moves upward. The push member 455 may lift the upper door 3120 by moving upward to open the upper door 3120 by a predetermined angle.

When the support 454 is in contact with the second outer circumferential surface 452*c* of the cam 452, that is, in a raised state, the switch 456 may control the driving source 453 to rotate the cam 452. The switch 456 may drive the driving source 453 by detecting that the support member 456*a* is deformed by the cam 452.

Referring to FIG. 33, when a distance between the cover frame 3150 and the tub top 140 shown in FIG. 29 increases, the push member 455 may adjust a length thereof correspondingly. In detail, the length of the push member 455 may be adjusted by adjusting a coupling degree of the push pin 455*b* screw-coupled to the push shaft 455*a*. The adjusting screw 455*c* may be coupled to come into contact with a lower end of the push shaft 455*a* to adjust the coupling degree of the push pin 455*b* coupled to the push shaft 455*a*.

Figure 34:
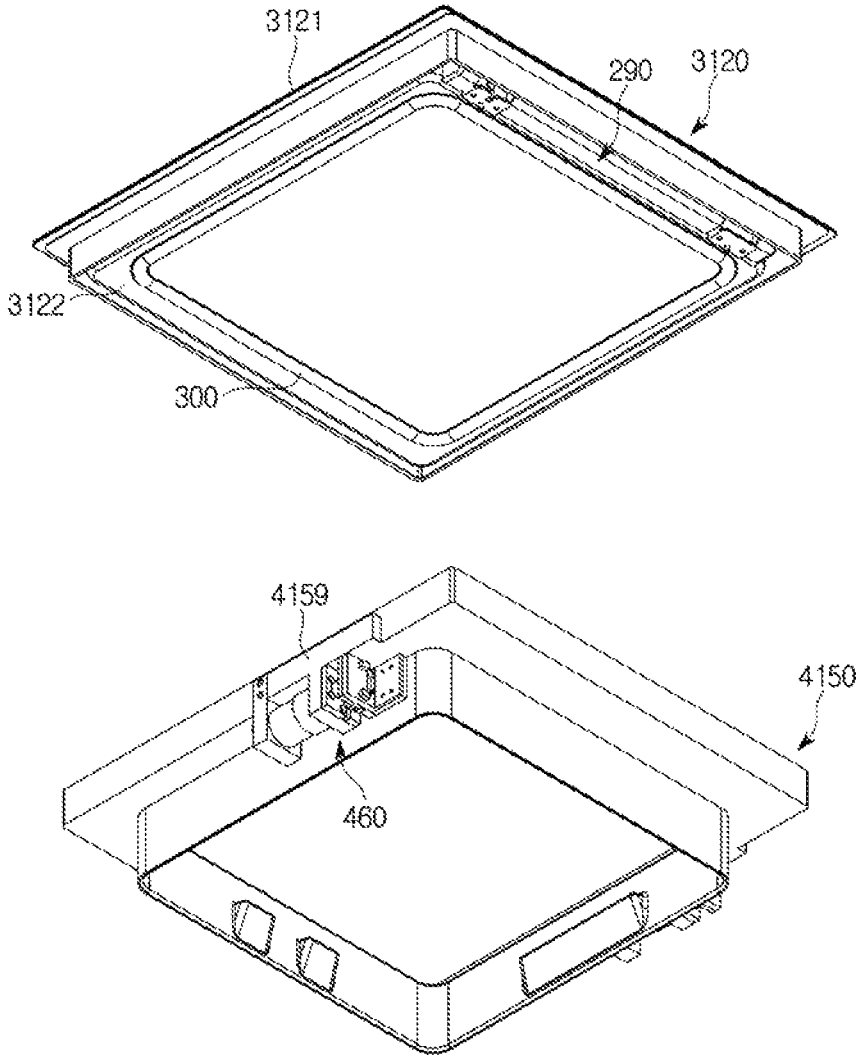
FIG. 34 is an exploded view of a part of the dishwasher including a lift apparatus according to another embodiment.
Figure 35:
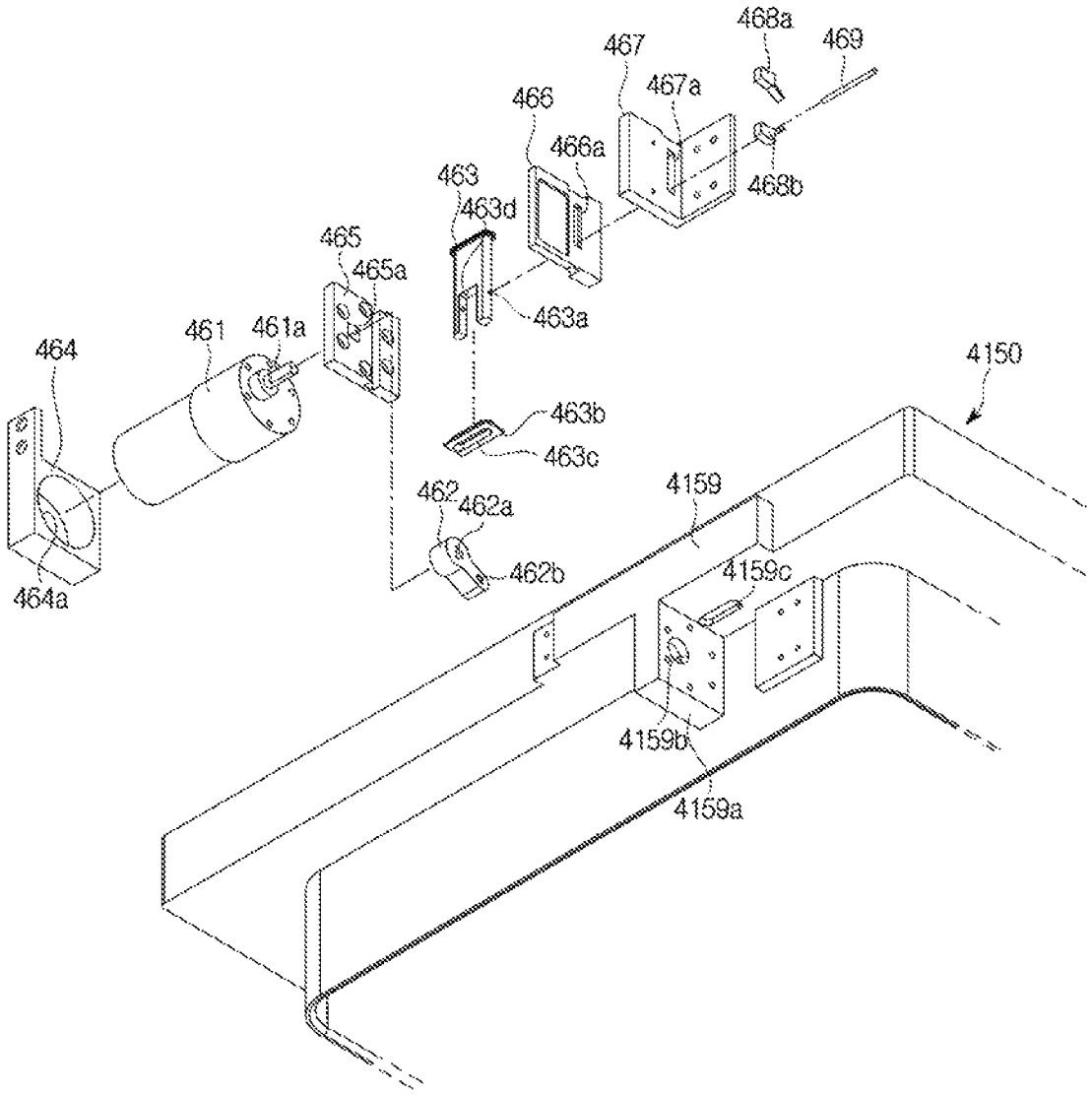
FIG. 35 is an exploded perspective view of the lift apparatus shown in FIG. 34.
Figure 36:
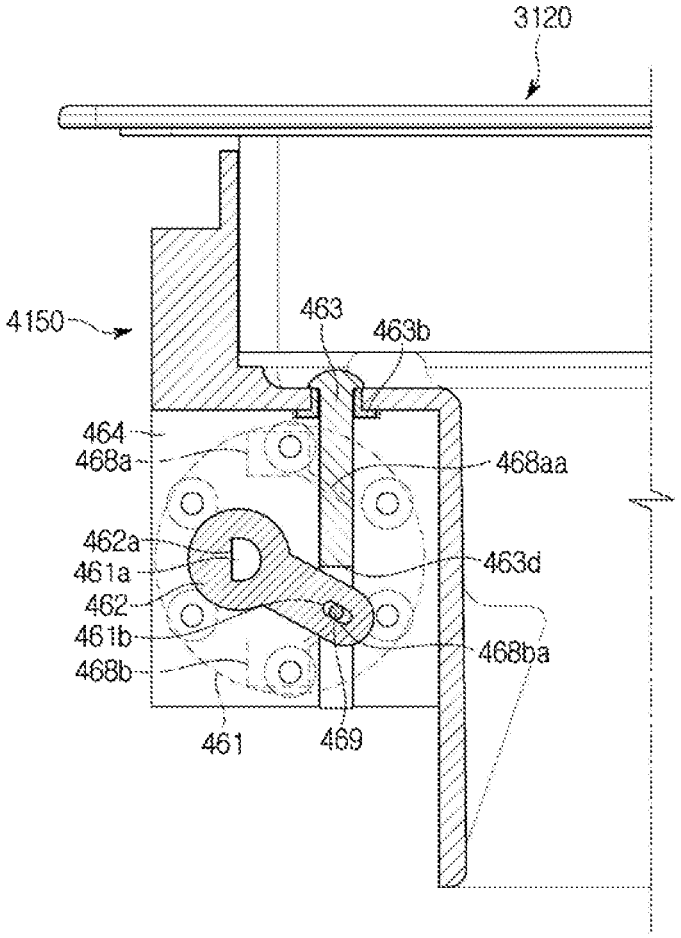
FIG. 36 is a view illustrating a state of the lift apparatus when the trigger locks the upper door.
Figure 37:
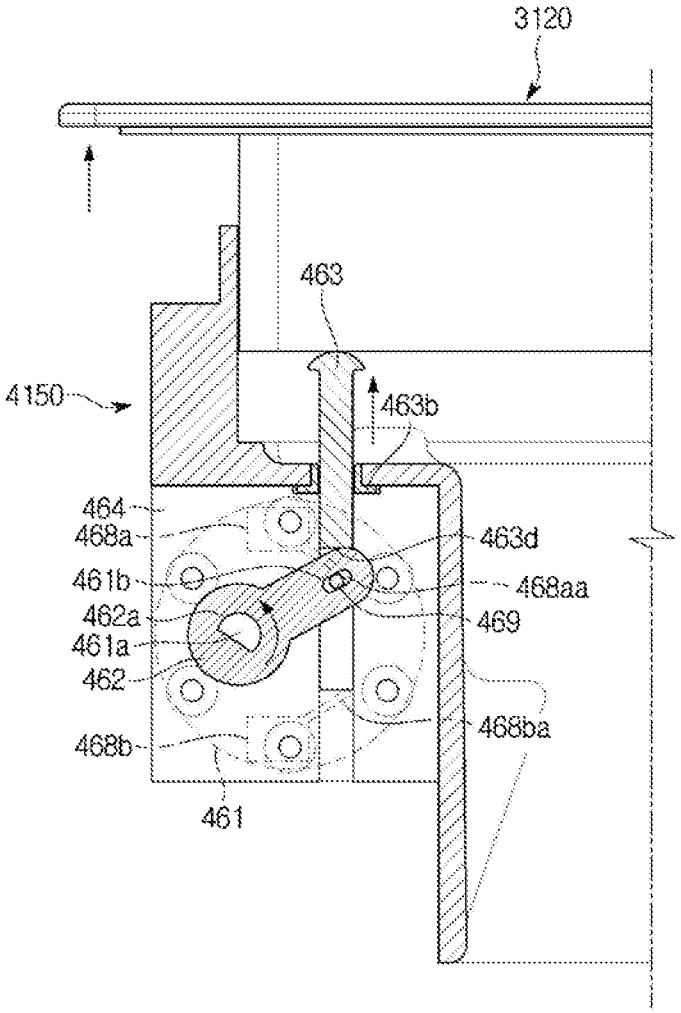
FIG. 37 is a view illustrating a state of the lift apparatus when the trigger unlocks the upper door.

FIG. 34 is an exploded view of a part of the dishwasher including a lift apparatus according to another embodiment. FIG. 35 is an exploded perspective view of the lift apparatus shown in FIG. 34. FIG. 36 is a view illustrating a state of the lift apparatus when the trigger locks the upper door. FIG. 37 is a view illustrating a state of the lift apparatus when the trigger unlocks the upper door.

In the description of the embodiment illustrated in FIGS. 34 to 37, the same reference numerals may be given to the same elements as in the above-described embodiments, and a description thereof may be omitted.

Referring to FIGS. 34 and 35, a lift apparatus 460 of the dishwasher 100 may be disposed on a cover frame 4150. The cover frame 4150 may include a lifter coupling portion 4149. The lifter coupling portion 4139 may include a driving source mounting portion 4149*a* to which a driving source 461 of the lift apparatus 460 is mounted, a driving shaft hole 4139*b* into which a driving shaft 461*a* of the driving source 461 is inserted, and a push member through hole 4159*c* formed to penetrate the cover frame 4150 such that the push member 463 may lift the lower surface of the upper door 3120. The upper door 3120 may include an upper frame 3121 and a lower frame 3122.

The lift apparatus 460 may include a driving source 461, a support 462 connected to the driving source 461, a push member 463 connected to the support 462, and a driving source fixing portion 464 having a driving source insertion hole 464*a* into which the driving source 461 is inserted and fixed, a driving source support member 465 having a shaft insertion hole 465*a* into which the driving shaft 461*a* of the driving source 461 is inserted, a guide member 466 having a first guide slit 466*a* for guiding a connection shaft 469 for guiding the vertical movement of the push member 463, and a restriction support member 467 having a second guide slit 467*a* for guiding the connection shaft 469 and provided with restriction members 468*a* and 468*b* for restricting a vertical movement range of the connection shaft 469.

The driving source 461 may be a motor. The driving source may be capable of both forward rotation and reverse rotation. The driving shaft 461*a* of the driving source 461 may be rotatably inserted into the shaft insertion hole 465*a* of the driving source support member 465.

The support 462 may include a shaft connection portion 462*a* connected to the driving shaft 461*a* of the driving source 461 to receive power from the driving source 461. A connection shaft insertion hole 462*b* into which the connection shaft 469 is inserted may be provided at the other end opposite to one end of the support 462 on which the shaft connection portion 462*a* is formed, that is, at a portion of the support 462 inserted into a support groove 463*d* of the push member 463.

The push member 463 may be ascended and descended by the support 462. The push member 463 may include a connection hole 463*a* connected to the connection shaft 469. The push member 463 may include the support groove 463*d* into which a portion of the support 462 in which the connection shaft insertion hole 462*b* is formed is inserted.

The lift apparatus 460 may further include a coupling member 463*b* such that the push member 463 may be easily coupled to the push member through hole 4159*c*. The coupling member 463*b* may be provided with a push member insertion hole 463*c* into which the push member 463 is inserted.

The restriction members 468*a* and 468*b* may include the first restriction member 468*a* and the second restriction member 468*b* to restrict the movement of the connection shaft 469 in the up-down direction.

Referring to FIG. 36, when the upper door 3120 is closed, that is, when the trigger 440 shown in FIGS. 27 and 28 maintains a locked state of the upper door 3120, the push member 463 may be in a lowered position and the connection shaft 469 may come into contact with a restriction portion 468*ba* of the second restriction member 468*b*.

Referring to FIG. 37, when the upper door 3120 is opened, that is, when the trigger 440 shown in FIGS. 27 and 28 releases the locking of the upper door 3120, the control module 449 may drive the driving source 461 to rotate the support 462 in the counterclockwise direction. The control module 449 may be electrically connected to the driving source 461. As the support 462 rotates in the counterclockwise direction, the push member 463 may move upward to lift the upper door 3120 by a predetermined angle.

At this time, the connection shaft 469 may move upward along the first guide slit 466*a* and the second guide slit 467*a*, and when the connection shaft 469 meets the restriction portion 468*aa* of the first restriction member 468*a*, the movement of the connection shaft 469 upward may be terminated.

Thereafter, when the user operates the trigger 440 again, the driving source 461 may rotate the support 462 in the clockwise direction, and thus the push member 463 may descend to reach the original position thereof. In detail, the connection shaft 469 may move downward along the first guide slit 466*a* and the second guide slit 467*a*, and when the connection shaft 469 meets the restriction portion 468*ba* of the second restriction member 468*b*, the movement of the connection shaft 469 downward may be terminated.

Figure 38:
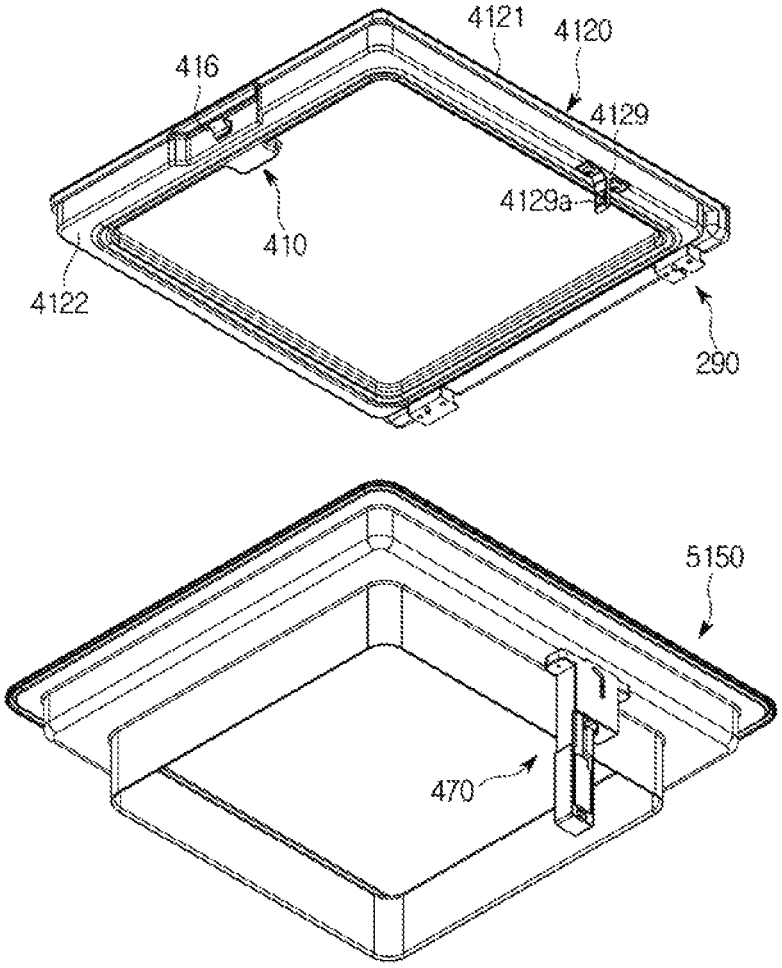
FIG. 38 is an exploded view of a part of the dishwasher including a lift apparatus according to another embodiment.
Figure 39:
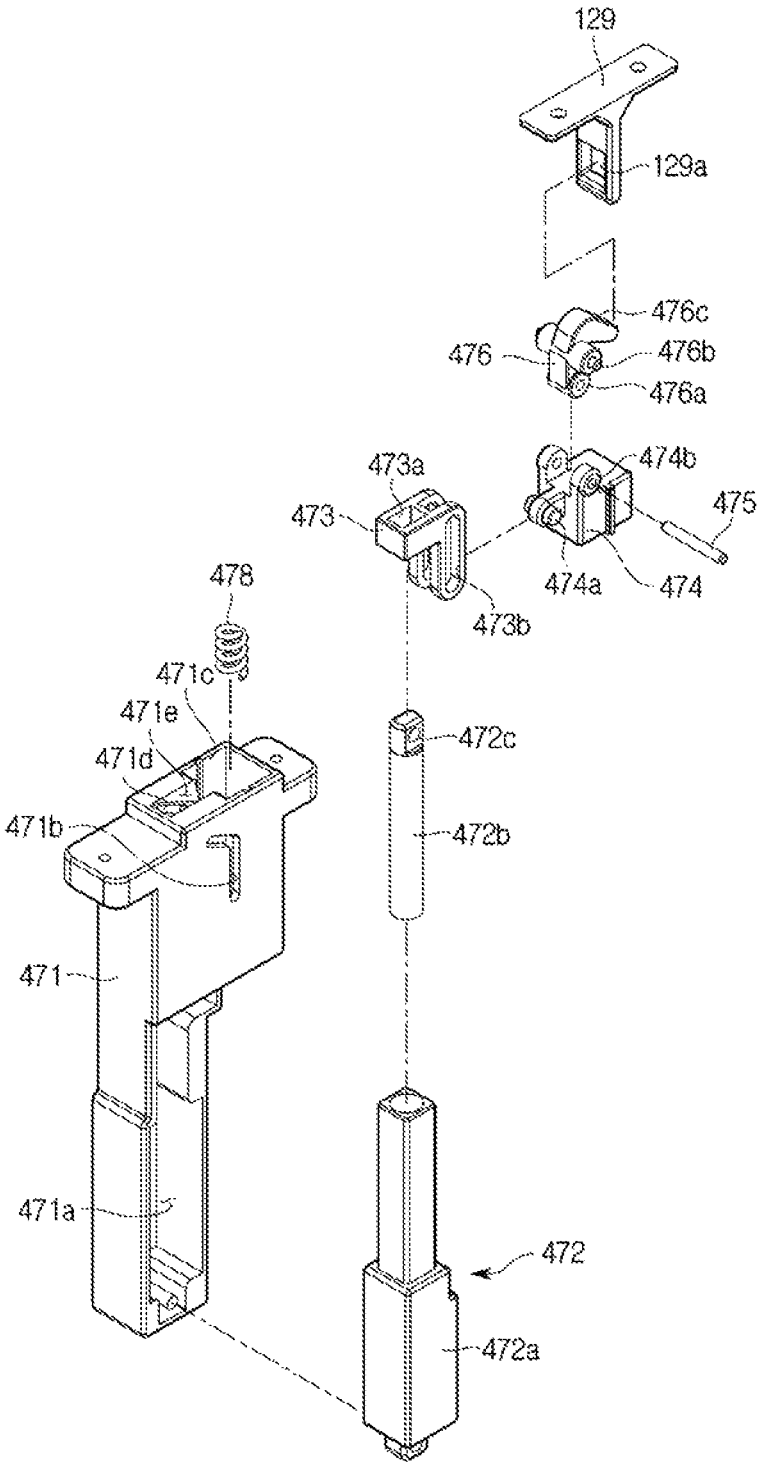
FIG. 39 is an exploded perspective view of the lift apparatus shown in FIG. 38.
Figure 40:
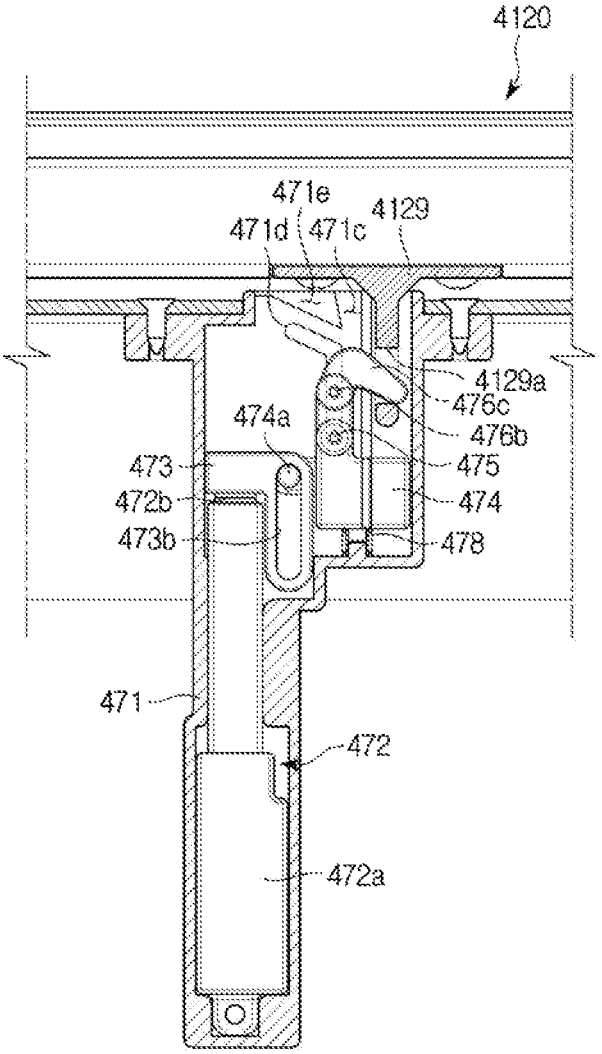
FIG. 40 is a view illustrating a state of the lift apparatus when the trigger locks the upper door.
Figure 41:
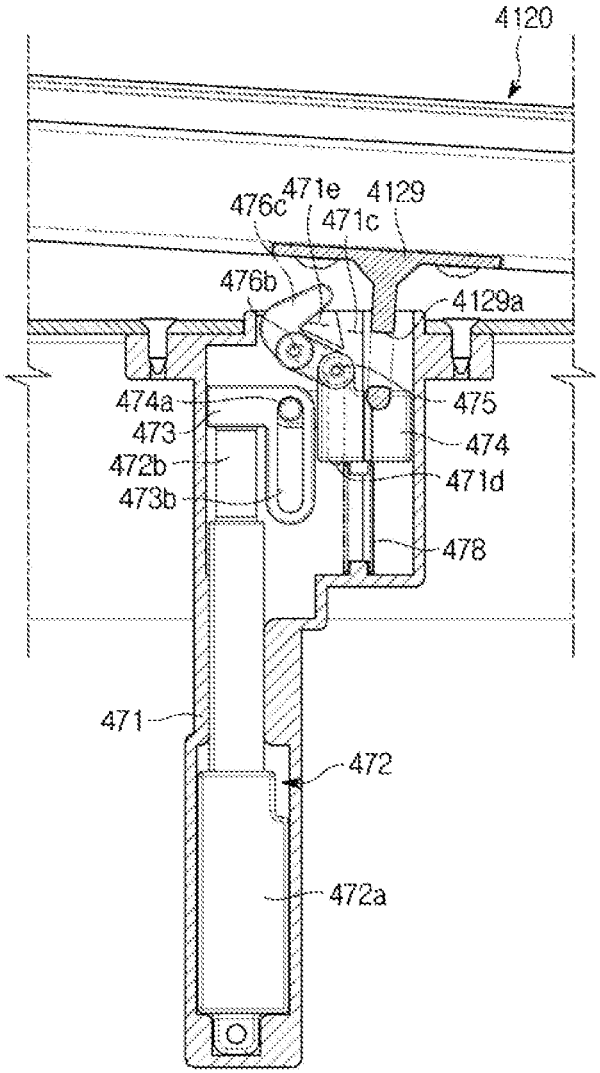
FIG. 41 is a view illustrating a state of the lift apparatus when the trigger unlocks the upper door.

FIG. 38 is an exploded view of a part of the dishwasher including a lift apparatus according to another embodiment. FIG. 39 is an exploded perspective view of the lift apparatus shown in FIG. 38. FIG. 40 is a view illustrating a state of the lift apparatus when the trigger locks the upper door. FIG. 41 is a view illustrating a state of the lift apparatus when the trigger unlocks the upper door.

In the description of the embodiment illustrated in FIGS. 38 to 41, the same reference numerals may be given to the same elements as in the above-described embodiments, and a description thereof may be omitted.

Referring to FIG. 38, an upper door 4120 may include a catch member 4129 disposed on a lower surface thereof. The catch member 4129 may include a through hole 4129*a* provided such that a hook member 476 is selectively inserted therein, which will be described later. The upper door 4120 may include an upper frame 4121 and a lower frame 4122. A lift apparatus 470 may be disposed on a cover frame 5150.

Referring to FIG. 39, the lift apparatus 470 includes a lift case 471, a driving unit 472, a support 473, a connection member 474, a connection shaft 475, the hook member 476, and an elastic member 478.

The lift case 471 receives the driving unit 472, the support 473, the connection member 474, the connection shaft 475, the hook member 476, and the elastic member 478 therein. The lift case 471 may include a driving unit mounting portion 471*a* on which the driving unit 472 is mounted, and a first guide slit 471*b* and a second guide slit 471*d* for guiding the movement of the connection shaft 475 and a hook shaft 476*b*.

The lift case 471 may include a space 471*e* so as not to interfere with the rotation of the hook member 476. The lift case 471 may include a space 471*c* into which a catch member 129 is inserted.

The driving unit 472 may include a driving source 472*a*, a driving shaft 472*b*, and a support connection portion 472*c*. The driving shaft 472*b* may be provided to be movable up and down with respect to the driving source 472*a*. The support 473 may be fixed to the support connection portion 472*c*.

The support 473 may include a driving shaft fixing portion 473*a* and a connection guide slit 473*b*. The support connection portion 472*c* may be inserted into and fixed to the driving shaft fixing portion 473*a*. A connection shaft 474*a* of the connection member 474 may be slidingly inserted into the connection guide slit 473*b*.

The connection member 474 may include the connection shaft 474*a* slidingly inserted into the connection guide slit 473*b* and moving up and down. The connection member 474 may include a first connection shaft insertion hole 474*b* into which the connection shaft 475 is inserted.

The connection shaft 475 may be rotatably inserted into the first connection shaft insertion hole 474*b* and a second connection shaft insertion hole 476*a* formed to correspond to the first connection shaft insertion hole 474*b*.

The hook member 476 may include the second connection shaft insertion hole 476*a* into which the connection shaft 475 is inserted. The hook member 476 may include the hook shaft 476*b* inserted into the first guide slit 471*b* and the second guide slit 471*d* and sliding therein. The hook member 476 may include a hook portion 476*c* selectively inserted into a through hole 129*a* of the catch member 129.

The elastic member 478 may have one end fixed to a lower side of the connection member 474 and the other end fixed to the lift case 471 to elastically bias the connection member 474 in the upward direction.

Referring to FIG. 40, when the upper door 120 is closed, the connection member 474 is pressed upward by the elastic member 478, the driving unit 472 pulls the connection member 474 downward with a force greater than that of the elastic member 478. Accordingly, the connection shaft 474*a* may be positioned at an upper side of the connection guide slit 473*b*. In addition, the hook portion 476*c* may be coupled to the through hole 129*a*. Accordingly, the upper door 120 may maintain a locked state.

Referring to FIG. 41, when the upper door 120 is opened, the driving unit 472 releases a force for pulling the connection member 474, and thus the elastic member 478 may lift the connection member 474 upwards.

At this time, the connection shaft 475 and the hook shaft 476*b* may move upward along the first guide slit 471*b* and the second guide slit 471*d*. The driving shaft 472*b* and the support 473 may be moved upward by the connection shaft 474*a*.

As the hook shaft 476*b* enters bent portions of the first guide slit 471*b* and the second guide slit 471*d*, that is, the portions changing in a diagonal direction, the hook portion 476*c* may escape from the through hole 129*a*. Subsequently, the connection member 474 may lift the catch member 129 by receiving a force from the elastic member 478 in the upward direction to open the upper door 120 by a predetermined angle.

Figure 42:
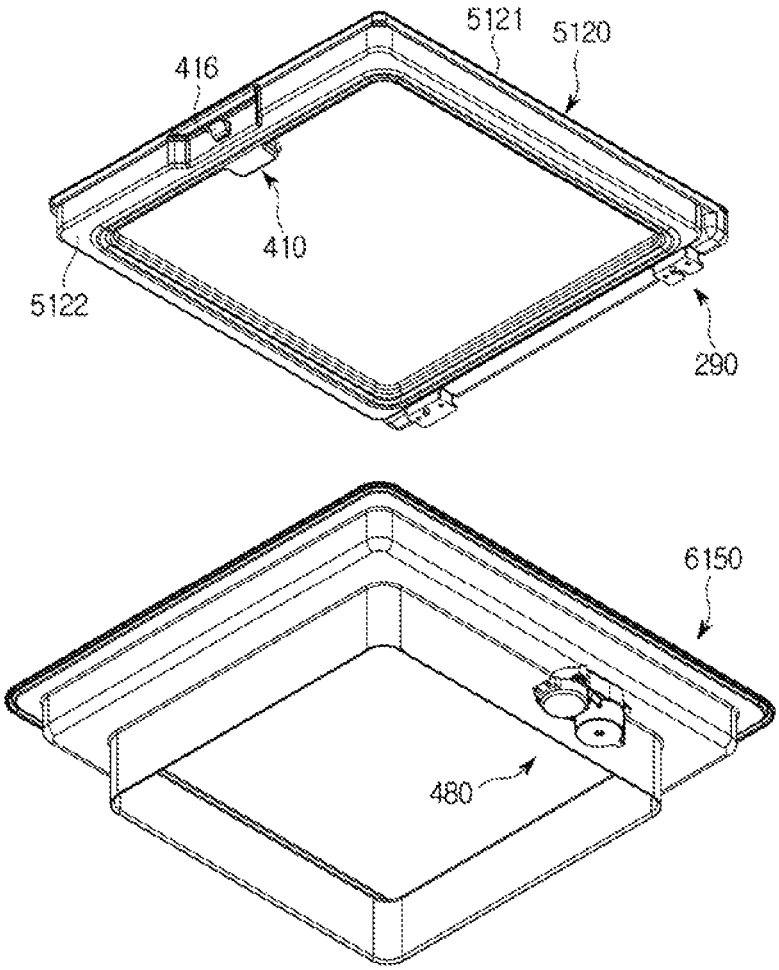
FIG. 42 is an exploded view of a part of the dishwasher including a lift apparatus according to another embodiment.
Figure 43:
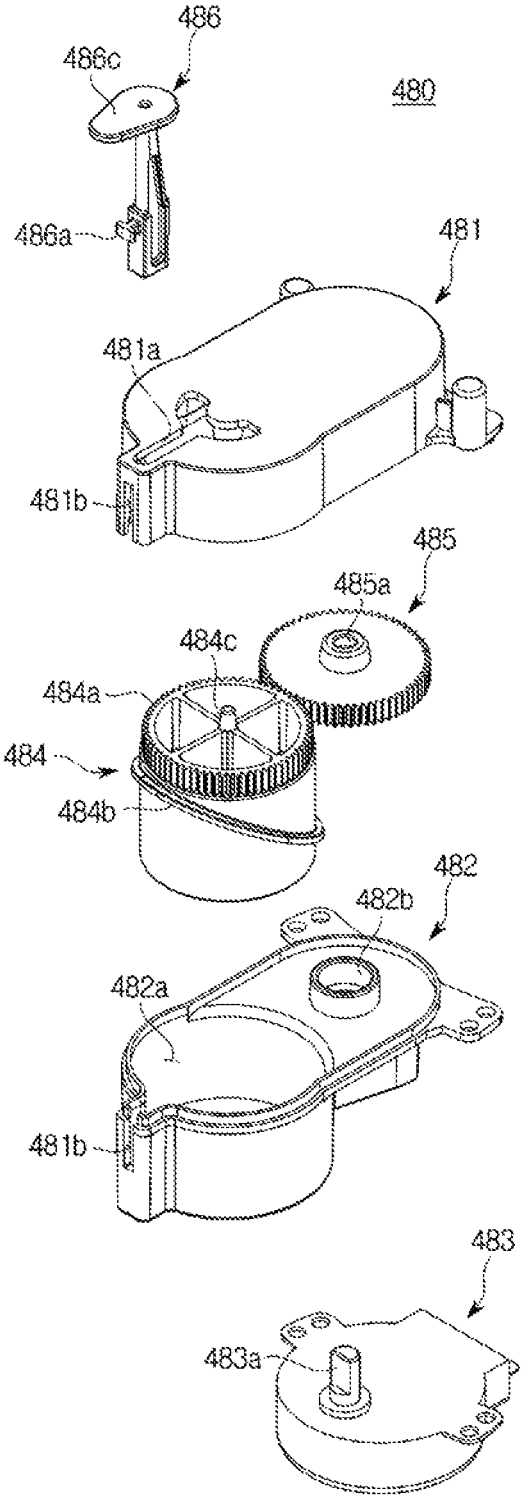
FIGS. 43 and 44 are exploded perspective views of the lift apparatus shown in FIG. 42.
Figure 44:
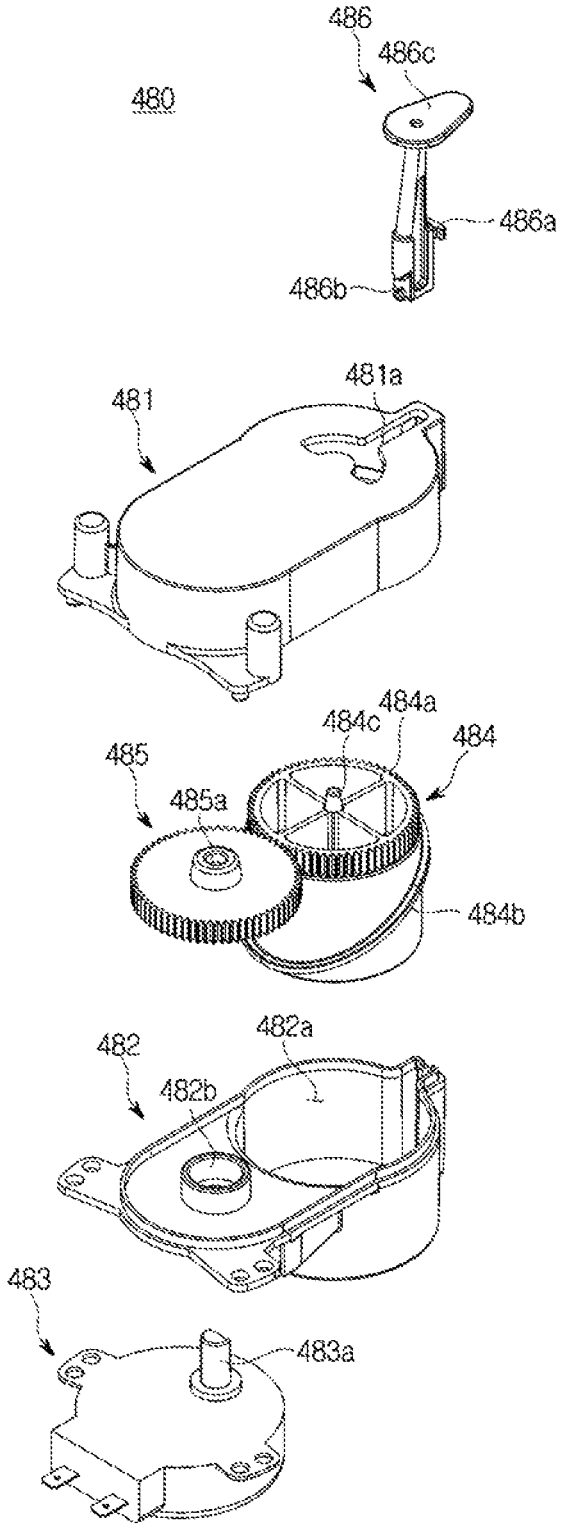
Figure 45:
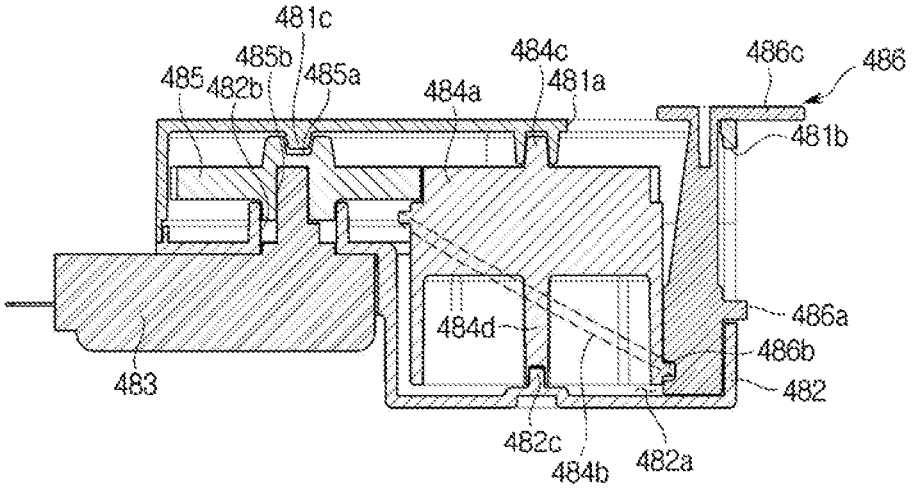
FIG. 45 is a view illustrating a state of the lift apparatus when the trigger locks the upper door.
Figure 46:
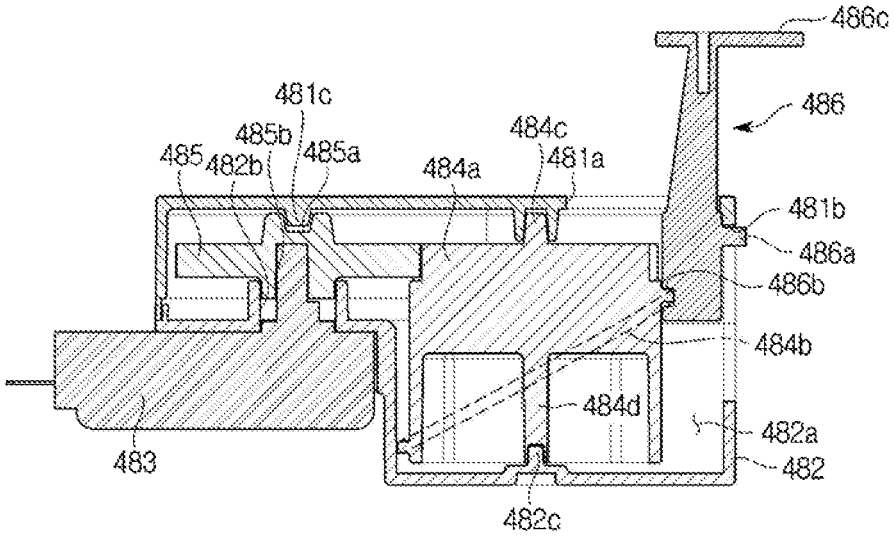
FIG. 46 is a view illustrating a state of the lift apparatus when the trigger unlocks the upper door.

FIG. 42 is an exploded view of a part of the dishwasher including a lift apparatus according to another embodiment. FIGS. 43 and 44 are exploded perspective views of the lift apparatus shown in FIG. 42. FIG. 45 is a view illustrating a state of the lift apparatus when the trigger locks the upper door. FIG. 46 is a view illustrating a state of the lift apparatus when the trigger unlocks the upper door.

In the description of the embodiment illustrated in FIGS. 42 to 46, the same reference numerals may be given to the same elements as in the above-described embodiments, and a description thereof may be omitted.

Referring to FIG. 42, a lift apparatus 480 may be disposed on a cover frame 6150. An upper door 5120 may include an upper frame 5121 and a lower frame 5122.

Referring to FIG. 43, the lift apparatus 480 may include an upper case 481, a lower case 482, a driving source 483, power transmission members 484 and 485, and a push member 486.

The upper case 481 may include a push member guide 481*a* to guide the push member 486 such that the push member 486 may be inserted therein and moved up and down, and a protrusion guide 481*b* to guide the vertical movement of a protrusion 486*a* of the push member 486. The protrusion guide 481*b* may extend to the lower case 482.

The lower case 482 is disposed below the upper case 481 and may include a space 482*a* in which the first power transmission member 484 is disposed. The lower case 482 may include a shaft through hole 482*b* through which a driving shaft 483*a* of the driving source 483 penetrates.

The driving source 483 may be a motor.

The power transmission members 484 and 485 may include the first power transmission member 484 and the second power transmission member 485. The second power transmission member 485 may receive power from the driving source 483 and transmit the power to the first power transmission member 484, and the first power transmission member 484 may move the push member 486 up and down with the received power.

The first power transmission member 484 may have an upper end portion 484*a* formed in a gear shape. The first power transmission member 484 may include a rotation shaft 484*c*. The first power transmission member 484 may include a guide protrusion 484*b* inserted into a guide groove 486*b* of the push member 486. The guide protrusion 484*b* may extend along an outer circumferential surface of the first power transmission member 484 in a direction inclined with respect to the direction of the rotation shaft 484*c* of the first power transmission member 484.

The second power transmission member 485 may include a power transmission shaft 485*a* inserted into the shaft through hole. An outer circumferential surface of the second power transmission member 485 may have a gear shape to correspond to the upper end portion 484*a* of the first power transmission member 484.

The push member 486 may include a push portion 486*c* in contact with a lower surface of the upper door 5120 to lift the upper door 5120 by a predetermined angle. The push member 486 may include the protrusion 486*a* moving in the vertical direction by the protrusion guide 481*b*. The push member 486 may include the guide groove 486*b* into which the guide protrusion 484*b* is inserted.

Referring to FIG. 45, when the upper door 5120 is closed, the guide protrusion 484*b* inserted into the guide groove 486*b* is disposed at a lower side of the first power transmission member 484, and thus the protrusion 486*a* may also be positioned at a lower side of the protrusion guide 481*b*.

Referring to FIG. 46, when the upper door 5120 is opened, the driving source 483 rotates the second power transmission member 485, and the second power transmission member 485 rotates the first power transmission member 484. Accordingly, the position of the guide protrusion 484*b* is changed, and the push member 486 moves upward by receiving power from the guide protrusion 484*b*.

The power transmission shaft 485*a* of the second power transmission member 485 may be rotatably inserted into an inner protrusion 481*c* of the upper case 481. The driving shaft 483*a* of the driving source 483 may be inserted into a shaft hole 485*b* of the second power transmission member 485. The first power transmission member 484 may include a rotation shaft 484*d* disposed at a lower end thereof to be coupled to an inner protrusion 482*c* of the lower case 482.

In this case, the protrusion 486*a* is also guided by the protrusion guide 481*b* to move upward. Accordingly, the push portion 486*c* of the push member 486 may come into contact with a lower surface of the upper door 120 to lift the upper door 5120 by the predetermined angle.

The dishwasher may itself be provided in a kitchen, without being installed in the system kitchen in a built-in manner. This type of dishwasher is defined as a free standing type dishwasher. Hereinafter, the free standing type dishwasher will be described.

Figure 47:
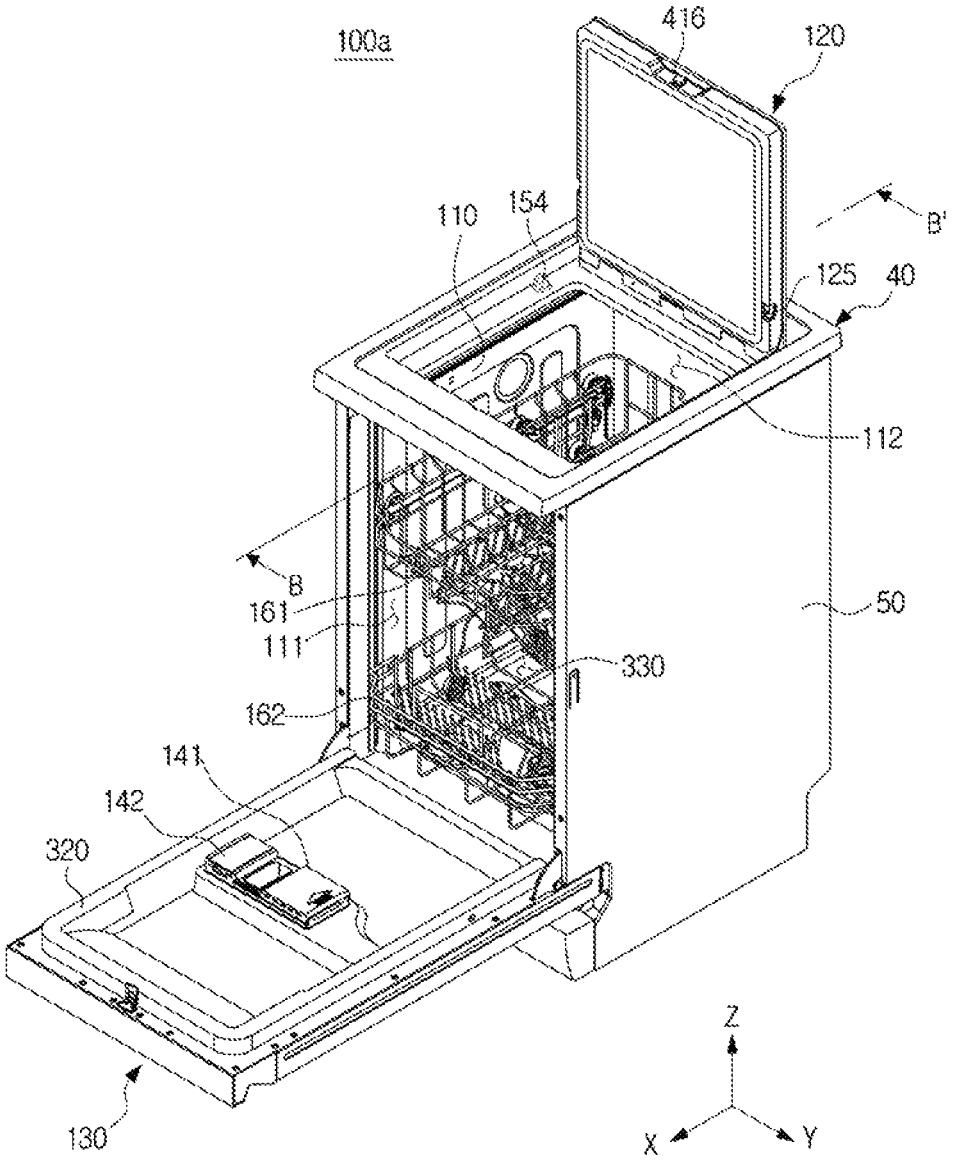
FIG. 47 is a view illustrating a dishwasher according to another embodiment of the present disclosure.
Figure 48:
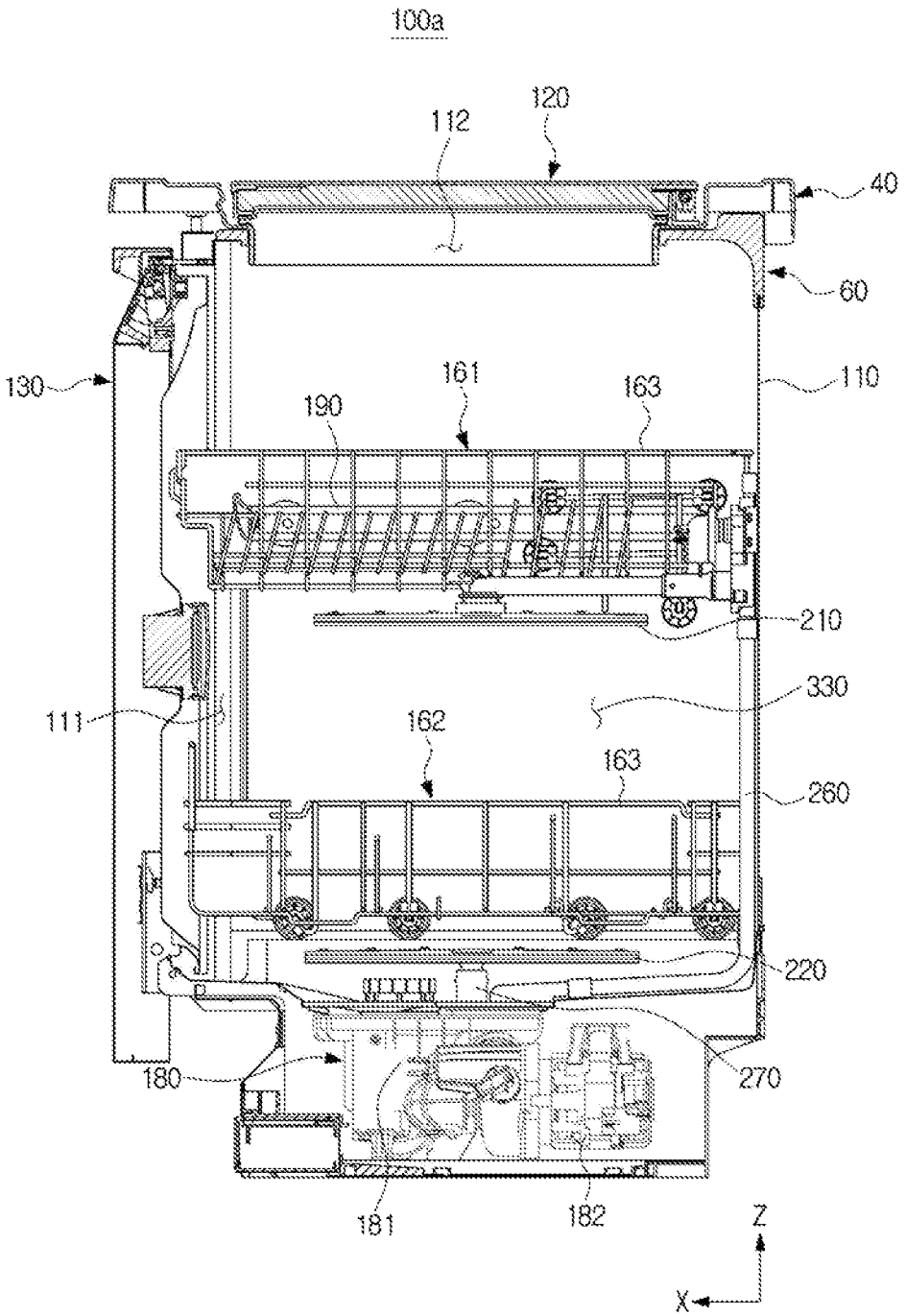
FIG. 48 is a cross-sectional view taken along line B-B' shown in FIG. 47.
Figure 49:
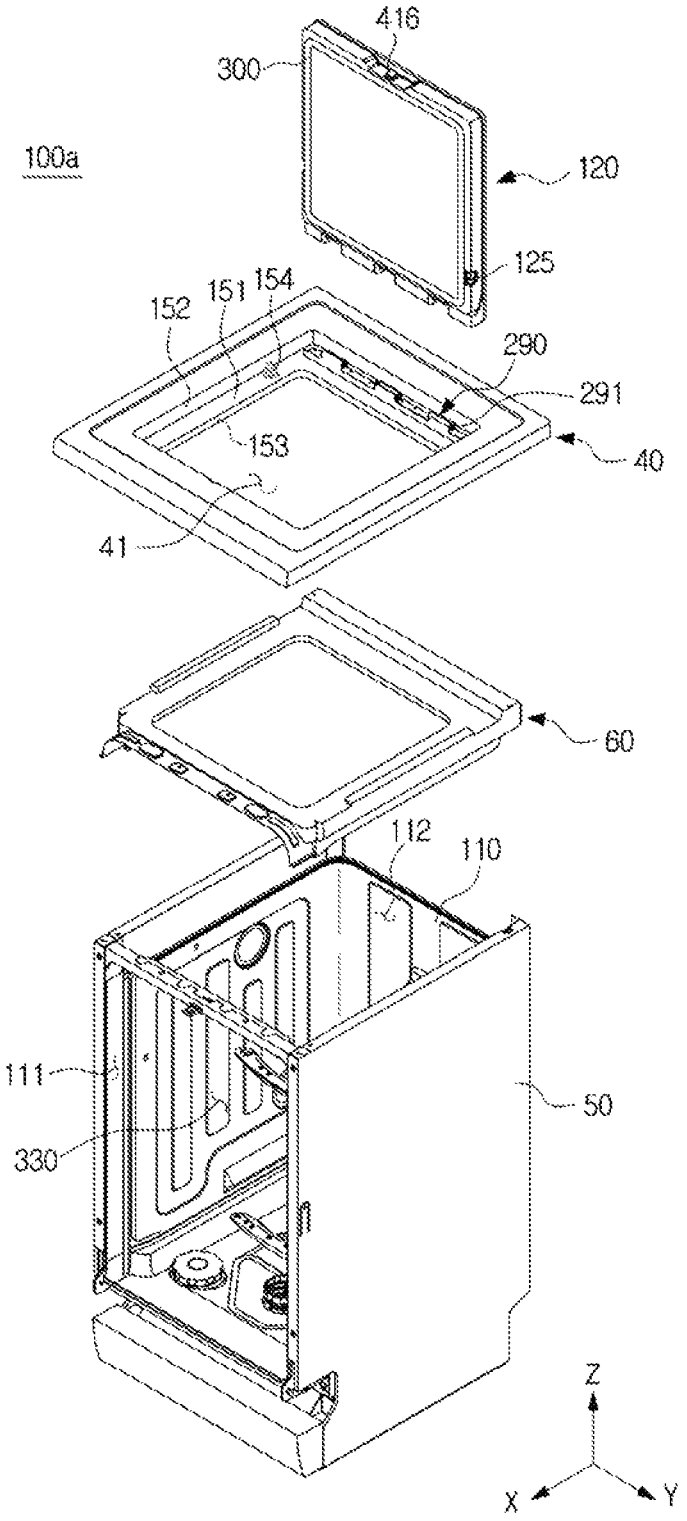
FIG. 49 is an exploded perspective view of the dishwasher shown in FIG. 47.

FIG. 47 is a view illustrating a dishwasher according to another embodiment of the present disclosure. FIG. 48 is a cross-sectional view taken along line B-B' shown in FIG. 47. FIG. 49 is an exploded perspective view of the dishwasher shown in FIG. 47.

Hereinafter, a description overlapping with the description of the built-in type dishwasher will be omitted. The front door 130 is not shown in FIG. 49.

As illustrated in FIGS. 47 to 49, a dishwasher 100*a* may include a housing 50 forming an appearance.

The dishwasher 100*a* may further include the tub 110 having the washing space 330 formed therein. The tub 110 may be disposed inside the housing 50. The tub 110 may include the front opening 111 capable of being opened and closed by the front door 130. Preferably, the front opening 111 may be larger than an opening 41 formed on a cover frame 40. The tub 110 may further include the upper opening 112 provided to correspond to the opening 41 formed on the cover frame 40.

The dishwasher 100*a* may include a plurality of the doors 1120 and 130 for the convenience of a user. In detail, the dishwasher 100*a* may include the upper door 120 provided to enable top loading of the dishes and the front door 130 provided to enable front loading of the dishes. The upper door 120 and the front door 130 may be rotatably installed. However, the installation form of the upper door 120 and the front door 130 is not limited to the above example and may be variously changed. Hereinafter, a case where the upper door 120 and the front door 130 are rotatably installed will be described. The upper door 120 may be rotatably installed on the cover frame 40. The front door 130 may be rotatably installed on the tub 110.

The front door 130 may be provided with at least one of the detergent box 141 configured to supply a detergent to the inside of the tub 110 and the rinse box 142 configured to supply a rinse to the inside of the tub 110.

The dishwasher 100*a* may further include the cover frame 40. The cover frame 40 may be disposed above the tub 110. The upper door 120 may be installed to the cover frame 40.

The cover frame 40 may include the seating portion 151 configured to seat the upper door 120 thereon. In detail, the upper door hinge 290 including the hinge shaft 291 may be mounted on the seating portion 151 of the cover frame 40. The upper door 120 may be coupled to the upper door hinge 290 to be rotatable about the hinge shaft 291. The hinge shaft 291 of the upper door hinge 290 may extend in the left-right direction Y of the dishwasher 100*a*.

The cover frame 40 may further include a first wall 152 extending from the seating portion 151 in the up-down direction Z of the dishwasher 100*a*. In detail, the first wall 152 may extend in the up-down direction Z of the dishwasher 100*a* to direct upward of the dishwasher 100*a* from an outer end of the seating portion 151. The seating portion 151 may face the lower surface of the upper door 120, and the first wall 152 may face a side surface of the upper door 120. In another aspect, the seating portion 151 and the first wall 152 may define an upper door receiving space in which the upper door 120 is received.

The cover frame 40 may further include a second wall 153 extending in the up-down direction Z of the dishwasher 100*a* from the seating portion 151. In detail, the second wall 153 may extend in the height direction Z of the dishwasher 100*a* to direct downward of the dishwasher 100*a* from an inner end of the seating portion 151.

The first wall 152 may extend further in the up-down direction Z of the dishwasher 100*a* than the second wall 153. That is, the first wall 152 may have a higher height in the up-down direction Z of the dishwasher 100*a* than the second wall 153.

A space defined by the first wall 152 may have a wider width in the left-right direction Y of the dishwasher 100*a* than a space defined by the second wall 153.

The dishwasher 100*a* may further include the upper door sealing member 300. The upper door sealing member 300 may be coupled to the upper door 120. The upper door sealing member 300 may serves to compensate for sealing a gap between the upper door 120 and the cover frame 40 to prevent washing water inside the tub 110 from leaking to the outside of the upper door 120. The upper door sealing member 300 may be formed of an elastic material. As an example, the upper door sealing member 300 may be formed of rubber or the like.

The dishwasher 100*a* may further include a connection frame 60 disposed between the tub 110 and the cover frame 40. The connection frame 60 may be disposed between the cover frame 40 and the tub 110 in the up-down direction Z of the dishwasher 100*a* to connect the cover frame 40 to the tub 110.

The dishwasher 100*a* may further include the one or more baskets 161 and 162 disposed inside the tub 110 to be withdrawable through the front opening 111. The one or more baskets 161 and 162 may be referred to as "front loading baskets." As an example, the dishwasher 100*a* may include the upper basket 161 disposed at an upper portion of the tub 110 in the up-down direction Z of the dishwasher 100*a*, and the lower basket 162 disposed below the upper basket 161 in the up-down direction Z of the dishwasher 100*a*. A description of the one or more baskets 161 and 162 will be omitted because it overlaps with those described with reference to FIGS. 16 and 17.

The dishwasher 100*a* may further include the front door sealing member 320. The front door sealing member 320 may be coupled to the front door 130. The front door sealing member 320 serves to compensate for sealing a gap between the tub 110 and the front door 130 to prevent washing water inside the tub 110 from leaking to the outside of the front door 130. The front door sealing member 320 may be formed of an elastic material. As an example, the front door sealing member 320 may be formed of rubber or the like.

The front door 130 of the dishwasher 100*a* may form a front appearance of the dishwasher 100*a*.

The upper door 120 of the dishwasher 100*a* may form an upper appearance of the dishwasher 100*a*. In detail, the upper door 120 of the dishwasher 100*a* may form the upper appearance of the dishwasher 100*a* together with the cover frame 40.

The dishwasher 100*a* may include the trigger 410 configured to lock or unlock the upper door 120 shown in FIGS. 20 and 21. However, the present disclosure is not limited thereto, and the dishwasher 100*a* may include the triggers 430 and 440 shown in FIGS. 25 to 27.

In addition, the dishwasher 100*a* may include the lift apparatus 420 shown in FIGS. 22 to 24. However, the present disclosure is not limited thereto, and the dishwasher 100*a* may include the 1 lift apparatuses 450, 460, 470, and 480 shown in FIGS. 29 to 46.

Figure 50:
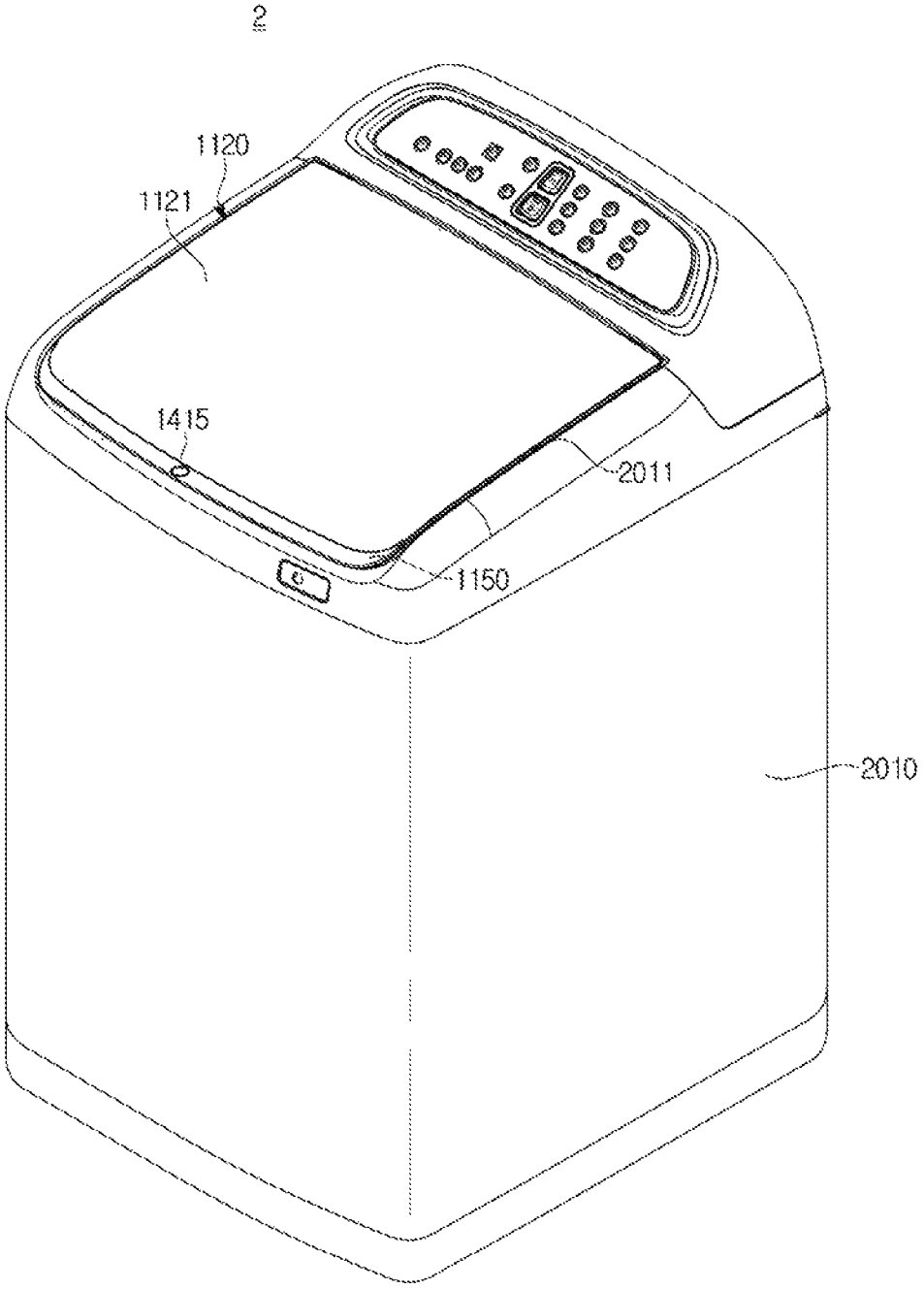
FIG. 50 is a view illustrating a washing machine including the upper door shown in FIG. 5.

FIG. 50 is a view illustrating a washing machine including the upper door shown in FIG. 5.

Referring to FIG. 50, a washing machine 2 may include a cabinet 2010 forming an appearance thereof, a tub (not shown) disposed inside the cabinet 2010 to store washing water, a drum (not shown) rotatably disposed inside the tub, and a pulsator (not shown) disposed inside the drum to generate water flow.

An opening 2011 may be formed at an upper portion of the cabinet 2010 to put laundry into the drum. The opening 2011 may be opened and closed by the upper door 1120. An upper frame 1121 of the upper door 1120 may be provided to be transparent such that the inside is visible even when the opening 2011 is closed. The upper door 1120 may be rotatably mounted to the cover frame 1150 mounted in the opening 2011.

Because the upper door 1120 has the same configuration as the upper door 1120 shown in FIG. 5, a detailed description thereof will be omitted. Accordingly, as the user presses a button 1415 of the upper door 1120, the upper door 1120 may be automatically opened by a predetermined angle. In a case of closing the upper door 1120, when the user applies a force to close only by a certain angle, the upper door 1120 may be automatically closed completely.

Figure 51:
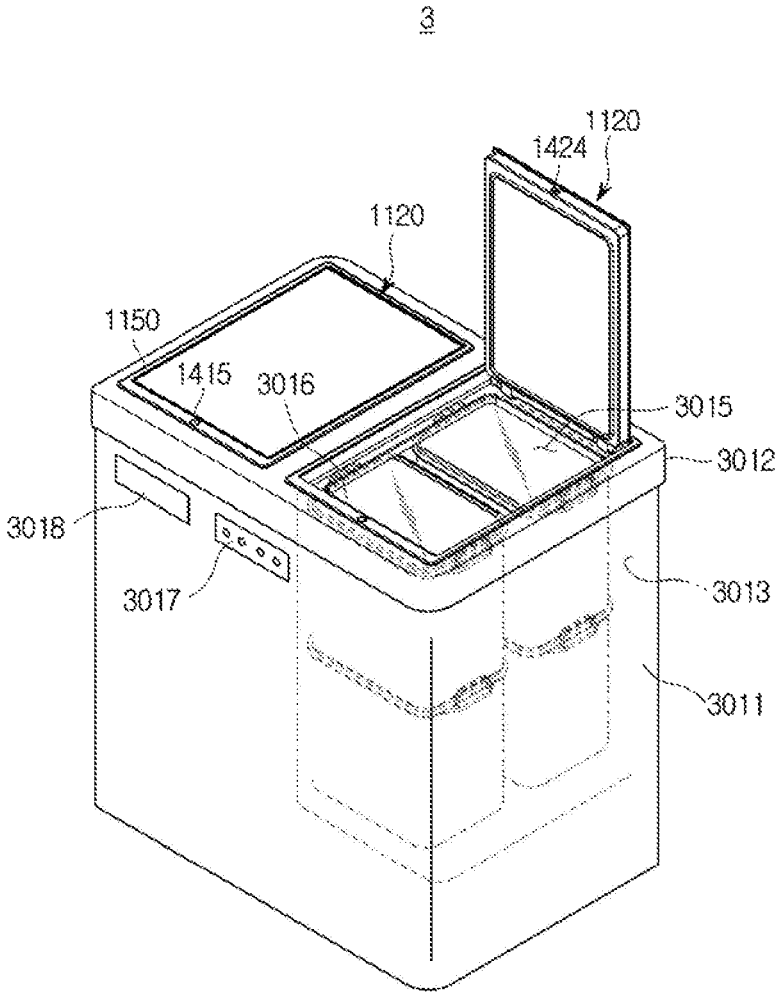
FIG. 51 is a view illustrating a refrigerator including the upper door shown in FIG. 5.

FIG. 51 is a view illustrating a refrigerator including the upper door shown in FIG. 5.

Referring to FIG. 51, a refrigerator 3 includes a plurality of storage chambers 3013 provided in a cabinet 3011 forming a box-shaped exterior to mature food or store food at a low temperature, and a cooling system (not shown) configured to lower the temperature of the storage chambers 3013 to store food at a low temperature. The cooling system includes a compressor, a condenser and an evaporator.

The cabinet 3011 may include an upper cabinet 3012. An opening 3015 may be formed in the upper cabinet 3012, and the cover frame 1150 may be mounted in the opening 3015. The upper door 1120 may be rotatably mounted to the cover frame 1150.

The plurality of storage chambers 3013 has a structure in which an upper side thereof is open and is formed in pairs to be arranged in parallel on the left and right sides of the cabinet 3011. The storage chamber 3013 may be provided with a plurality of storage containers 3016. The storage chamber 3013 may be opened and closed by the upper door 1120.

An operating portion 3017 and a display 3018 may be provided on a front surface of the cabinet 3011. The display 3018 may display a storage temperature, a storage time, and the like, and the operating portion 3017 may receive a command of the user for the operation of the refrigerator 3. The operating portion 3017 and the display 3018 may be provided integrally in the form of a touch screen or the like, or may be provided separately. The display 3018 may be configured with an LCD, an LED, a PDP, and the like, and a configuration thereof is not limited. The operating portion 3017 may also be configured with a switch, a button, a slide bar, a dial, and the like without limitation.

Because the upper door 1120 has the same configuration as the upper door 1120 shown in FIG. 5, a detailed description thereof will be omitted. Accordingly, as the user presses a button 3022 of an upper door 3020, the upper door 3020 may be automatically opened by a predetermined angle by the configuration of a latch head 1424 and the like. In a case of closing the upper door 1120, when the user applies a force to close only by a certain angle, the upper door 1120 may be automatically closed completely.

While the present disclosure has been particularly described with reference to exemplary embodiments, it should be understood by those of skilled in the art that various changes in form and details may be made without departing from the spirit and scope of the present disclosure.

The invention claimed is:

1. A dishwasher, which is installed in a built-in manner in a system kitchen comprising a cabinet having a receiving space and a counter disposed on the cabinet to include an opening, comprising:

a tub having a front opening;

a front door configured to open and close the front opening;

a cover frame disposed in the opening of the counter;

an upper door rotatably coupled to the cover frame to open and close the opening of the counter;

a first connection member configured to connect the cover frame and the tub, the first connection member being capable of extending and contracting in the height direction of the system kitchen;

a trigger configured to lock or unlock the upper door; and a lift apparatus disposed to be spaced apart from the trigger and configured to open the upper door by a predetermined angle when the trigger releases the locking of the upper door.

2. The dishwasher according to claim 1, further comprising a latch-locker module configured to support a portion of the lift apparatus or to be coupled to the lift apparatus as the latch-locker module is selectively pressed by the trigger, wherein the trigger is disposed on the cover frame, and the latch-locker module and the lift apparatus are disposed inside the upper door.

3. The dishwasher according to claim 2, wherein the latch-locker module comprises a locker, the lift apparatus comprises a lifter supported by or coupled to the locker, and the lifter is configured to be coupled to the locker when the upper door is opened and to be supported by the locker when the upper door is closed.

4. The dishwasher according to claim 1, wherein the trigger is disposed on the other end opposite to one end on which a rotation shaft of the upper door is disposed, and the cover frame comprises a locking opening into which a portion of the trigger is selectively inserted.

5. The dishwasher according to claim 1, wherein the trigger is disposed on a portion of the cover frame close to the other end opposite to the one end on which a rotation shaft of the upper door is disposed, and the upper door comprises a locking opening into which a portion of the trigger is selectively inserted.

6. The dishwasher according to claim 1, wherein the trigger comprises:

a locking member configured to be movable between a locking position and an unlocking position;

an elastic member configured to elastically bias the locking member to the locking position; and a button member configured to move the locking member in a direction of releasing the locking of the upper door as the button member is pressed.

7. The dishwasher according to claim 1, wherein the trigger comprises:

a button member configured to be movable;

a locking member configured to be movable between a locking position and an unlocking position;

a driving apparatus configured to move the locking member between the locking position and the unlocking position; and a control module comprising a sensor configured to detect the movement of the button member to drive the driving apparatus.

8. The dishwasher according to claim 1, wherein the lift apparatus is disposed in the upper door, and the cover frame comprises a pressing portion to press a portion of the lift apparatus in a direction in which the upper door is opened when the upper door is closed.

9. The dishwasher according to claim 8, wherein the lift apparatus comprises:

an arm member pressed by the pressing portion when the upper door is closed; and an elastic member configured to elastically bias the arm member in a direction opposite to the direction in which the upper door is opened.

10. The dishwasher according to claim 1, wherein the lift apparatus is disposed on an upper end portion of the tub.

11. The dishwasher according to claim 10, wherein the lift apparatus comprises:

a driving source;

a cam connected to the driving source;

a support configured to move up and down by sliding on an outer circumferential surface of the cam as the cam rotates; and a push member in which one end thereof is in contact with the support to receive a force from the support and open the upper door by a predetermined angle and the other end opposite to the one end is disposed to be in contact with the upper door.

12. The dishwasher according to claim 11, wherein the push member comprises a push pin and a push shaft configured to be screw-coupled to the push pin, and a length of the push member is adjusted by adjusting a degree of screw coupling of the push shaft to the push pin.

13. The dishwasher according to claim 11, wherein the lift apparatus further comprises a switch configured to detect a rotational position of the cam.

14. The dishwasher according to claim 10, wherein the upper door further comprises a catch member disposed on a lower surface thereof, and the lift apparatus comprises:

a connection member;

a hook member rotatably connected to the connection member and configured to be connectable to the catch member;

a case comprising a guide slit to guide the movement of the connection member and the hook member;

an elastic member in which one end thereof is fixed to the case and the other end opposite to the one end is fixed to the connection member, the elastic member configured to elastically bias the connection member in a direction in which the upper door is opened; and a driving unit configured to apply a force to the connection member such that the connection member is movable in a direction in which the upper door is closed.

15. The dishwasher according to claim 10, wherein the lift apparatus comprises:

a driving source;

a power transmission member configured to receive power from the driving source and comprising a first guide portion formed at a portion along an outer circumferential surface thereof; and a push member comprising a second guide portion coupled to the first guide portion, wherein the push member is configured to open the upper door only by a predetermined angle as the power transmission member is driven.

* * * * *